US006296553B1

(12) United States Patent
Nishi et al.

(10) Patent No.: US 6,296,553 B1
(45) Date of Patent: Oct. 2, 2001

(54) GRINDING METHOD, SURFACE GRINDER, WORKPIECE SUPPORT, MECHANISM AND WORK REST

(75) Inventors: Kenichiro Nishi, Kanagawa; Mitsuru Nukui, Toyama; Shirou Murai, Toyama; Kazuo Nakajima, Toyama; Toyotaka Wada, Toyama, all of (JP)

(73) Assignee: Nippei Toyama Corporation, Tokyo (JP)

( * ) Notice: Subject to any disclaimer, the term of this patent is extended or adjusted under 35 U.S.C. 154(b) by 0 days.

(21) Appl. No.: 09/052,019

(22) Filed: Mar. 31, 1998

(30) Foreign Application Priority Data

| | | |
|---|---|---|
| Apr. 2, 1997 | (JP) | 9-083898 |
| Apr. 4, 1997 | (JP) | 9-102771 |
| Apr. 18, 1997 | (JP) | 9-116477 |
| Jun. 26, 1997 | (JP) | 9-185825 |

(51) Int. Cl.[7] ..... B24B 7/00
(52) U.S. Cl. ..... 451/259
(58) Field of Search ..... 451/269, 260, 451/262, 41, 59, 285, 287, 259

(56) References Cited

U.S. PATENT DOCUMENTS

| | | | | |
|---|---|---|---|---|
| 2,899,779 | | 8/1959 | Price | 51/118 |
| 3,818,640 | * | 6/1974 | Dunn | 451/24 |
| 4,319,432 | * | 3/1982 | Day | 451/288 |
| 4,586,296 | | 5/1986 | Saunders | 51/281 |
| 4,782,631 | * | 11/1988 | Nishio | 451/269 |
| 4,805,348 | * | 2/1989 | Arai et al. | 451/269 |
| 4,827,677 | * | 5/1989 | Schmitz | 451/11 |
| 5,121,572 | * | 6/1992 | Hilscher | 451/269 |
| 5,152,104 | * | 10/1992 | Wood et al. | 451/269 |
| 5,511,005 | | 4/1996 | Abbe et al. | 364/552 |
| 5,533,924 | | 7/1996 | Stroupe et al. | 451/286 |
| 5,558,560 | * | 9/1996 | Uchida | 451/24 |
| 5,642,298 | | 6/1997 | Mallory et al. | 364/561 |
| 5,755,613 | * | 5/1998 | Uchida et al. | 451/41 |
| 5,873,772 | * | 2/1999 | Hajime et al. | 451/41 |

FOREIGN PATENT DOCUMENTS

| | | | |
|---|---|---|---|
| 38 13 031 | 11/1989 | (DE) | B24B/49/10 |
| 197 39 265 | 3/1998 | (DE) | B24B/7/04 |
| 0 150 074 | 7/1985 | (EP) | B24B/7/04 |
| 0 405 301 | 1/1991 | (EP) | H01L/21/00 |
| 0 575 296 | 12/1993 | (EP) | B24B/7/04 |
| 0 729 073 | 8/1996 | (EP) | G03F/7/20 |
| 1 469 658 | 4/1977 | (GB) . | |
| 2 186 823 | 8/1987 | (GB) | B24B/7/17 |
| 54-23608 | 7/1952 | (JP) . | |
| 4-13076 | 3/1985 | (JP) . | |
| 60-155358 | 8/1985 | (JP) . | |
| 3-266430 | 11/1991 | (JP) . | |
| 6-304854 | 11/1994 | (JP) . | |
| 8-162430 | 6/1996 | (JP) . | |
| 3028734 * | 6/1996 | (JP) | B23Q/15/12 |
| 9-262747 | 10/1997 | (JP) . | |

OTHER PUBLICATIONS

"Machines & Tools", Kanai et al., ASPE Annual Meeting, pp. 60–64.*

"Ductile Mode Grinding For Silicon Wafering Process", ABE, Proceedings of Abrasive Engineering Society, Jul. 1995, vol. 39, No. 4, pp. 20–23.*

* cited by examiner

*Primary Examiner*—Rodney A. Butler
(74) *Attorney, Agent, or Firm*—Sughrue, Mion, Zinn, Macpeak & Seas, PLLC

(57) ABSTRACT

A workpiece receiving hole 60*a* for fittingly receiving a workpiece 17 is formed in the center of a rotary disk 60 which is thinner than the workpiece 17. A workpiece drive section 60*b* which engages a notch 17*a* formed for the purpose of orienting the workpiece 17 relative to crystal orientation is formed along the brim of the hole 60*a*. A gear 59 is rotated by a gear 62 of a motor 61, thereby rotating the rotary disk 60 and imparting torque to the workpiece 17. Accordingly, both surfaces of the workpiece are ground by means of a double disc surface grinder.

39 Claims, 51 Drawing Sheets

GRINDING METHOD, SURFACE GRINDER, WORKPIECE SUPPORT, MECHANISM AND WORK REST

BACKGROUND OF THE INVENTION

The present invention relates to a grinding method and a surface grinder for minutely grinding single or both surfaces of a workpiece, such as a thin-plate-like hard wafer to be used for a semiconductor, with extremely high accuracy.

In addition, the present invention relates to a workpiece support mechanism, and a work rest.

Further, the present invention also relates to a surface grinder having a contact preventing apparatus for preventing the workpiece supporting member from being contacted with a grinding wheel.

Conventionally, after having been sliced off from an ingot through use of an inner blade saw or wire saw, a wafer, such as a silicon wafer, is ground by a lapping machine.

The wafer sliced off from the ingot is rough in terms of surface roughness and accuracy of geometry. It takes very long time to lap the wafer sliced off from the ingot, resulting in deterioration of working efficiency. At the time of grinding of one surface of the wafer, another surface of the wafer is held by a vacuum chuck. For this reason, although the wafer sliced off from the ingot is plane in shape while being held, the wafer tends to become warped after removal of the workpiece from the vacuum chuck.

In a case where, with a view to improving the efficiency and accuracy of a lapping operation, an attempt is made to grind the wafer, a required degree of accuracy is obtained in a very short time. However, if the wafer is held by the vacuum chuck as a conventional matter, a required degree of accuracy cannot be obtained. This is a problem.

Conventional grinding method for a wafer is, however, known and described in, e.g., Japanese Utility Model No. 3028734; "Machines and Tools," July, 1996, pp. 60–64; and "Proceedings of Abrasive Engineering Society", July, 1995, vol. 3, No. 4, pp. 20–23.

Generally, a conventional double disc surface grinder comprises upper and lower rotary spindles rotatively arranged in alignment with each other. Grinding wheels (so called grindstone) are held and secured to the respective ends of the rotary spindles which are opposite to each other by upper and lower grinding wheel holders. The grinding wheels are positioned so as to be opposite to each other such that the grinding surfaces of the grinding wheels are arranged in parallel with each other. A workpiece hold mechanism for supporting a workpiece is provided between the grinding wheels so as to be movable, and a workpiece support plate is provided for the workpiece hold mechanism. While the workpiece is retained by the workpiece support plate, both grinding wheels are rotated and moved close to the workpiece. Both surfaces of the workpiece are ground so as to be parallel to each other by grinding surfaces of the grinding wheels. At that time, the surface grinder is operated in such a manner that the workpiece is only ground by the upper and lower grinding wheels without grinding of the workpiece support plate.

On the other hand, in many cases, the workpiece support plate becomes warped by its dead weight. At the time of grinding of the workpiece, it has been difficult to retain the workpiece support plate while being kept from contact with the grinding wheels.

It is conceivable that the workpiece support plate is stretched in the form of a very thin sheet. However, in such a case, it is difficult for the workpiece support sheet to stand the grinding torque exerted on the workpiece during a machining operation.

SUMMARY OF THE INVENTION

It is an object of the present invention to solve the above-mentioned problem in the conventional techniques, and to provide a grinding method, a surface grinder, a work support mechanism or a work rest in which required surface roughness and accuracy of geometry are achieved in a short time.

In addition, it is also an object of the present invention to provide a surface grinder having a contact preventing apparatus for preventing a workpiece supporting element from being contacted with a grinding wheel.

The above-mentioned object can be attained by a surface grinder, according to the present invention, comprises:

a rotary disk having one of a recess and a through hole into which a workpiece having an engaged portion can be loosely fitted with a fine clearance, and also having a workpiece drive section provided with the one so as to be engaged with the engaged portion of the workpiece;

a grinding wheel for grinding the surface of the workpiece loosely fitted in the one of the recess and the through hole while the end face of the grinding wheel is directed towards the workpiece;

a spindle for rotating the grinding wheel;

a support member for rotatively supporting the rotary disk; and rotational drive means for rotating the rotary disk, wherein when the rotary disk is rotated, a torque developing in the rotary disk is transferred to the workpiece drive section so as to rotate the workpiece relative to the support member.

In the above-mentioned construction of the surface grinder according to the present invention, advantageously, the grinding wheel is an upper grinding wheel which is arranged so as to be opposite to the upper surface of said workpiece in the vertical direction of the surface grinder, and the recess is formed in the rotary disk.

In the above-mentioned construction of the surface grinder according to the present invention, advantageously, the grinding wheel comprises upper and lower grinding wheels arranged so as to respectively face both surfaces of the workpiece in the vertical direction of the surface grinder; and the through hole is formed in the rotary disk.

In the above-mentioned construction of the surface grinder according to the present invention, advantageously, In the above-mentioned construction of the surface grinder according to the present invention, advantageously, the upper and lower grinding wheels are different from each other in terms of magnitude of grinding ability.

In the above-mentioned construction of the surface grinder according to the present invention, advantageously, the grinding wheel is a cup-shaped grinding wheel;

the workpiece is substantially circular; and the center of the workpiece is arranged so as to permit overlap between the center and the grinding surface of the cup-shaped grinding wheel.

In the above-mentioned construction of the surface grinder according to the present invention, advantageously, the rotational drive means comprises:

a motor supported on the support member; and a torque transfer mechanism interposed between the motor and the rotary disk.

In the above-mentioned construction of the surface grinder according to the present invention, advantageously, the support member comprises:

a slide table for rotatively supporting the rotary disk; and guide member, along which the slide table is movable, extended in a direction perpendicular to the rotational axis of the grinding wheel.

In the above-mentioned construction of the surface grinder according to the present invention, advantageously, the workpiece drive section is formed from a material which is softer than that of the workpiece.

In the above-mentioned construction of the surface grinder according to the present invention, advantageously, the rotary disk comprises:

a substantially-annular rotary metal plate body; and a workpiece loosely fitting member provided along the internal periphery of the rotary body and formed from a material which is softer than that of the workpiece.

In the above-mentioned construction of the surface grinder according to the present invention, advantageously, the workpiece drive section is integrally formed from the rotary disk.

In addition, the above-mentioned object can be attained by a workpiece support mechanism, according to the present invention, comprises:

a rotary disk having one of a recess and a through hole into which a workpiece having an engaged portion can be loosely fitted with a fine clearance, and also having a workpiece drive section provided with the one so as to be engaged with the engaged portion of the workpiece;

a support member for rotatively supporting the rotary disk; and rotational drive means for rotating the rotary disk, wherein when the rotary disk is rotated, a torque developing in the rotary disk is transferred to the workpiece drive section so as to rotate the workpiece relative to the support member.

In the above-mentioned construction of the workpiece support mechanism, according to the present invention, advantageously, the workpiece drive section is formed from material which is softer than that of the workpiece.

In the above-mentioned construction of the workpiece support mechanism, according to the present invention, advantageously, the rotary disk comprises:

a substantially-annular rotary metal plate body; and a workpiece loosely fitting member provided along the internal periphery of the rotary body and formed from a material which is softer than that of the workpiece.

In the above-mentioned construction of the workpiece support mechanism, according to the present invention, advantageously, the workpiece drive section is integrally formed from the rotary disk.

Further, the above-mentioned object can be achieved by a grinding method, according to the present invention, comprises the steps of:

fitting loosely a workpiece into one of a recess and a through hole formed in a rotary disk in such a manner that an workpiece drive section formed on the rotary disk is brought in engagement with an engaged portion formed in the workpiece;

rotating the rotary disk into which the workpiece is loosely fitted and simultaneously rotating the workpiece by transferring a rotational torque of the rotary disk from the workpiece drive section of the rotary disk to the engaged portion of the workpiece; and grinding the workpiece with a grinding wheel while the workpiece is being rotated.

In the above-mentioned grinding method according to the present invention, advantageously, the fitting step comprises the step of fitting loosely the workpiece into the recess; and the workpiece grinding step comprises the step of grinding the upper surface of the workpiece thus fitted into the recess loosely through use of a grinding wheel.

In the above-mentioned grinding method according to the present invention, advantageously, the fitting step comprises the step of loosely fitting the workpiece into the through hole; and the workpiece grinding step is the step of grinding both surfaces of the workpiece thus fitted into the through hole loosely through use of upper and lower grinding wheels.

In the above-mentioned grinding method according to the present invention, advantageously, the step of grinding the upper and lower surfaces of the workpiece comprises the steps of:

grinding the upper surface of the workpiece with a certain magnitude of grinding ability; and grinding the lower surface of the workpiece with grinding ability which is different in magnitude from the grinding ability employed in the upper surface grinding step.

In the above-mentioned grinding method according to the present invention, advantageously, the grinding step is conducted with a cup-shaped grinding wheel the grinding surface of which is overlapped with the center of the workpiece.

Furthermore, the above-mentioned construction of the surface grinder according to the present invention, advantageously, further comprises:

a work rest member for retaining at least a part of the workpiece surface outside the area of the workpiece surface which comes into contact with the end surface of the grinding wheel.

In the above-mentioned construction of the surface grinder according to the present invention, more advantageously, the work rest member comprises:

an upper work rest for retaining the upper surface of the workpiece; and a lower work rest for retaining the lower surface of the workpiece.

In the above-mentioned construction of the surface grinder according to the present invention, more advantageously, the work rest member comprises:

a hydrostatic slide for retaining the surface of the workpiece through a pressurized medium.

In addition, the above-mentioned construction of the surface grinder according to the present invention, more advantageously, further comprises:

means for moving the work rest member between a retaining position where the work rest member retains the surface of the workpiece and a withdrawn position where the work rest member is withdrawn from the workpiece.

Furthermore, the above-mentioned grinding method according to the present invention, advantageously, further comprises the step of:

retaining at least a part of the workpiece surface other than the area of the workpiece surface which comes into contact with the end face of the grinding wheel, when the workpiece is ground through use of the grinding wheel.

In the above-mentioned grinding method according to the present invention, more advantageously, the retaining step comprises the step of:

retaining the workpiece surface with a pressurized medium through a hydrostatic slide.

Moreover, the above-mentioned object of the present invention is attained by a surface grinder according to the present invention comprises:

a workpiece support member for retaining and rotating a workpiece;

a grinding wheel which is rotated so as to grind the workpiece while the end face of the grinding wheel is kept in contact with the surface of the workpiece; and a work rest for retaining at least a part of the workpiece surface outside the area of the *workpiece surface which comes into contact with the end face of the grinding wheel.

In the above-mentioned construction of the surface grinder according to the present invention, advantageously, the work rest member comprises:

an upper work rest for retaining the upper surface of the workpiece; and a lower work rest for retaining the lower surface of the workpiece.

In the above-mentioned construction of the surface grinder according to the present invention, advantageously, the work rest member comprises:

a hydrostatic slide for retaining the surface of the workpiece by use of a pressurized medium.

The above-mentioned construction of the surface grinder according to the present invention, advantageously, further comprises:

means for moving the work rest member between a retaining position where the work rest member retains the surface of the workpiece and a withdrawn position where the work rest member is withdrawn from the workpiece.

In the above-mentioned construction of the surface grinder according to the present invention, advantageously, the moving means comprises a grinding wheel holder.

In the above-mentioned construction of the surface grinder according to the present invention, advantageously, the moving means comprises an arm member which is supported by a pivot provided in parallel to the rotational axis of the grinding wheel and is provided with the work rest disposed at the pivotal end.

In the above-mentioned construction of the surface grinder according to the present invention, advantageously, the moving means comprises an annular table which is rotatively supported so as to be concentric with the axis of a grinding wheel holder of the grinding wheel.

In the above-mentioned construction of the surface grinder according to the present invention, advantageously, the outer diameter of the grinding wheel is substantially half the outer diameter of the workpiece.

In the above-mentioned construction of the surface grinder according to the present invention, advantageously, the grinding wheel comprises a cup-shaped grinding wheel.

However, the above-mentioned object can also be achieved by a grinding method, according to the present invention, comprises the steps of:

rotating a grinding wheel;

retaining and rotating the workpiece;

grinding the workpiece while the grinding wheel being rotated is brought in contact with the surface of the rotating workpiece; and retaining at least part of the workpiece surface other than the area of the workpiece surface which comes into contact with the end face of the grinding wheel, when the workpiece is ground through use of the grinding wheel.

In the above-mentioned grinding method according to the present invention, advantageously, the step of retaining at least a part of the workpiece surface comprises the step of:

retaining the workpiece surface by means of a hydrostatic slide through use of a pressurized medium.

In the above-mentioned grinding method according to the present invention, advantageously, the step of grinding the workpiece comprises the steps of:

grinding the upper surface of the workpiece through use of an upper grinding wheel, and grinding the lower surface of the workpiece through use. of a lower grinding wheel; and the step of retaining the workpiece surface comprises the steps:

retaining at least either the upper or lower surface of the workpiece.

In addition, the above-mentioned grinding method according to the present invention, advantageously, further comprises the step of:

preparing the upper and lower grinding wheels which have different magnitudes of grinding ability.

In the above-mentioned grinding method according to the present invention, advantageously, the grinding step further comprises the steps of:

preparing a substantially-circular workpiece, and preparing a cup-shaped grinding wheel as the grinding wheel; and grinding the workpiece while the grinding wheels are brought into contact with the respective surfaces of the workpiece and the grinding surfaces of the grinding wheels pass through the center of the workpiece.

Further, the above-mentioned object of the present invention can also be attained by a work rest comprises:

a workpiece retaining member, disposed in a surface grinder which grinds a workpiece while the workpiece is being rotated and is brought in engagement with the end face of a grinding wheel, for retaining at least a part of the workpiece surface outside the area of the workpiece surface which comes into contact with the end surface of the grinding wheel.

In the above-mentioned construction of the work rest according to the present invention, advantageously, the workpiece retaining member comprises:

an upper workpiece retaining member for retaining the upper surface of the workpiece; and a lower workpiece retaining member for retaining the lower surface of the workpiece.

In the above-mentioned construction of the work rest according to the present invention, advantageously, the workpiece retaining member is a hydrostatic slide which retains the surface of the workpiece through a pressurized medium.

The above-mentioned construction of the work rest according to the present invention, advantageously, further comprises:

means for moving the work rest member between a retaining position where the work rest member retains the surface of the workpiece and a withdrawn position where the work rest member is withdrawn from the workpiece.

In the above-mentioned construction of the work rest according to the present invention, advantageously, the moving means comprises a grinding wheel holder.

In the above-mentioned construction of the work rest according to the present invention, advantageously, the moving means comprises an arm member which is supported by a pivot provided in parallel to the rotational axis of the grinding wheel and is provided with the work rest disposed at the pivotal end.

In the above-mentioned construction of the work rest according to the present invention, advantageously, the moving means comprises an annular table which is rotatively supported so as to be concentric with the axis of a grinding wheel holder of the grinding wheel.

However, the above-mentioned surface grinder according to the present invention, advantageously, further comprises:

a grinding wheel holder for supporting the grinding wheel; and dynamic pressure generation means provided on at least either the grinding wheel holder or the rotary disk for generating dynamic pressure between the grinding wheel holder and the rotary disk.

In the above-mentioned construction of the surface grinder according to the present invention, advantageously, the dynamic pressure generation means is provided in the grinding wheel holder so as to surround the grinding wheel.

Furthermore, the above-mentioned object can also be attained by a surface grinder, according to the present invention, comprises:

a grinding wheel holder provided at one end of a spindle, which rotates the grinding wheel, for supporting the grinding wheel;

a workpiece support plate rotatively supporting a workpiece to be ground with the grinding wheel; and dynamic pressure generation means provided at at least either the grinding wheel holder or the workpiece support plate for generating a dynamic pressure between the grinding wheel holder and the workpiece support plate.

In the above-mentioned construction of the surface grinder according to the present invention, advantageously, the dynamic pressure generation means is provided in the grinding wheel holder so as to surround the grinding wheel.

However, in the above-mentioned construction of the workpiece support member according to the present invention, advantageously, the workpiece drive section is provided so as to be movable in the radial direction of the rotary disk and is biased by a spring member towards the center of the rotary disk.

In the above-mentioned workpiece support member according to the present invention, advantageously, the workpiece drive section comprises an engagement member movable in the radial direction of the rotary disk;

a spring member for biasing the engagement member towards the center of the rotary disk;

an actuator actuated by a pressurized fluid so as to withdraw the engagement member towards the outside of the rotary disk against the biasing force of the spring member;

a stopper for stopping the rotary disk at a given position; and a fluid pressure cylinder provided outside the rotary disk and which, when the rotary disk is stopped at the given position, for advancing to or receding from the actuator between a forward position where the cylinder supplies the pressurized fluid to the actuator and a withdrawn position where the cylinder lets the pressurized fluid escape from the inside of the actuator.

In the above-mentioned workpiece support member according to the present invention, more advantageously, the actuator is a spring-offset fluid pressure cylinder, and the pressurized fluid is supplied to the actuator through a channel formed in a plunger of the fluid pressure cylinder seated outside the rotary disk.

Further, in the above-mentioned workpiece support member according to the present invention, advantageously, further comprises:

load detection means for detecting a load exerted on the workpiece drive section; and calculation control means for calculating the direction of magnitude of the load calculated by the load detection means and controlling at least one of the factors which are selected from the rotational speed of the grinding wheel, the rotational speed of the workpiece, and the feed rate to which the workpiece is ground.

However, the above-mentioned object of the present invention can also be achieved by a surface grinder includes:

a workpiece support plate for supporting a workpiece, a grinding wheel which grinds the workpiece while the end face of the grinding wheel is directed toward the workpiece held by the workpiece support plate, a spindle for rotating the grinding wheel, and rotary drive means for rotating the workpiece support plate, wherein the workpiece support plate comprises:

an annular workpiece support member for supporting the workpiece;

an annular rotational frame;

a press ring provided along a peripheral channel formed in the lower surface of the workpiece support plate; and fixing means for holding the workpiece support plate between the workpiece support plate and the press ring in a sandwiched manner.

In addition, the above-mentioned object of the present invention can also be achieved by a workpiece support mechanism for use in a surface grinder comprises:

an annular workpiece support plate for supporting a workpiece;

a rotary disk provided in the vicinity of the, outer periphery of the workpiece support plate;

a press ring provided in a peripheral channel formed in the lower surface of the rotary disk; and fixing means for holding the workpiece support plate between the rotary disk and the press ring in a sandwiched manner.

DETAILED DESCRIPTION OF THE PREFERRED EMBODIMENTS

Figure 1:
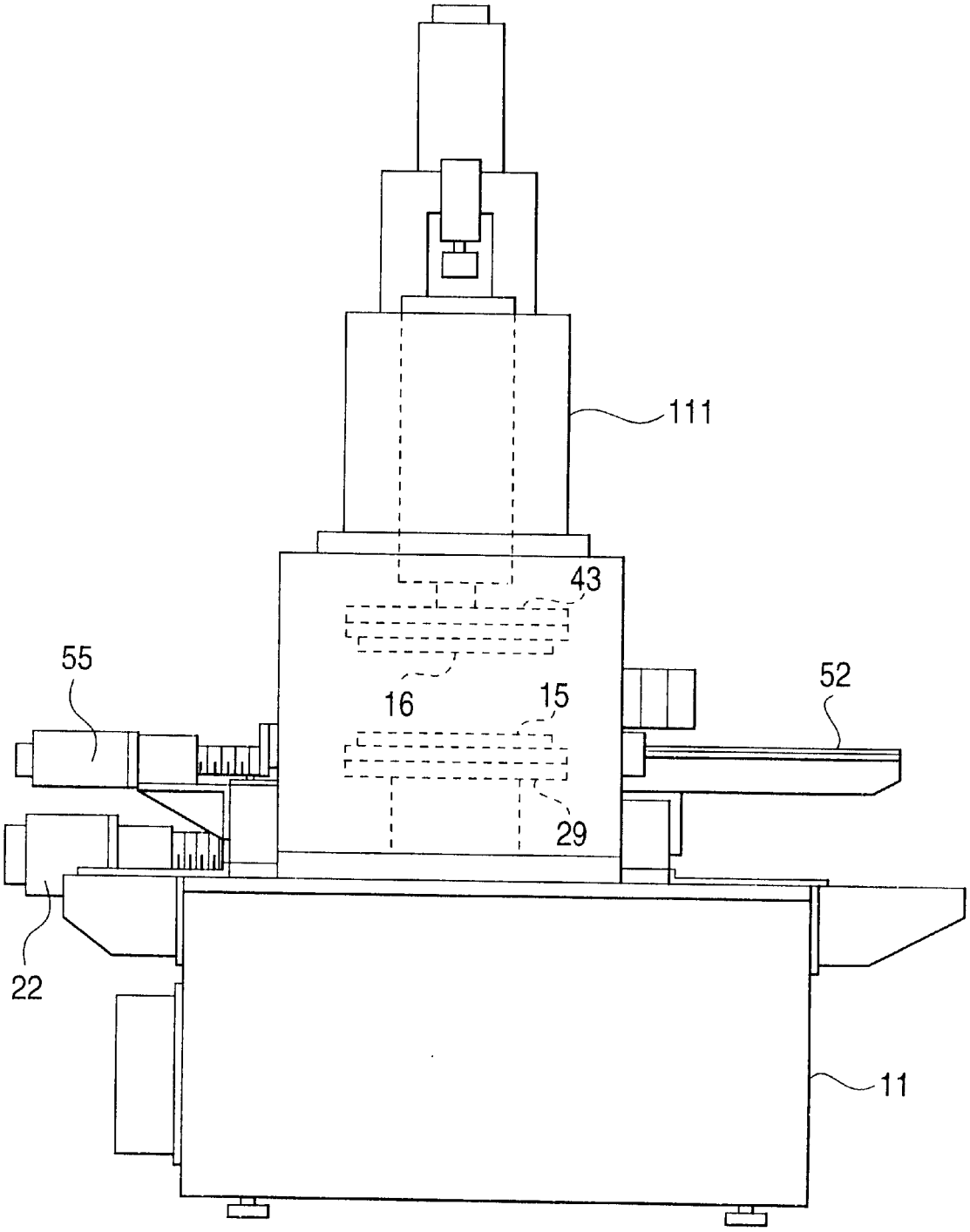
FIG. 1 is a front view showing a double disc surface grinder according to one embodiment of the present invention.

Embodiments of the present invention will be described in detail by reference to FIGS. 1 through 11.

(First Embodiment)

As shown in FIGS. 1 through 4, a double disc surface grinder according to a first embodiment comprises a lower frame 11, and an upper frame 111 is mounted on the lower frame 11. The lower frame 11 comprises a lower grinding wheel feed unit 12 and a workpiece support member 14, and the upper frame 111 comprises an upper grinding wheel feed unit 13. The lower grinding wheel feed unit 12 has a lower grinding wheel 15, and the upper grinding wheel feed unit 13 has an upper grinding wheel 16. A grinding surface 15*a* provided at the upper end of the lower grinding wheel 15 and a grinding surface 16*a* provided at the lower end of the upper grinding wheel 16 are positioned so as to become opposite to and in parallel with each other. While being supported on the workpiece support member 14, a thin-plate-like workpiece 17 is inserted between the lower and upper grinding wheels 15, 16 of the lower and upper grinding wheel feed units 12, 13. Both surfaces of the workpiece 17 are simultaneously ground by the grinding surfaces 15*a*, 16*a* of the grinding wheels 15, 16.

Figure 2:
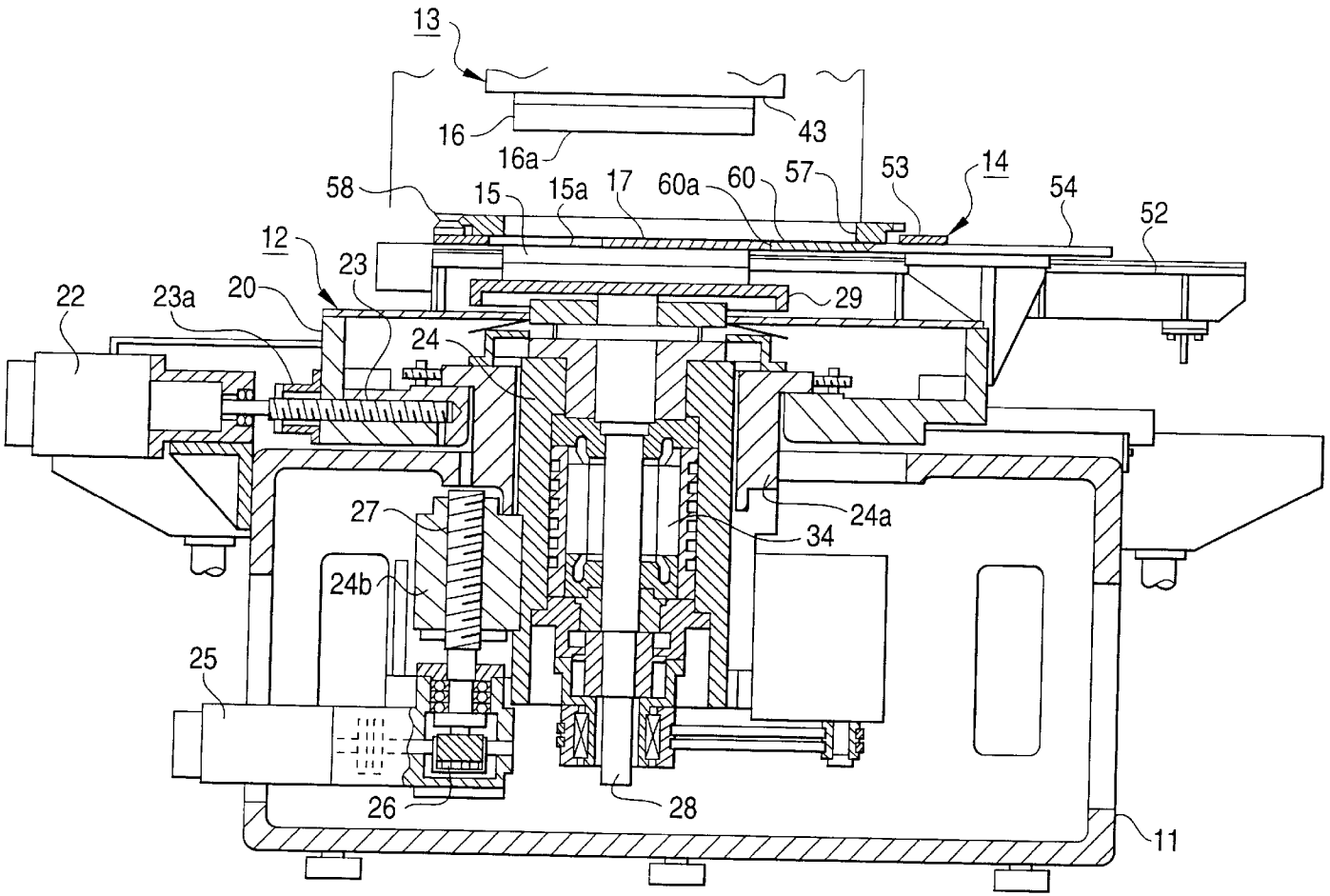
FIG. 2 is a longitudinal cross-sectional view showing the principle elements of a lower frame.
Figure 3:
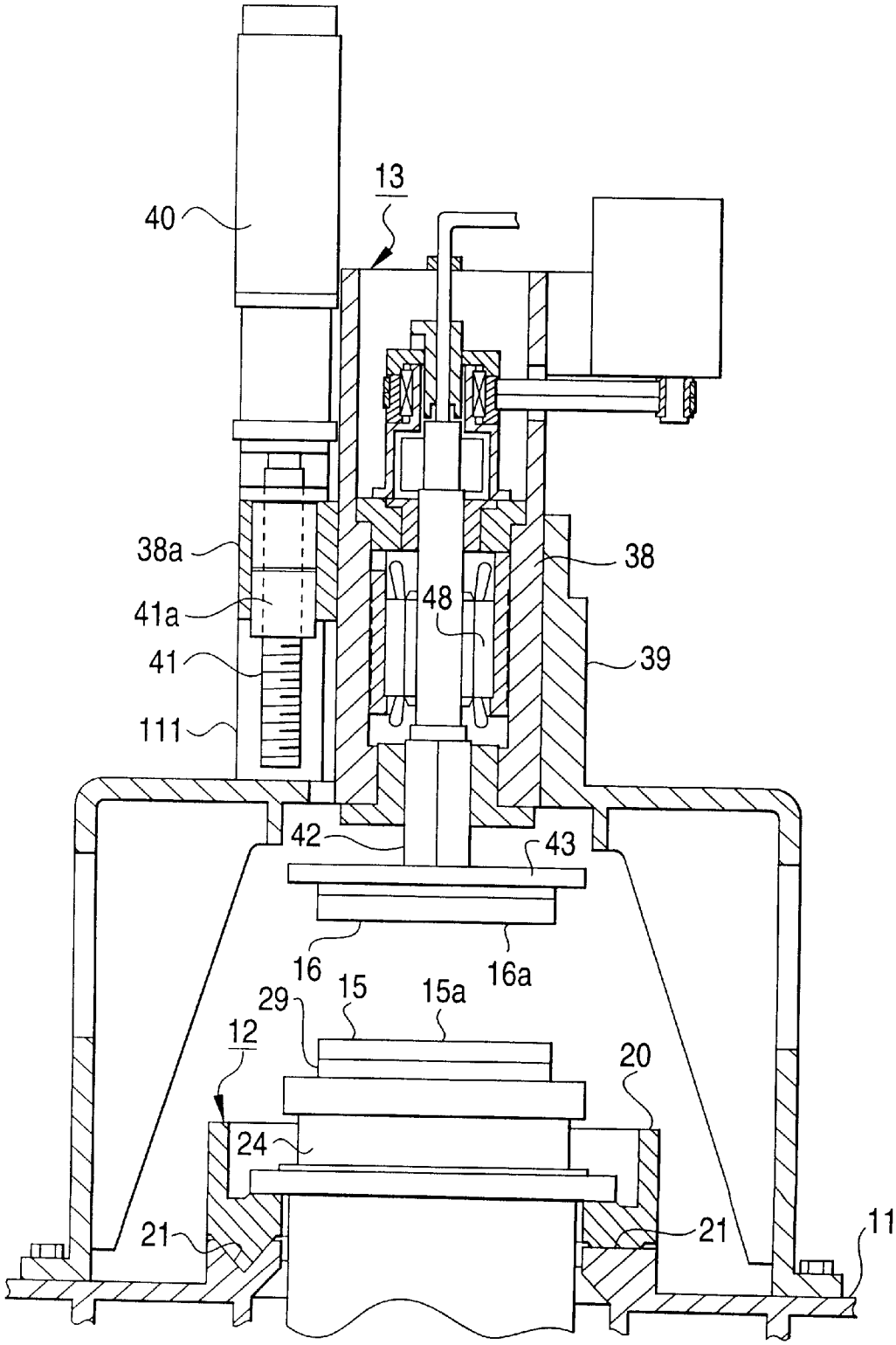
FIG. 3 is a longitudinal cross-sectional view showing the principle elements of an upper frame.

As shown in FIGS. 2 and 3, a grinding wheel table 20 of the lower grinding wheel feed unit 12 is supported on the lower frame 11 by a so-called V-and-flat-shaped guide 21 so as to be movable in the direction orthogonal to the axis of rotation of the lower grinding wheel 15. A motor 22 for traveling the lower grinding wheel is disposed at the side of the lower frame 11. As a result of rotation of the motor 22, the grinding wheel table 20 horizontally travels by a ball screw 23 threadedly engaged with a ball nut 23*a* fixed in the grinding wheel table 20. A lower spindle guide 24 is supported by a vertical guide 24*a* integrally formed with the grinding wheel table 20 so as to be movable in the direction of rotation axis of the lower grinding wheel 15. A motor 25 for feeding a lower grinding wheel is disposed at the side of the vertical guide 24*a* below the grinding wheel table 20. As a result of rotation of the motor 25, while being guided by the guide 24*a*, the lower spindle guide 24 is raised or lowered through a torque transfer mechanism 26 which is constituted by a worm and a worm wheel and also through a ball screw 27 which is threadedly engaged with an unillustrated ball nut fixed in a bracket 24*b* being secured to the lower spindle guide 24. This feeding stroke is small.

A lower grinding wheel spindle 28 (so called a lower spline) is rotatably supported within the lower spindle guide 24 (so called a lower housing), and the lower grinding wheel 15 is supported on a grinding wheel holder 29 integrally formed with the upper end of the lower grinding wheel spindle 28.

A grinding wheel drive motor 34 of a built-in type is provided in the lower spindle guide 24, and a stator of the grinding wheel drive motor 34 is fixedly fitted into the lower spindle guide 24. Further, a rotor of the grinding wheel drive motor 34 is fixedly fitted into the lower grinding wheel spindle 28. At the time of a grinding operation, the lower grinding wheel 15 rotates at high speed by rotation of the motor 34 by the lower grinding wheel spindle 28.

As shown in FIG. 3, an upper spindle guide 38 of the upper grinding wheel feed unit 13 is supported by a vertical guide 39 integrally formed with the upper frame 111 so as to be movable in the direction of rotation axis of the lower grinding wheel 16. A hosting/lowering motor 40 is disposed at the side of the upper frame 111. As a result of rotation of the motor 40, the upper spindle guide 38 is raised or lowered by a ball screw 41 which is threadedly engaged with a ball nut 41*a* fixedly fitted into a bracket 38*a* fixed to the upper spindle guide 38.

An upper grinding wheel spindle 42 (so called an upper spline) is rotatably supported within the upper spindle guide 38 (so called an upper housing), and the upper grinding wheel 16 is supported on a grinding wheel holder 43 integrally formed with the lower end of the upper grinding wheel spindle 42. A grinding wheel drive motor 48 of a built in type is provided in the upper spindle guide 38, and a stator of the grinding wheel drive motor 48 is fixedly fitted into the upper spindle guide 38. Further, a rotor of the grinding wheel drive motor 48 is fixedly fitted into the upper grinding wheel spindle 42. At the time of a grinding operation, the upper grinding wheel 16 rotates at high speed by rotation of the motor 48 by the upper grinding wheel spindle 42.

Figure 4:
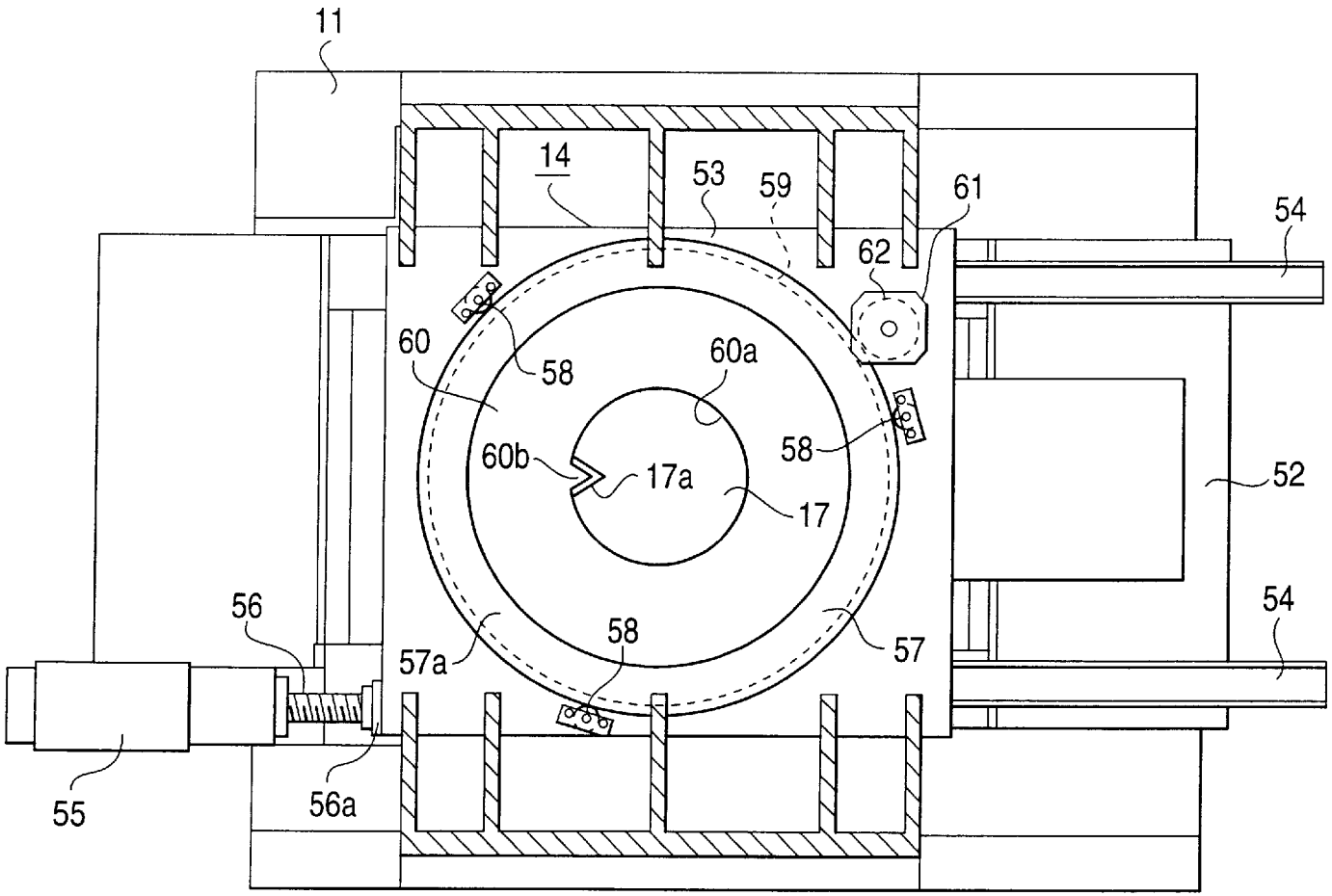
FIG. 4 is a plan view showing a workpiece support member.

As shown in FIGS. 2 and 4, a support table 52 of the workpiece support member 14 is laid on the lower frame 11 between lower and upper grinding wheel feed units 12, 13. A slide table 53 is supported by a pair of guide rails 54 disposed on the support table 52 and on both sides of the lower grinding wheel 15 so as to be movable in the same direction in which the grinding wheel table 20 of the lower grinding wheel feed unit 12 is moved. As shown in FIG. 4, a motor 55 for traveling a slide table is mounted on the support table 52. As a result of rotation of the motor 55, a ball screw 56 joined to the motor shaft of the motor 55 is threadedly engaged with a ball nut 56*a* set on the slide table 53, enabling movement of the slide table 53.

Figure 5:
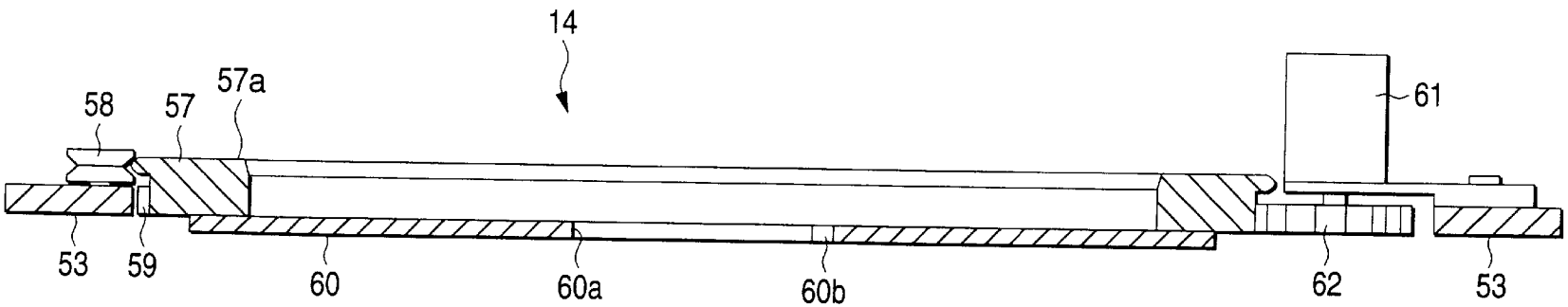
FIG. 5 is a longitudinal cross-sectional view showing a slide table.
Figure 6:
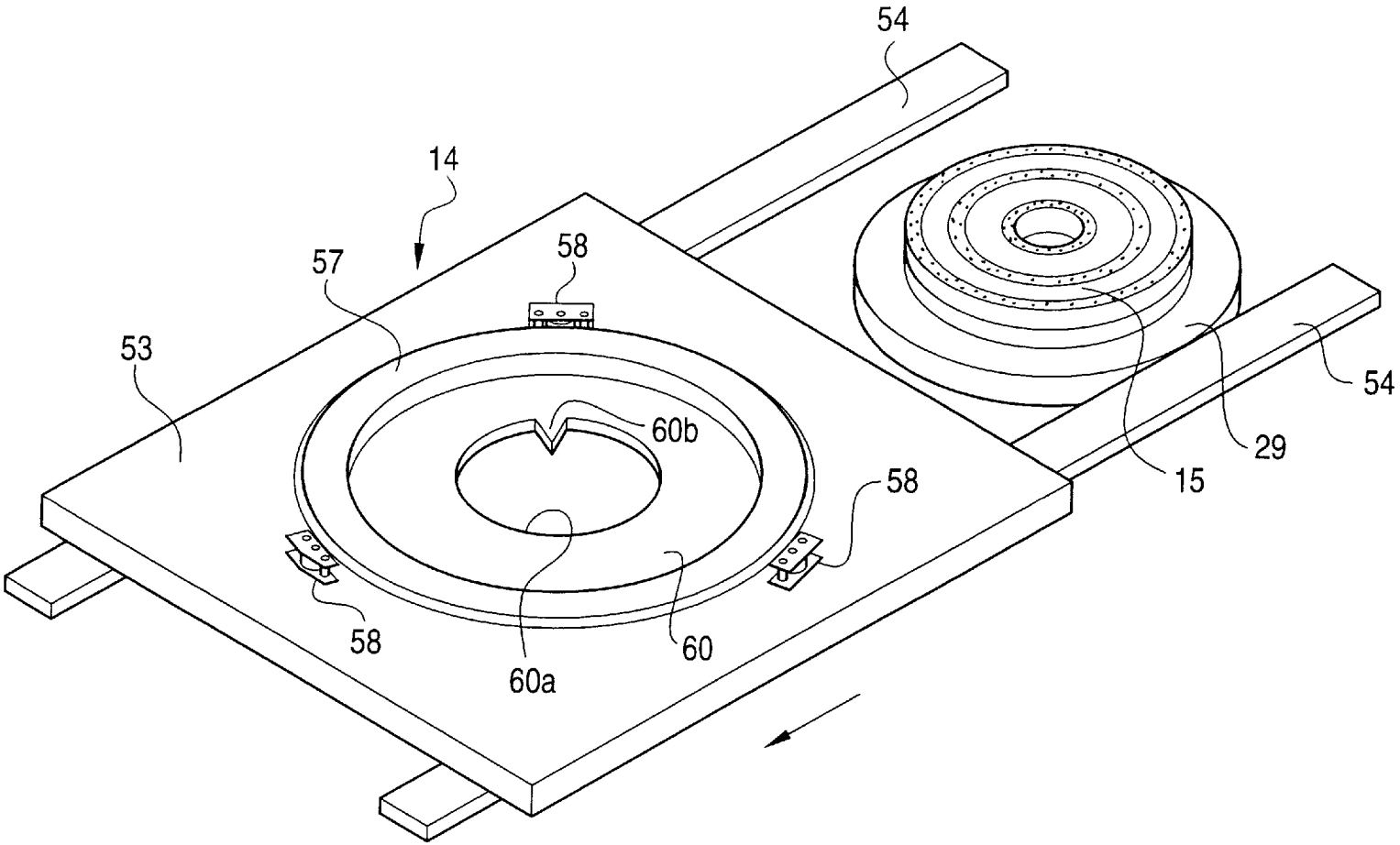
FIG. 6 is a perspective view showing the slide table.

A rotary disk 57 is disposed within the slide table 53 and is rotatably supported by three guide rollers 58 which are also rotatably supported by the slide table 53 (see FIG. 5). A thick-walled peripheral annular frame 57*a* (hereinafter simply referred to as a "peripheral frame") of the-rotary disk 57 is equipped with a workpiece support plate 60, and a gear 59 is formed along the lower periphery of the peripheral frame 57*a* The workpiece support plate 60 is formed thinner than the workpiece 17 and is horizontally extended along the lower surface of the peripheral frame 57*a* by an unillustrated tension mechanism so as not to become deformed or warped by gravity (its dead weight). A receiving hole 60*a* is formed at the center of the workpiece support plate 60 for removably receiving and loosely fitting the workpiece 17. The receiving hole 60*a* has a diameter which permits fitting of the workpiece 17 into the hole with a clearance. A motor 61 for revolving a rotary disk 57 is disposed on the slide table 53, and a gear 62 which meshes the gear 59 of the rotary disk 57 is secured to the shaft of the motor 61. The rotary disk 57 is rotated by rotation of the motor 61 by the engagement of these gears 59 and 62. The inner diameter of the peripheral frame 57*a* is set in such a way that the upper grinding wheel 16 which is lowered in an offset way with respect to the rotary disk 57 can approach to the workpiece support plate 60.

As shown in FIG. 4, a workpiece drive section 60*b* is provided with the receiving hole 60*a* of the workpiece support plate 60 in such a way as to protrude toward the inner radius of the hole for the purpose of engaging a notch 17*a*, such as a notch or orientation flat, used as a reference point for crystal orientation of the workpiece 17 which is an unground wafer sliced off from the ingot. As in the present embodiment, the notch 17*a* of the workpiece 17 has a shape like V-shaped notch or an orientation flat formed by cutting away the outer periphery of the workpiece. Another notch 17*a* for the purpose of driving the workpiece 17 may be provided in a position other than the position where the notch is originally provided for defining crystal orientation of the workpiece 17.

Although the foregoing workpiece receiving hole 60*a* has a circular shape in the present embodiment, the hole may take any shape other than a circular shape, so long as the workpiece 17 is positioned by the hole. For example, the hole may be formed in such a way as to come into contact with at least three trisected segments of outer periphery of the workpiece 17.

The operation of the double disc surface grinder having the foregoing structure will now be described.

In a case where a grinding operation is carried out through use of the double disc surface grinder, the workpiece 17 is inserted into and positioned between the lower and upper grinding wheels 15, 16 of the lower and upper grinding wheel feed units 12, 13 while being loosely fitted and supported in the workpiece support plate 60 of the workpiece support member 14 with a clearance. In this state, the lower and upper grinding wheels 15, 16 of the lower and upper grinding wheel feed units 12, 13 are rotated at high speed, and the motor 61 is rotated at low speed, thereby rotating the workpiece support plate 60 by the engagement of the gears 62 and 59 which serve as rotational drive means. As a result, the workpiece 17 retained in the receiving hole 60*a* is rotated. The upper grinding wheel 16 of the upper grinding wheel feed unit 13 is lowered close to the workpiece 17. Both surfaces of the workpiece 17 are simultaneously ground by the grinding surfaces 15*a*, 16*a* of the grinding wheels 15, 16.

Figure 7:
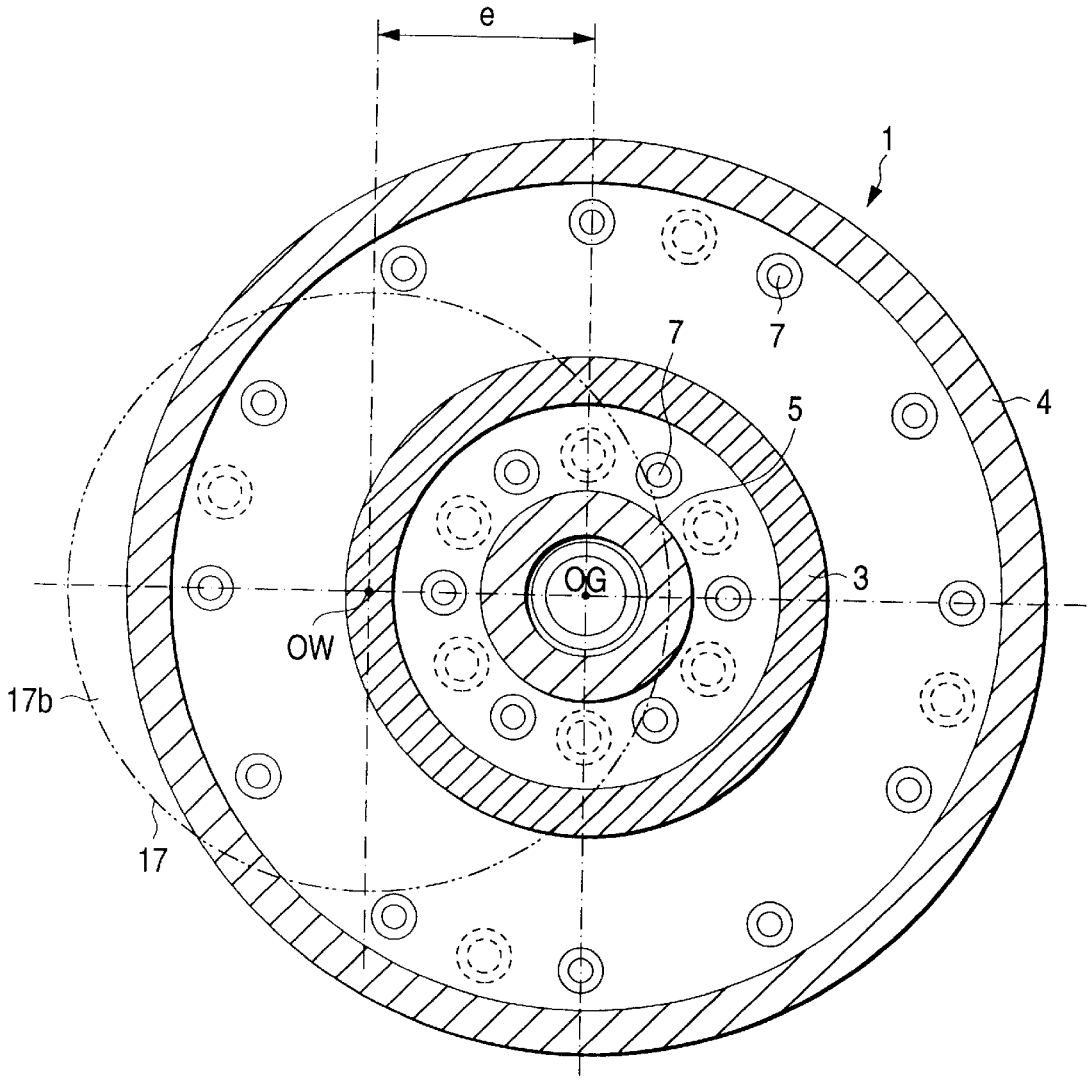
FIG. 7 is a front view showing a grinding tool.
Figure 8:
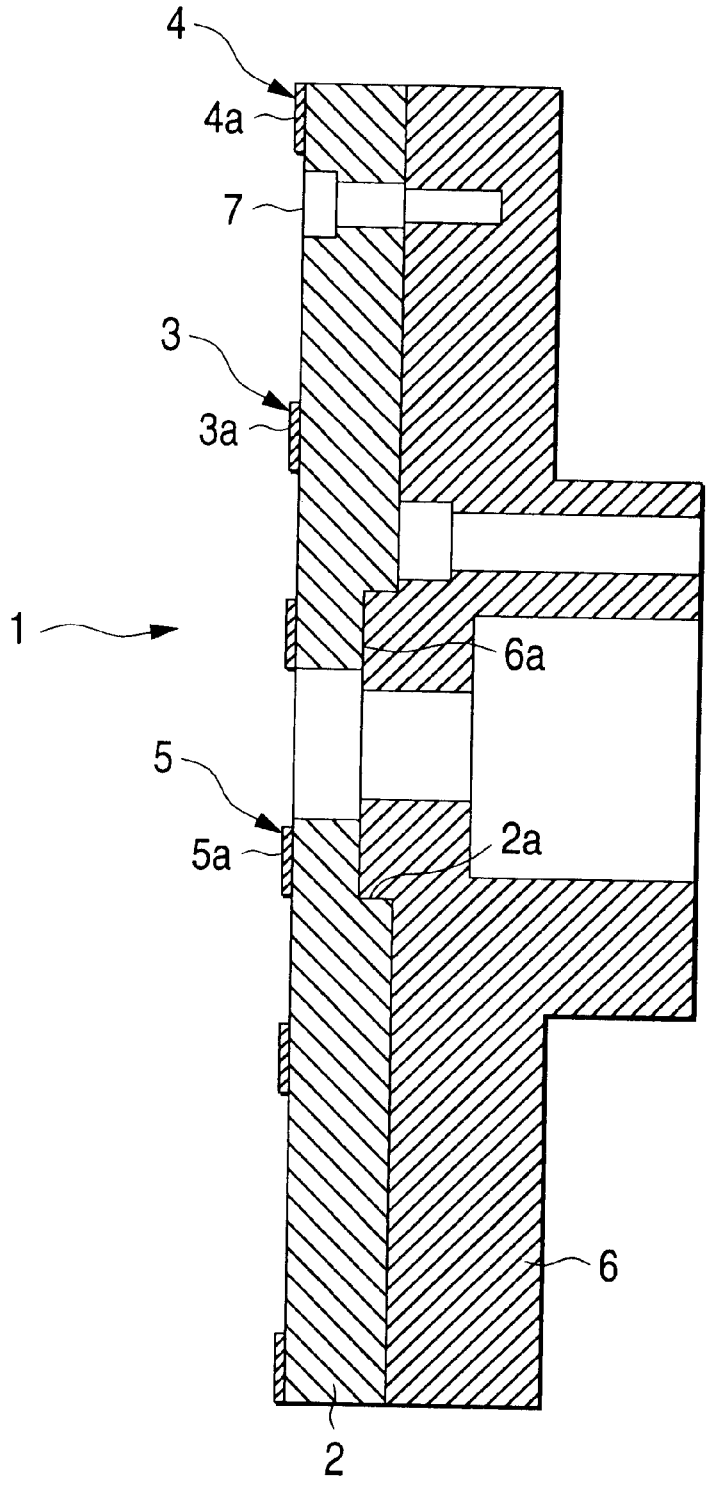
FIG. 8 is a longitudinal cross-sectional view showing the grinding tool shown in FIG. 7.

FIG. 7 is a front view showing the grinding surface of a grinding tool when viewed from the front, and FIG. 8 is a longitudinal cross-sectional view showing the grinding tool and its center shown in FIG. 7. In the present embodiment, identical reference numerals are assigned to the grinding wheels (or grinding tools) 15, 16, both grinding wheels being collectively represented by reference numeral 1.

The grinding tool 1 comprises a steel disk table 2, a diamond grinding wheel 3 which is provided on the end face of the disk table 2 and serves as a grinding wheel, and workpiece contact members 4, 5 used as workpiece supports. All of these components are concentrically provided in the form of annular patterns of certain width. More specifically, the workpiece contact member 4 which is greater in diameter than the diamond grinding wheel 3 is provided along the outer periphery of the disk table 2, and the workpiece contact member 5 which is smaller in diameter than the diamond grinding wheel 3 is provided along the center of the disk table 2. Only one of the workpiece contact members 4, 5 may be used.

The diamond grinding wheel 3 is manufactured by binding together abrasive diamond grains with a binder, and by fastening the thus-formed diamond grains on the disk table 2. It is desirable to form the workpiece contact members 14, 15 from a substance which is-abraded by the workpiece 17 and has lubricity, e.g., oil-impregnated ceramics.

A grinding surface 3*a* of the diamond grinding wheel 3 and contact surfaces 4*a*, 5*a* of the workpiece contact members 4, 5 are in the same plane orthogonal to the axis of the grinding wheel. A cylindrically indented fitting section 2*a* is formed in the reverse side of the disk table 2 and fittingly receives a protruding fitting section 6*a* of a grinding wheel holder 6 (used in lieu of the foregoing grinding wheel holders 29, 43). While the reverse side of the disk table 2 is being held in close contact with the front side of the grinding wheel holder 6, the disk table 2 and the grinding wheel holder are secured to each other by screwing bolts 7 into the grinding wheel holder 6 through bolt holes formed in the disk table 2.

The operation of the grinding tool 1 having the structure mentioned previously will now be described. While the grinding wheel 16 is retained in an elevated position, the center OW of the workpiece receiving hole 60*a* is positioned so as to become offset from the center OG of the grinding tool 1 by value "e" by movement of the slide table 53. The offset value "e" corresponds to the averaged radius of the diamond grinding wheel 3. In this case, there is a need for necessarily positioning the center OW of the workpiece on the diamond grinding wheel 3. The lower grinding wheel 15 is raised close to the lower surface of the workpiece support plate 60, and the notch 17*a* of the workpiece 17 is engaged with the workpiece drive section 60*b* protruding into the workpiece receiving hole 60*a*, whereby the workpiece 17 is loosely fitted into the workpiece receiving hole 60*a* and is positioned on the lower grinding wheel 15. As a result, both surfaces of the workpiece 17 protrude, respectively, from the upper and lower surfaces of the workpiece support plate 60. Next, the upper grinding wheel 16 is lowered close to the workpiece.

The grinding wheel drive motors 34, 48 and the motor 61 for driving a workpiece are energized, rotating the grinding wheels 15, 16 and the workpiece 17. When the upper grinding wheel 16 is lowered to come into contact with the workpiece 17, the diamond grinding wheels 3 grind both surfaces of the workpiece 17. During the grinding operation, other than the area of the workpiece 17 (i.e., a circular-arch area passing through the center of the workpiece 17) which is ground by the grinding surface 3*a* of the diamond grinding wheel 3, both sides in the vicinity of the outer periphery of the workpiece 17 are supported by the workpiece contact members 4, 5. The workpiece contact members 4, 5 are formed from a substance which does not abrade the workpiece 17 but is abraded by the workpiece 17 or a substance which abrades the workpiece 17 and is abraded much faster than the diamond grinding wheel 3. The workpiece contact members 4, 5 are formed by binding together, e.g., abrasive alumina or silicon carbide grains, through use of a soft binder.

After grinding of the workpiece 17, the upper grinding wheel 16 is raised to thereby lift an area 17*b* of the workpiece 17 projecting to the outside of the outer periphery of the lower grinding wheel 15 (see FIG. 7), removing the workpiece 17 from the receiving hole 60*a*.

While being rotated at a rate of 10 r.p.m., the workpiece 17, a wafer having a diameter of 200 mm, was ground by rotation of the diamond grinding wheel 3 having an outer diameter of 160 mm and an inner diameter of 130 mm together with the upper and lower grinding wheels 15, 16 at the same speed and in the same direction, i.e., at the speed ranging from 2,000 to 3,000 r.p.m. The workpiece was ground in two minutes, and the total thickness variation (TTV) of the workpiece was 0.3 $\mu$m.

(Second Embodiment)

Figure 9:
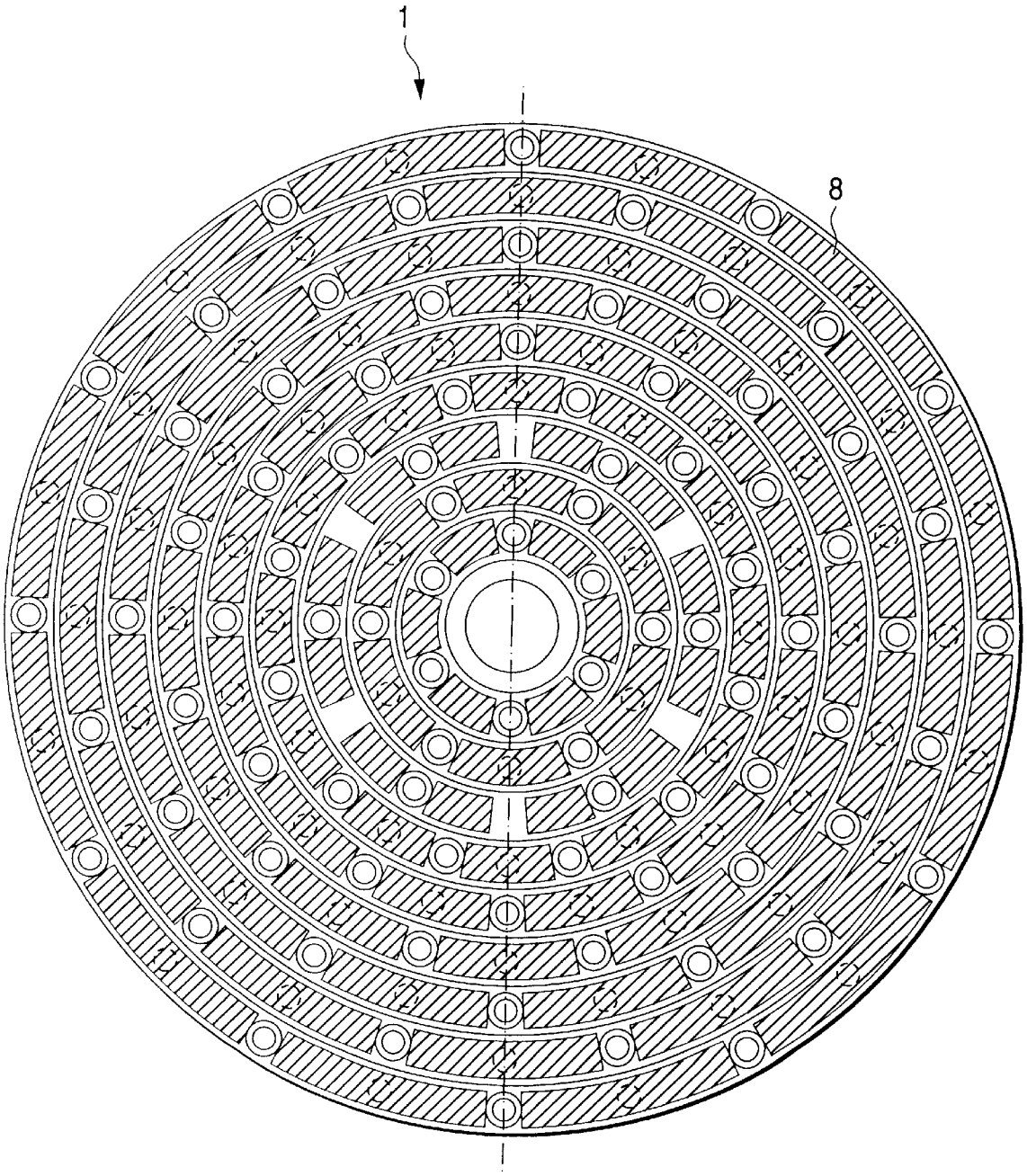
FIG. 9 is a front view showing another example of the grinding tool.
Figure 10:
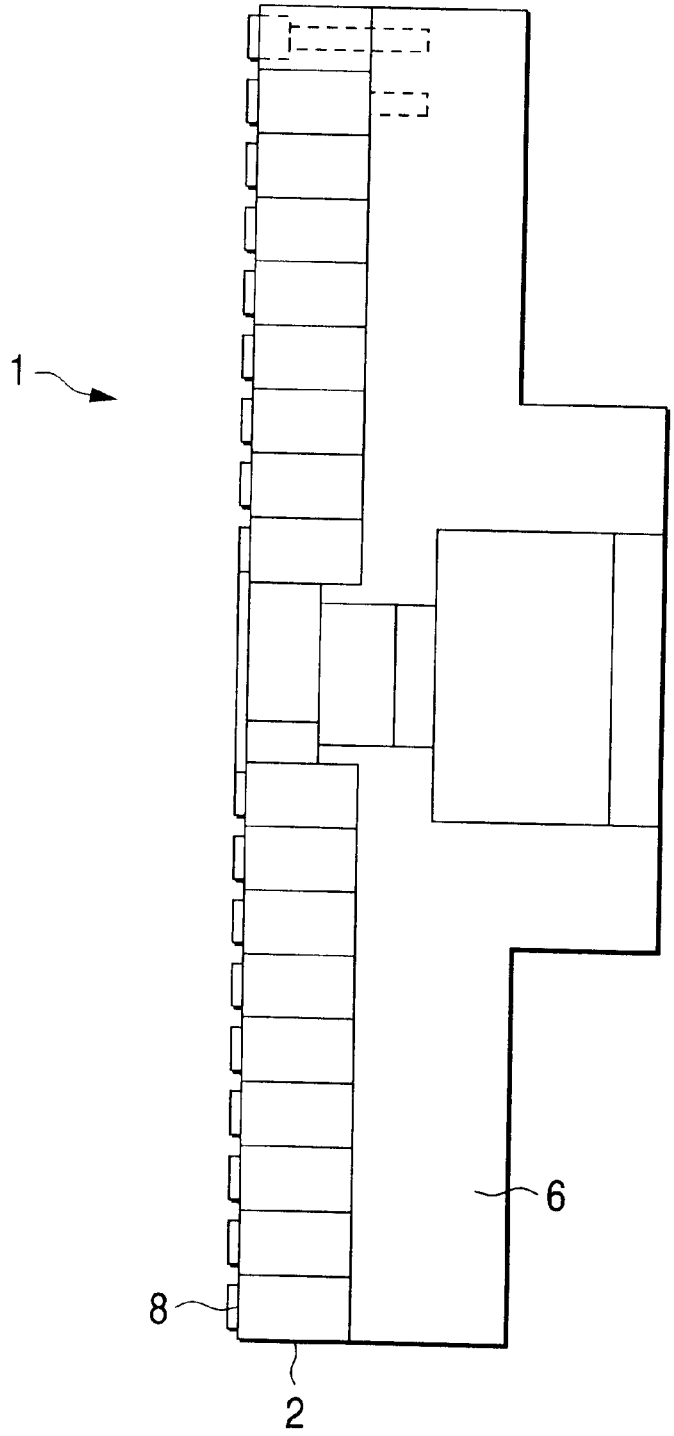
FIG. 10 is a longitudinal cross-sectional view showing the grinding tool shown in FIG. 9.

FIGS. 9 and 10 show an example of the grinding tool 1 which uses a diamond impregnated grinding wheel. A plurality of diamond impregnated grinding wheel 8 are circularly arranged so as to become spaced given intervals apart from each other, thereby forming a segmented circular pattern. Such a circular pattern is arranged in a plurality of concentric rows on the surface of the disk table 2 in such a way that the interval between the grinding wheels in one circular pattern is offset from that in the adjacent circular pattern in the radial direction of the disk table 2. The grinding tool grinds the overall workpiece 17 while the grinding tool 1 is held in a position where the outer periphery of the grinding tool passes through the center of the-workpiece 17.

(Third Embodiment)

If the principle objective is to finish a single surface of the workpiece 17, the workpiece 17 may be ground through use of the foregoing double disc surface grinder while the lower grinding wheel 15 is stationary or is slowly rotated, or the workpiece 17 may be ground while the lower grinding wheel 15 is replaced with a member which slightly grinds or does not grind the workpiece 17.

(Fourth Embodiment)

Figure 11:
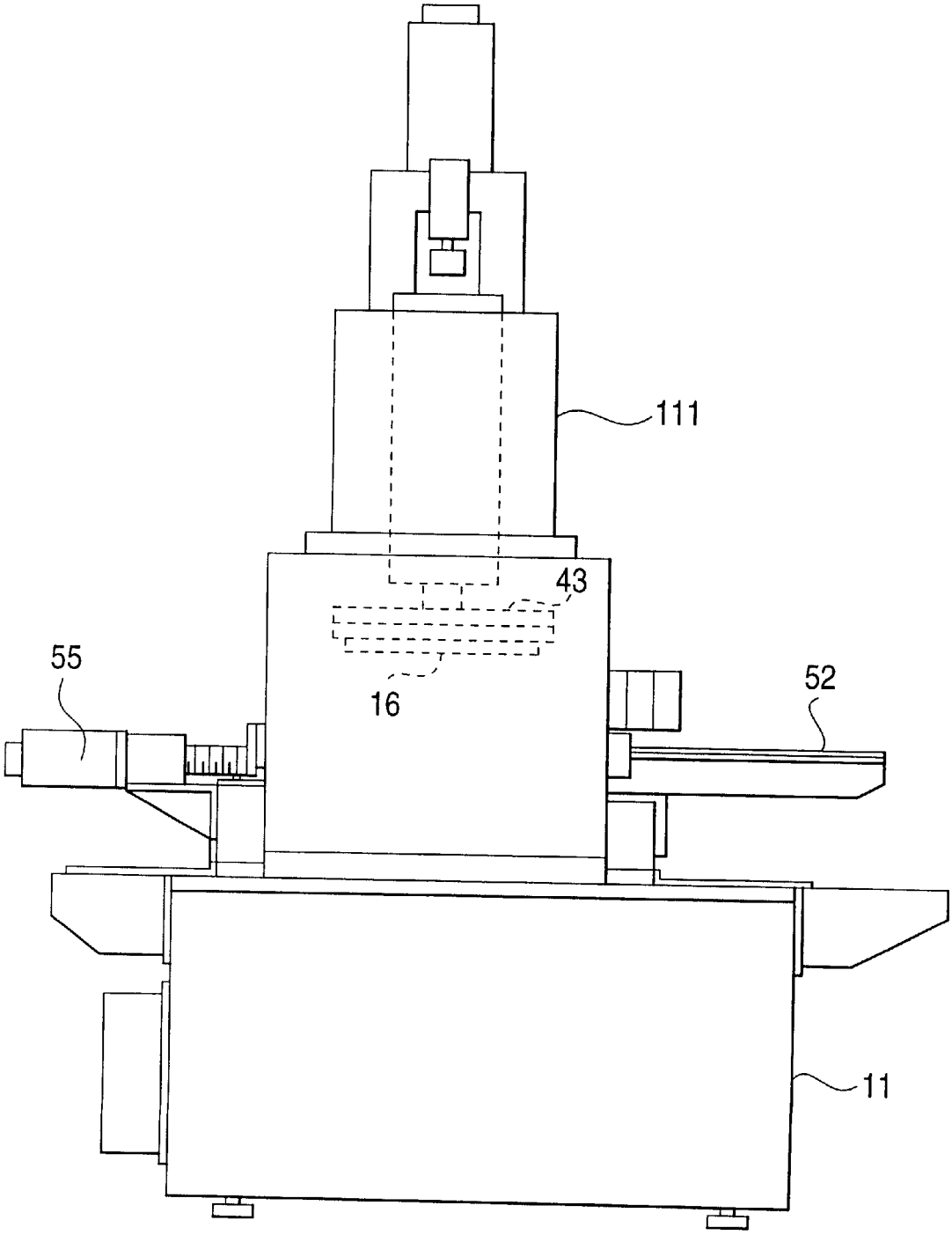
FIG. 11 is front view showing a single disc surface grinder according to another embodiment of the present invention.

A single surface of the workpiece 17 may be finished through use of a single disc surface grinder having a grinding wheel whose end surface is formed into a grinding surface. FIG. 11 shows such a single disc surface grinder, and the lower frame 11 of the surface grinder does not have any members associated with a lower grinder. Only guide rails 52 and the workpiece support member 14 are provided on the lower frame 11. In this case, the upper surface of the lower frame 11 may be formed into a plane surface, and the foregoing workpiece support plate 60 may be placed on the upper surface so as to come into contact with or to be positioned in the vicinity of the upper surface. The workpiece receiving hole 60*a* may be provided with a bottom. In such a case, as a matter of course, the depth of the workpiece receiving hole 60*a* is set so as to become smaller than the thickness of the workpiece 17.

As mentioned previously, according to the present embodiment, the workpiece support plate which is thinner than the wafer comprises the workpiece receiving hole, and the drive section which protrudes so as to engage the notch formed in the wafer for the purpose of orienting the wafer relative to crystal orientation. While the workpiece support plate is rotated, the wafer is ground by simultaneously bringing the grinding wheels into contact respectively with the upper and lower surfaces of the wafer. As a result, there are advantages of the wafer being imparted with torque without fail, as well as of the overall surfaces of the wafer being uniformly ground. Further, there are advantages of both surfaces of the wafer being simultaneously ground, as well as of being able to achieve superior surface roughness in a short time. In a case where a wafer is held by a vacuum chuck, the wafer is pulled and held in a plane state by a suction portion of the vacuum chuck. If a wafer having inferior accuracy of geometry is ground in such a state, the wafer will restore its original shape by an elasticity itself after having been removed from the vacuum chuck, resulting in a deterioration in the accuracy of geometry of the wafer. In contrast, according to the present embodiment, since the workpiece is not held in a plane state when being supported, superior accuracy of geometry can be achieved.

As mentioned previously, even in the case of a single-side grinding operation, the wafer is fittingly supported within the workpiece receiving hole of the workpiece support plate, and the drive section is engaged with the notch formed for the purpose of orienting the wafer relative to crystal orientation. In such a state, since the wafer is forcibly imparted with torque, both superior surface roughness and accuracy of geometry are achieved.

Further, the grinding tool used in the present embodiment comprises diamond grinding wheels arranged into an annular pattern on the end surface of the disk table, and the annular workpiece contact portions which are provided along the outer and inner peripheries of the disk plate, respectively. If the diamond grinding wheel is in the form of a cup-shaped grinding wheel, the grinding surface of the diamond grinding wheel can press only a part of the grinding wheel, posing a problem of how to support the wafer. However, the grinding tool according to the present embodiment solves the problem without providing the surface grinder with a workpiece support member additionally.

Although the surface grinder has been described for the case of a vertical double disc surface grinder or a vertical single disc surface grinder in the foregoing embodiments, a horizontal double disc surface grinder or a horizontal single disc surface grinder may also be used.

Although the foregoing explanation has described the cases where the vertical double disc surface grinder or the vertical single disc surface grinder is used as the surface grinder, a horizontal double disc surface grinder or a horizontal single disc surface grinder may be used in place of them.

(Fifth Embodiment)

Figure 12:
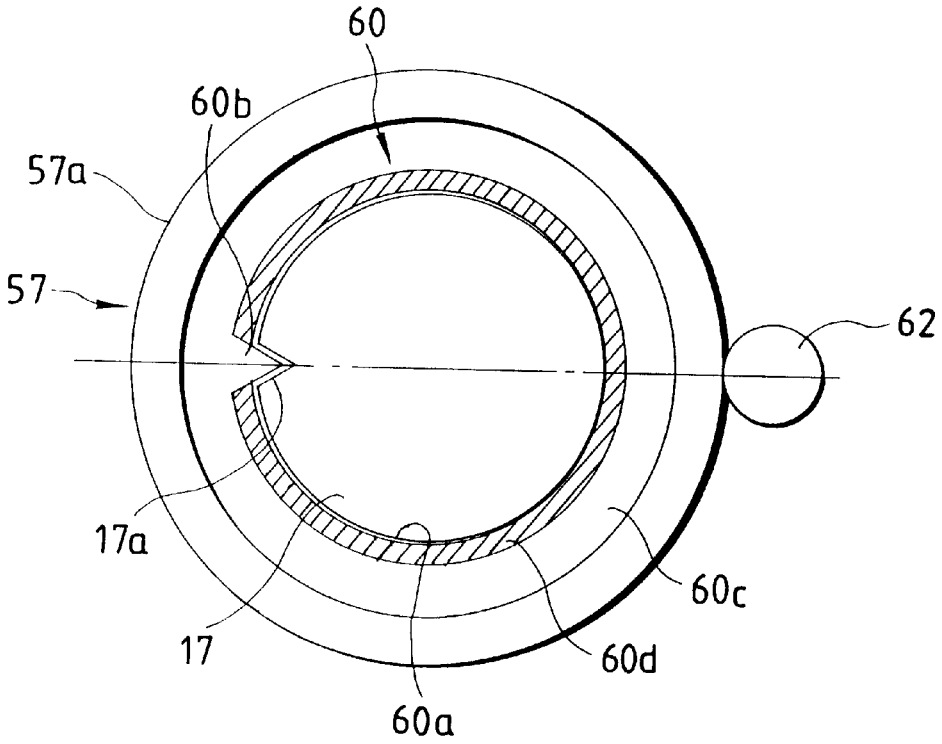
FIG. 12 is a plan view showing the principle elements of a workpiece support member according to a fifth embodiment.
Figure 13:
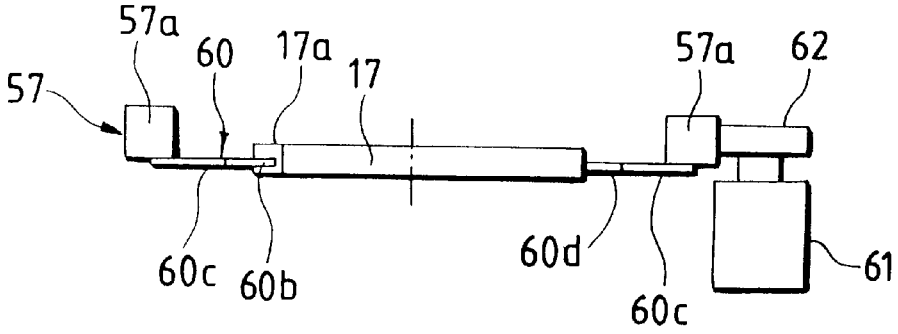
FIG. 13 is a longitudinal cross-sectional view showing the workpiece support member shown in FIG. 12.

FIG. 12 is a plan view showing a workpiece support member according to a fifth embodiment of the present invention, and FIG. 13 is a longitudinal cross-sectional view showing the workpiece support member shown in FIG. 12.

The fifth embodiment is the same as the previous embodiments, except for the configuration of the workpiece support plate 60 to be attached to the rotary disk 57.

The workpiece support plate 60 is fixed on the peripheral frame 57*a* of the rotary disk 57. The workpiece support plate 60 comprises a ring-shaped metal plate 60*c* and a ring-shaped workpiece retaining plate 60*d* (a workpiece retaining member) integrally fixed to the inner periphery of the metal plate 60*c*.

When the workpiece retaining plate 60*d* is combined with the metal plate 60*c*, there is obtained a workpiece support plate identical with the workpiece support plate 60 described for the previous embodiments. The workpiece retaining plate 60*d* is integrally formed with the metal plate 60*c*, or they are fixed together by welding or bonding. The metal plate 60*c* and the workpiece retaining plate 60*d* are thinner than the wafer, or the workpiece 17, at all times. The metal plate 60*c* and the workpiece retaining plate 60*d* have are identical with or different from each other in terms of thickness. The workpiece retaining plate 60*d* is made of material which is softer than that of the workpiece 17, such as synthetic resin or hard rubber, a copper alloy, or an aluminum alloy.

In the fifth embodiment, the workpiece drive section 60*b* protrudes from the receiving hole 60*a*, or the internal periphery of the workpiece retaining plate 60*d*, toward the inside of the workpiece retaining plate 60*d*. In short, the workpiece drive section 60*b* is formed so as to protrude from the metal plate 60*c*, as well as to radially cross the workpiece retaining plate 60*d*.

According to the fifth embodiment, since the workpiece 17 is retained and rotated by the workpiece retaining plate 60*d* made of material which is softer than that of the workpiece 17, there is yielded an advantage of preventing damage, such as a chipping phenomenon, to the outer periphery of the workpiece 17, which damage would otherwise be caused by a chattering phenomenon occurring between the outer periphery of the workpiece 17 and the inner periphery of the workpiece retaining plate 60*d* because of variation in a grinding torque.

If the radial width of the foregoing workpiece retaining plate is reduced, there is achieved a result similar to that accomplished when the inner periphery of the metal plate 60*c* is given metal plating. Further, the inner periphery of the metal plate may be given synthetic resin material by welding. In short, a workpiece retaining plate comprising the metal plate 60*c* having the coated inner periphery is also included in the present embodiment.

(Sixth Embodiment)

A sixth embodiment is intended to prevent a risk of the notch 17*a* of the workpiece 17 being broken when the rotary disk 57 is rotated while the workpiece drive section 60*b* is meshing with the notch 17*a* of the wafer or the like.

Figure 14:
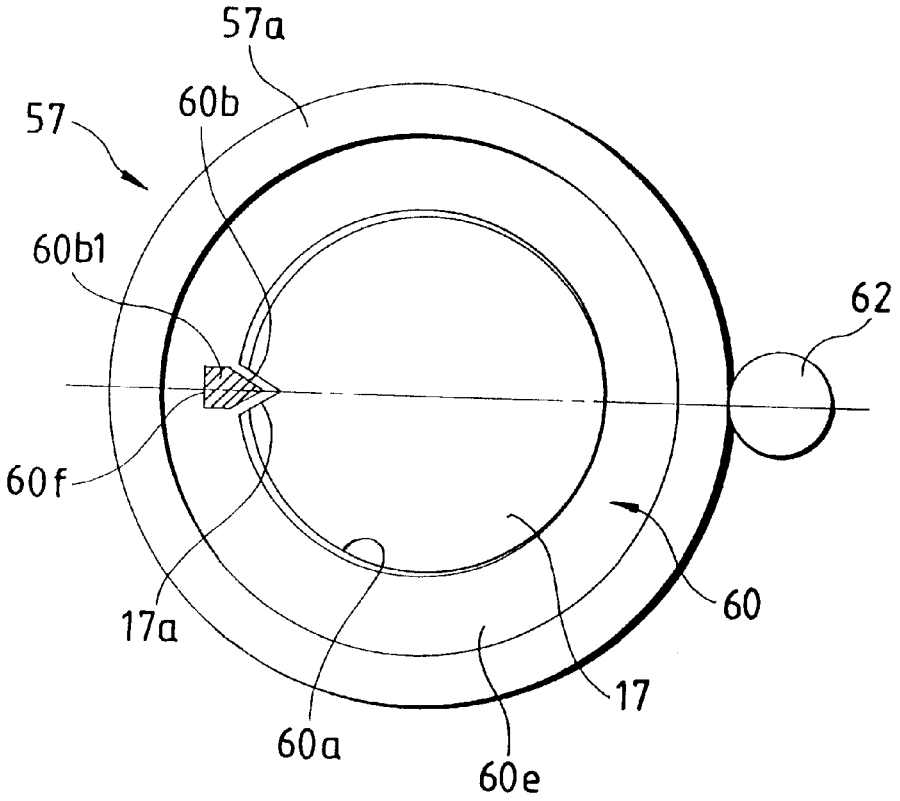
FIG. 14 is a plan view showing the principle elements of a workpiece support member according to a sixth embodiment of the present invention.
Figure 15:
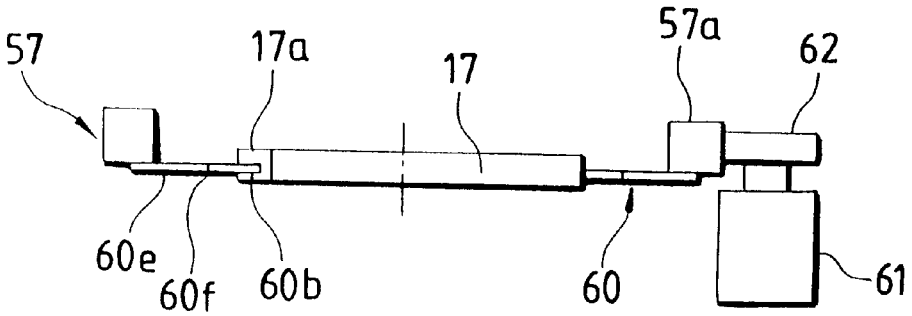
FIG. 15 is a longitudinal cross-sectional view showing the workpiece support member shown in FIG. 14.

As shown in FIGS. 14 and 15, the workpiece drive section 60*b* comprises a main body 60*e* of the workpiece support metal plate 60, a cutout 60*f* which is angularly formed in the main body 60*e* from the inner periphery to outer periphery of the main body in the radial direction, and a root 60*b*1 of the workpiece drive section 60*b* which is integrally formed with or bonded to the main body 60*e*. Alternatively, the main body 60*e* is welded to the workpiece drive section 60*b*. The workpiece drive section 60*b* is formed from material, such as synthetic resin, an aluminum alloy, or a copper alloy, which is softer than that of the workpiece 17, e.g., a wafer.

The workpiece drive section 60*b* and the workpiece support metal main body 60*e* are thinner than the workpiece 17.

According to a sixth embodiment, it is possible to prevent damage, such as a chipping phenomenon, to the notch of the wafer which would otherwise be caused by variations in a grinding torque.

(Seventh Embodiment)

Figure 16:
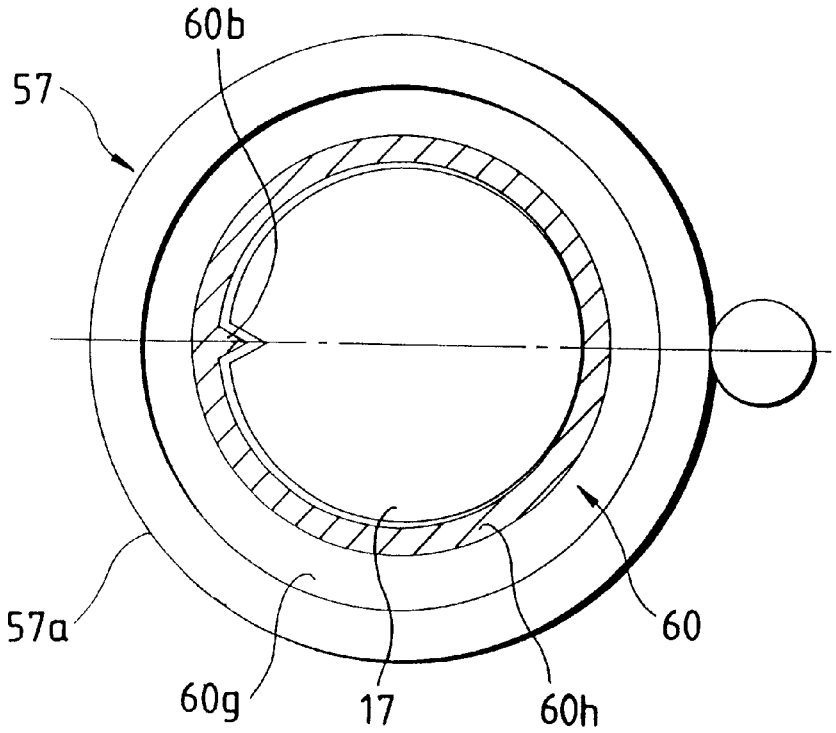
FIG. 16 is a plan view showing the principle elements of a workpiece support member according to a seventh embodiment of the present invention.
Figure 17:
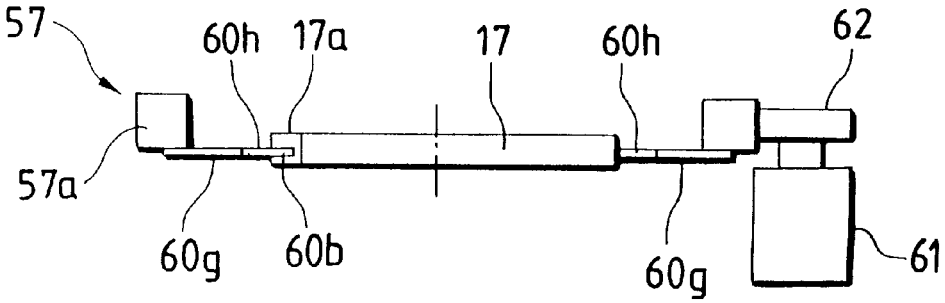
FIG. 17 is a longitudinal cross-sectional view showing the workpiece support member shown in FIG. 16.

FIGS. 16 and 17 show a seventh embodiment of the present invention. In the seventh embodiment, the workpiece support plate 60 comprises an outer metal disk 60*g* integrally formed with an inner plastic workpiece support plate 60*h*. The outer disk 60*g* is integrally formed with or bonded to the inner workpiece support plate 60*h*. In the seventh embodiment, the workpiece drive section 60*b* is formed integrally with the internal periphery of the workpiece support plate 60*h*.

The outer disk 60*g* is made of, e.g., iron, and the workpiece support plate 60*h* is manufactured from non-ferrous metal which is softer than that of the workpiece 17, e.g., a copper alloy, an aluminum alloy, or synthetic resin.

According to the seventh embodiment, since the external disk 60*g* is fixed to the outer periphery 57*a*, the rigidity of the external disk is maintained. Further, the workpiece support plate 60*h* and the workpiece drive section 60*b* protruding from the workpiece support plate are softer than that of the workpiece 17, and hence it is possible to prevent a chipping phenomenon which would otherwise be caused by variations in a grinding torque.

In the seventh embodiment, the workpiece support plate 60*h* is provided along the edge of the external disk 60*g*, and the workpiece support plate 60*h* is thicker than the external disk 60*g*. When the workpiece support plate 60*h* is fixed to the external disk plate 60*g* by bonding or welding, a channel is formed along the outer periphery of the workpiece support plate 60*h*. The thus-formed channel is fitted into the inner periphery of the external disk 60*g*.

Figure 18:
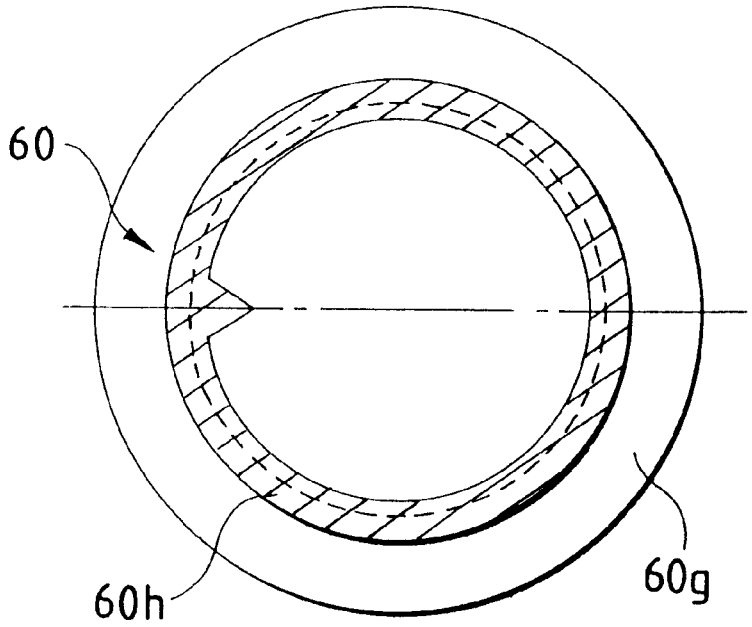
FIG. 18 is a plan view showing a modification of the workpiece support member according to the seventh embodiment.
Figure 19:
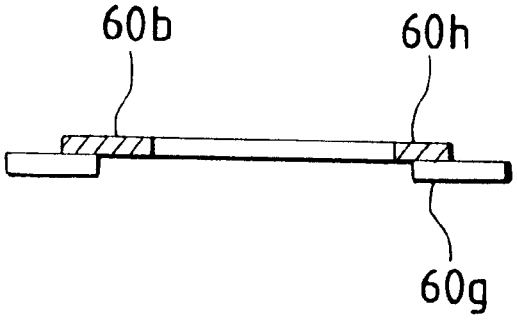
FIG. 19 is a longitudinal cross-sectional view showing the modification shown in FIG. 18.

However, since the workpiece support plate 60*h* is thin, it is difficult to form a channel to be fitted into the external disk 60*g*. As shown in FIGS. 18 and 19, if the workpiece support plate 60*h* and the external disk 60*g* are thick and if it is difficult to attach them together by welding or bonding, the edge of the workpiece support plate 60*h* is superimposed on the edge of the external disk 60*g*. The workpiece support plate 60*h* and the external disk 60*g* can be combined together by bonding or welding the thus-superimposed edges.

(Eighth Embodiment)

In the foregoing embodiments, since the workpiece drive section is integrally formed with or fixed to the workpiece support plate, the workpiece drive section is stationary.

In the eighth embodiment, the workpiece drive section is resiliently retained relative to the workpiece support plate. FIGS. 20 to 23 show the eighth embodiment.

Figure 20:
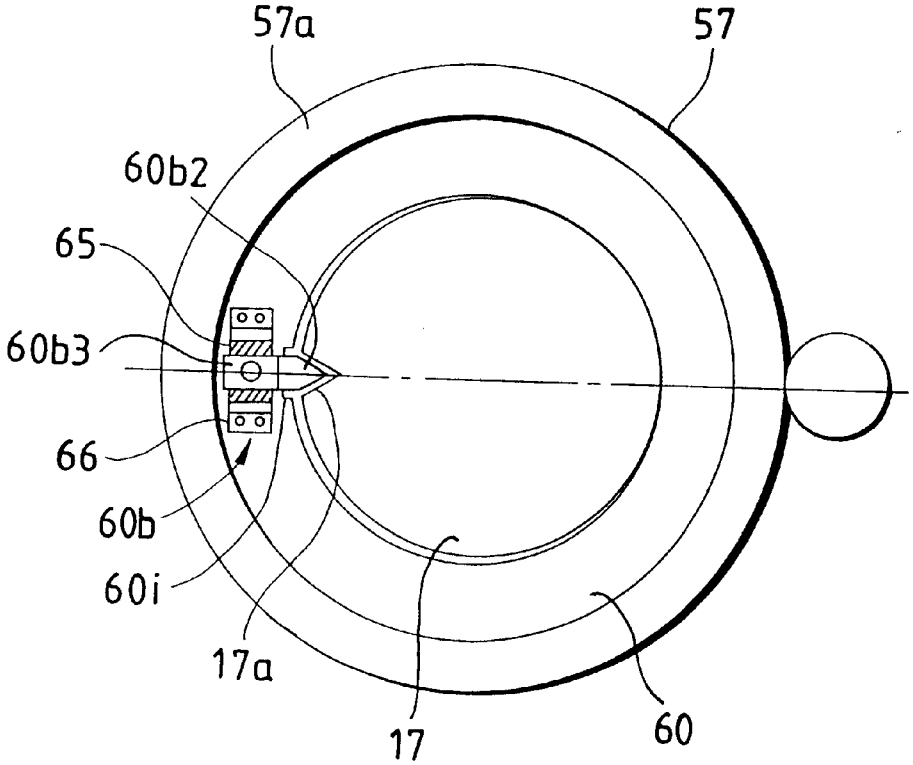
FIG. 20 is a plan view showing the principle elements of the workpiece support member according to an eighth embodiment of the present invention.
Figure 21:
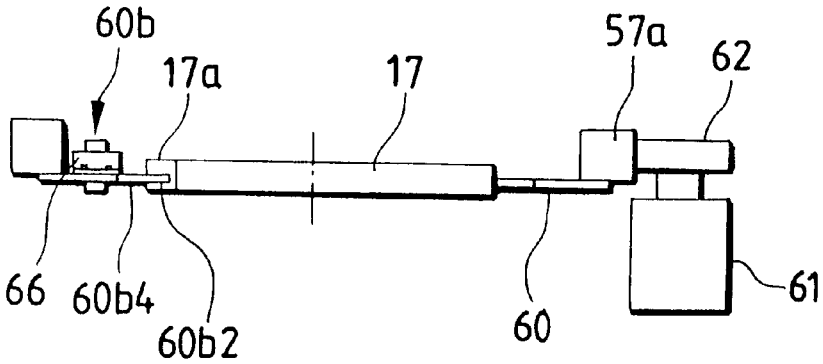
FIG. 21 is a longitudinal cross-sectional view showing the modification shown in FIG. 18.
Figure 22:
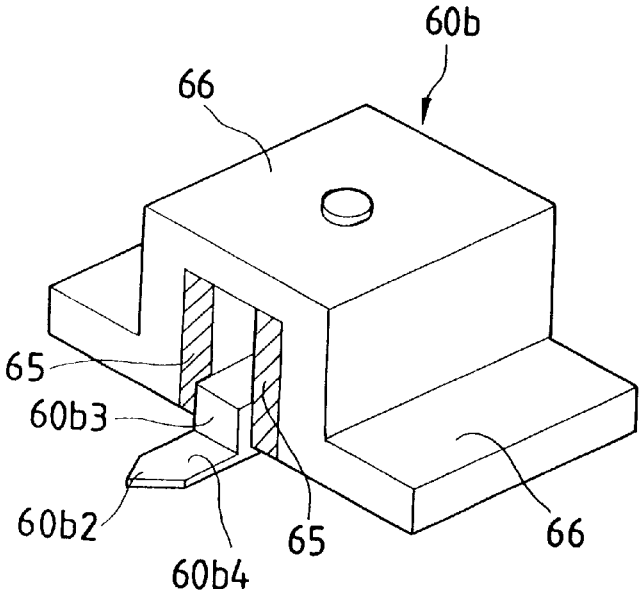
FIG. 22 is a perspective view showing a workpiece drive section according to an eighth embodiment of the present invention.
Figure 23:
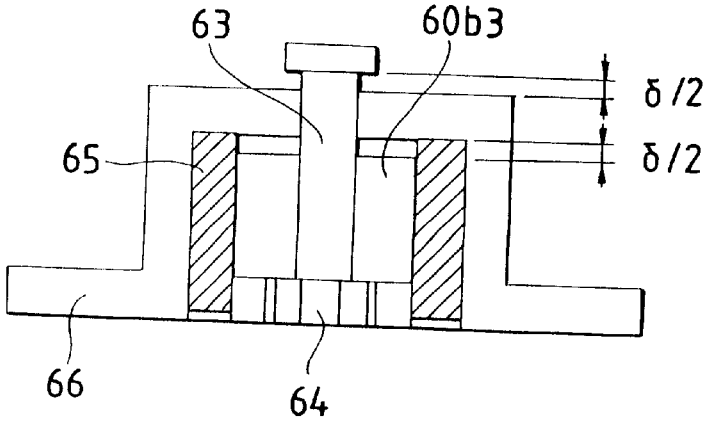
FIG. 23 is a longitudinal cross-sectional view showing the workpiece support member shown in FIG. 20.

FIG. 20 is a plan view showing the workpiece support member when viewed from above. A workpiece drive section 60*b* which faces the center of the rotary disk 57 is provided on the upper surface of the workpiece support plate 60 of the rotary disk 57.

The workpiece drive section 60*b* has-a projection 60*b*2 which engages the notch 17*a* of the workpiece 17. A body 60*b*3 extending rearwards from the projection 60*b*2 is loosely fitted at midpoint to a cylindrical stud 63 provided below the lower surface of a mount bracket 66, so that the workpiece drive section 60*b* is attached to the peripheral frame 57*a*. An under-neck portion of the stud 63 is located at a position higher than the bracket 66 by $\delta/2$, and a nut 64 is threadedly engaged with the stud 63. Accordingly, the workpiece drive section can slightly move. Further, there is a clearance of $\delta/2$ between the body 60*b*3 and the bracket 66.

Here, $\delta$ is 0.1 mm or less. Therefore, the workpiece drive member 60*b*4 comprising the projection 60*b*2 and the body 60*b*3 is set so as to remain substantially stationary in the vertical direction. The body 60*b*3 has an angular shape, and a cushioning member 65 is provided on each side of the body 60*b*3. The mount bracket 66 having the cushioning members 65 bonded or welded thereto is secured to the upper surface of the workpiece support plate 60 by unillustrated bolts. The workpiece drive member 60*b*4 constituting the workpiece drive section 60*b* is slightly movable within a horizontal plane when being damped by the cushioning members 65, thereby reducing physical shock given to the projection 60*b*2. The workpiece drive member 60*b*4 formed after the projection 60*b*2 is thinner than the workpiece 17. The width of the workpiece drive member 60*b*4 is set such that the workpiece drive member becomes loosely fit into a slit 60I radially formed in the workpiece support plate 60.

When the rotary disk 57 is rotated, the projection 60*b*2 of the workpiece drive section 60*b* comes into engagement with the notch 17*a* of the workpiece 17, and rotates the workpiece 17. If there is a variation in a grinding torque, the torque used for actuating the workpiece 17 also changes, exerting force on the projection 60*b*2 of the workpiece drive section 60*b*. Physical shock developing between the notch 17*a* of the workpiece 17 and the projection 60*b*2 of the workpiece drive section 60*b* is absorbed by the cushioning members 65 provided on both sides of the body 60*b*3. As a result, even in a case where the workpiece 17 is, e.g., a wafer, the notch 17*a* of the workpiece 17 is prevented from being damaged, and the outer periphery of the workpiece 17 is prevented from being chipped.

(Ninth Embodiment)

FIGS. 24 to 28 show a ninth embodiment of the present invention.

Figure 24:
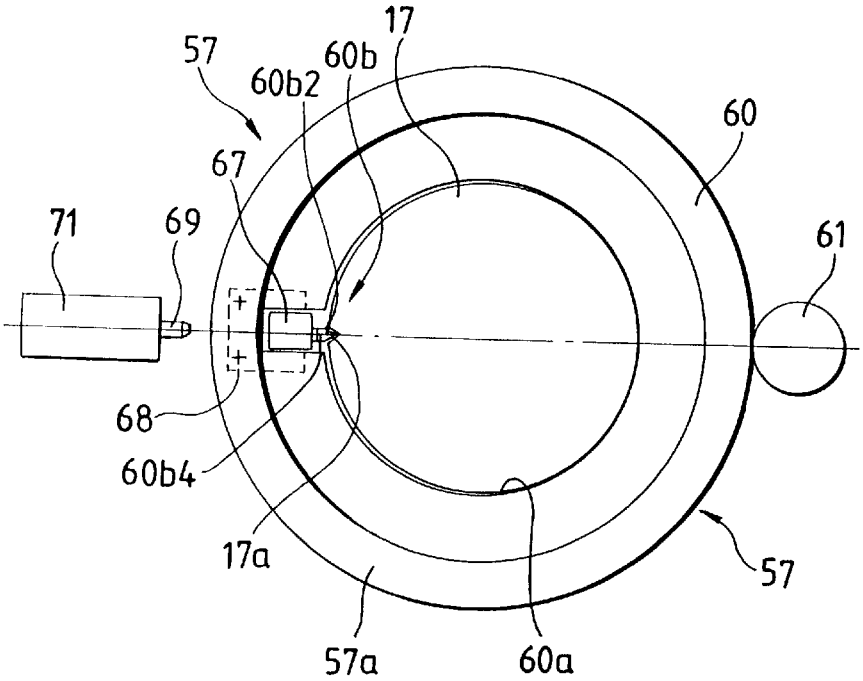
FIG. 24 is a plan view showing a workpiece support member according to a ninth embodiment of the present invention.
Figure 25:
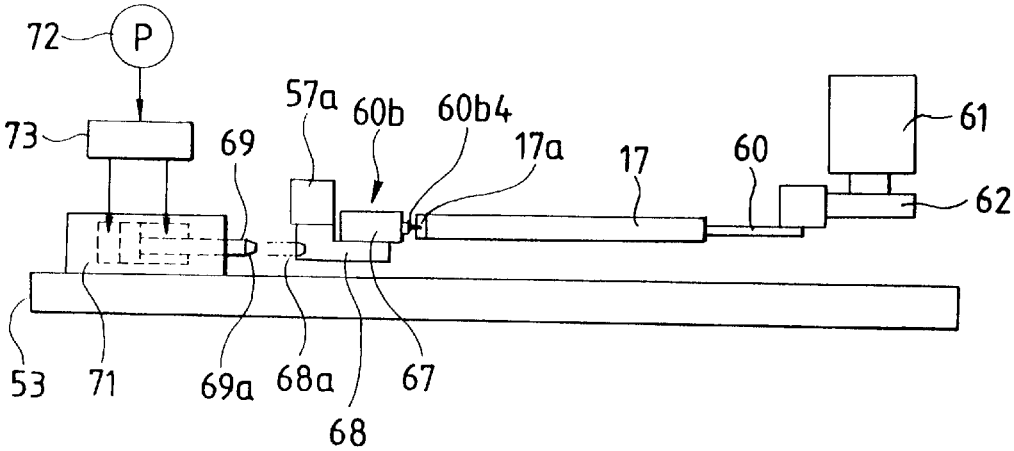
FIG. 25 is a longitudinal cross-sectional view showing the workpiece drive section shown in FIG. 24.
Figure 26:
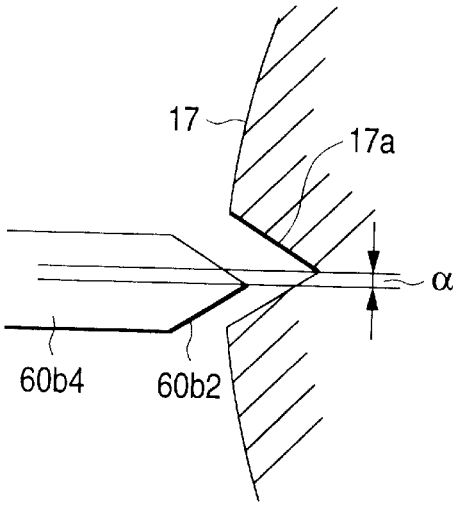
FIGS. 26A and 26B are plan views respectively showing the operation of the workpiece drive member.
Figure 26:
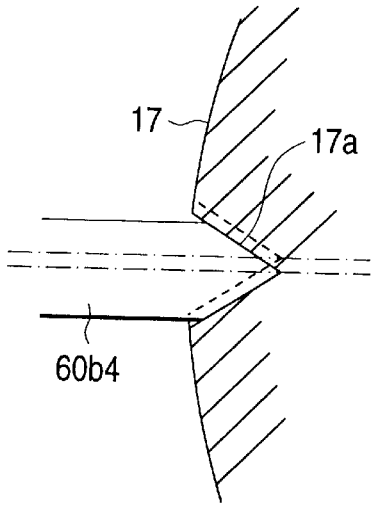

As shown in FIGS. 24 and 25, the workpiece drive section 60*b* is situated just behind the peripheral frame 57*a* of the rotary disk 57. The rotary disk 57 and the workpiece drive section 60*b*4 are situated in one plane, and the projection 60*b*2 of the workpiece drive member 60*b*4 is capable of engaging with the notch 17*a* of the workpiece 17. The workpiece drive section 60*b* is mounted on an actuator 67 so as to push the workpiece drive member 60*b*4 in the radial direction until it engages with the notch 17*a* (see FIG. 26B), as well as to withdraw the workpiece drive member 60*b*4 until it is disengaged from the notch 17*a* (see FIG. 26A). The actuator 67 is mounted on a manifold 68 fixed to the lower surface of the peripheral frame 57*a*. The motor 61 is a servo motor and is energized by an unillustrated controller to thereby rotate the disk plate 57 and to stop the rotary disk to a given position.

A fluid pressure cylinder 71 having a plunger 69 is mounted on the slide table 53. At the fixed stopping position of the rotary disk 57, the plunger 69 advances to an entrance 68*a* of the manifold 68 until a tip end 69*a* of the plunger 69 fits into the entrance 68*a*, and also recedes until the tip end 69*a* is disengaged from the entrance 68*a*. Compressed air is supplied to or discharged out of the fluid pressure cylinder 71 from a pressurizing fluid source, e.g., an air compressor 72, by a switching valve 73.

Figure 27:
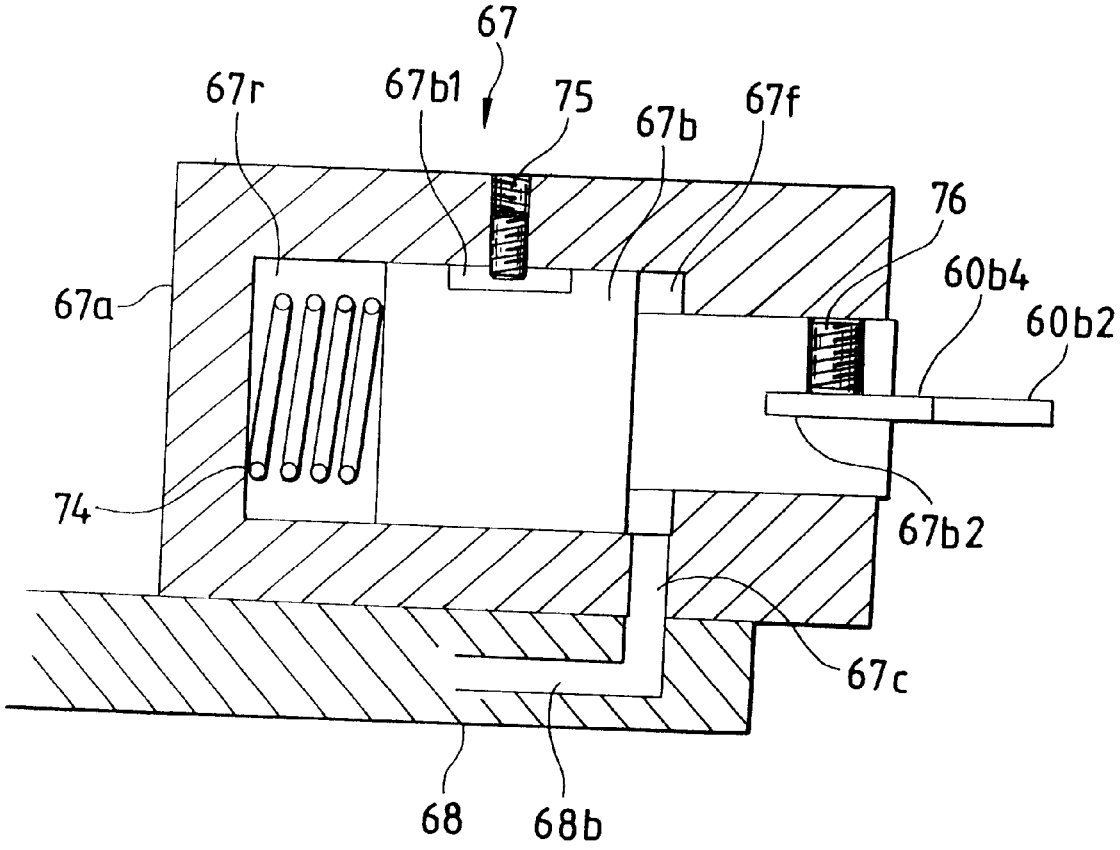
FIG. 27 is a longitudinal cross-sectional view showing an actuator seated on the workpiece drive member.

FIG. 27 shows an actuator 67. The actuator 67 comprises a cylinder body 67*a* having a cylindrical cylinder chamber; a plunger 67*b* which is tightly fitted into the cylinder body 67*a* and is capable of advancing or receding; a compression coil spring 74 which is situated in a rear cylinder chamber 67*r* of the cylinder body 67*a* in a compressed state; and a machine screw 75 which is screwed into the cylinder body 67*a*until the tip end of the machine screw is fitted into a channel 67*b*1 formed in the side surface of the plunger 67*b* in the axial direction thereof. The plunger 67*b* is stationary relative to the cylinder body 67*a*. The workpiece drive member 60*b*4 is fitted into a slot 67*b*2 horizontally formed in the tip end of the plunger 67*b* and is pressed by a machine screw 76 screwed into the plunger 67*b*. A port 67*c* communicating with a front cylinder chamber 67*f* of the actuator 67 is connected to a compressed air flow channel 68*b* of the manifold 68.

Figure 28:
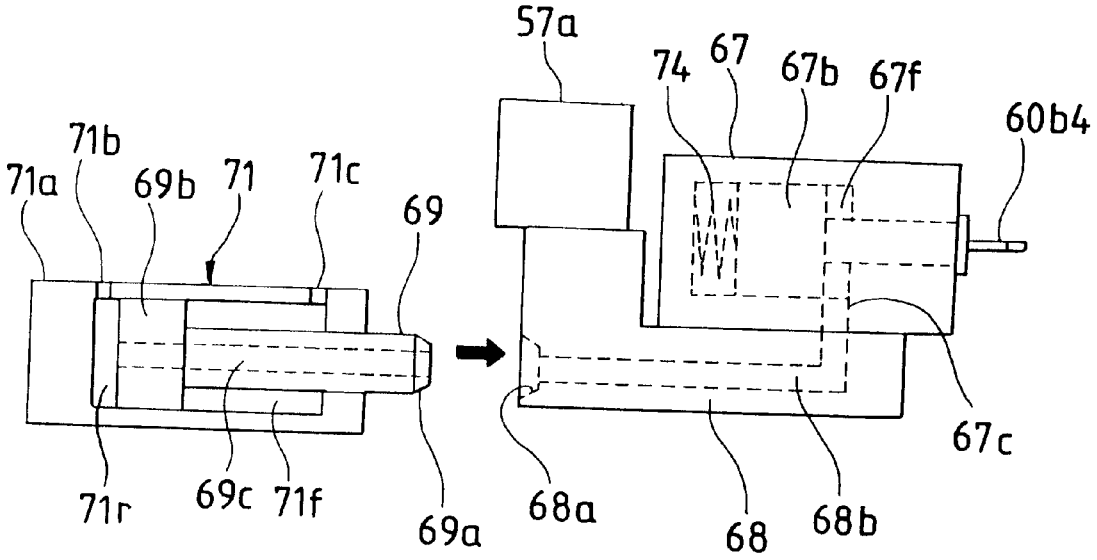
FIG. 28 is a fragmentary-sectional-and enlarged side view showing a part of the workpiece drive section shown in FIG. 25.

As shown in FIG. 28, the entrance 68*a* of the compressed air flow channel 68*b* of the manifold 68 has a truncated conical shape. The tip end 69*a* of the plunger 69 which tightly fits into the cylinder body 71*a* of the fluid pressure cylinder 71 also has a truncated conical shape and matches in shape the entrance 68*a* of the manifold 68. A compressed air channel 69*c* is formed along the center of the plunger 69 so as to pass through the plunger in the direction in which the plunger 69 advances or recedes. A small hole or an orifice is (not shown) is formed in the channel 69*c*, thereby ensuring forward movement of the plunger 69*b*. With this construction, a rear cylinder chamber 71*r* of a cylinder body 71*a* of the fluid pressure cylinder 71 is connected to the tip end 69*a* of the plunger 69. A front cylinder chamber 71*f* and the rear cylinder chamber 71*r* of the cylinder body 71*a* are connected to the switching valve 73 through the ports 71*b* and 71*c*, respectively. In a case where compressed air is used as a pressure source, the switching valve 73 is formed from a three-way switching valve.

The operation of the workpiece support member having the foregoing construction according to the ninth embodiment will be described.

In a state in which the double disc surface grinder is in an inactive state after completion of a previous machining operation, the plunger 69 of the fluid pressure cylinder 71 is situated in a receded position. Further, the tip end 69*a* of the plunger 69 is situated in a receded position relative to the entrance 68*a*, and the plunger 67*b* equipped with the workpiece drive member 60*b*4 is situated at the forward end to which the plunger has been pushed by the spring force of the compression coil spring 74. When the plunger 67*b* is situated at the forward end, the projection 60*b*2 of the workpiece drive member 60*b*4 is in a position close to the center of the rotary disk 57 with reference to the notch 17*a* of the workpiece 17.

To place the workpiece 17 on the workpiece support member, compressed air is supplied to the rear cylinder chamber 71*r* of the fluid pressure chamber 71 by switching the switching valve 73. When the compressed air escapes to the outside of the rear cylinder chamber 71*r* by the channel 69*c*, forward thrust develops in the plunger 69 because of orifice resistance of the channel 69*c*, moving the plunger 69 forward. As a result, the tip end 69*a* of the plunger 69 fits into the entrance 68*a* of the manifold 68 fixed to the rotary disk 57 which is at a standstill in a given position. By the channel 69*c* of the plunger 69, the channel 69*b* of the manifold 68, and the port 67*c*, the compressed air flows into the front cylinder chamber 67*f* of the actuator 67, withdrawing the plunger 67*b* against the spring force of the compression coil spring 74. As a result, the workpiece drive section 60*b*4 is withdrawn. In this state, the notch 17*a* of the workpiece 17 is brought into alignment with the projection 60*b*2 of the workpiece drive member 60*b*4, and the workpiece 17 is fitted into the receiving hole 60*a*. At this time, the workpiece 17 is retained in the same way as it is set to the double disc surface grinder described for the previous embodiments.

Next, as a result of the compressed air supplied from the air compressor 72 being switched by the switching valve 73, the compressed air is delivered to the front cylinder chamber 71*f* of the fluid pressure cylinder 71, causing the compressed air to escape to the atmosphere from the rear cylinder chamber 71*r*. Eventually, the tip end 69*a* of the plunger 60 departs from the entrance 68*a* of the manifold 68. At the same time, the compressed air is released from the front cylinder chamber 67*f* of the actuator 67 to the atmosphere by the port 67*c*, the compressed air flow channel 68*b*, and the entrance 68*a*. Accordingly, by the spring force of the compression coil spring 74 that has been held in a compressed state in a left part of the cylinder under the pressure of the compressed air trapped in the front cylinder chamber 67*f* so far, the plunger 67*b* is forwardly moved to advance the workpiece drive member 60*b*4 to the notch 17*a* of the workpiece 17. Even if there is displacement $\alpha$ between the triangular projection 60*b*2 of the workpiece drive member 60*b*4 and the V-shaped notch 17*a* of the workpiece 17 such as that shown in FIG. 26A, the projection 60*b*2 of the workpiece drive member 60*b*4 enters the notch 17*a* by the spring force of the compression coil spring 74, rotating the workpiece 17 within the receiving hole 60*a*. As shown in FIGS. 26A and 26B, the projection 60*b*2 of the workpiece drive member 60*b*4 meshes the notch 17*a*. In this way, even if the workpiece 17 is roughly set on the workpiece support member 14, the workpiece 17 is reset in a correct position precisely.

With the foregoing configuration, the manifold 68, the actuator 67, and the workpiece drive member 60*b*4 rotate together with the rotary disk 57 in an integrated fashion. In a sate in which the spring force of the compression coil spring 74 is exerted on the projection 60*b*2 of the workpiece drive member 60*b*4 by the plunger 67*b*, there is no clearance between the projection 60*b*2 and the notch 17*a*. In such a state, in the event of variations in a grinding torque, the projection 60*b*2 is prevented from coming into collision with the notch 17*a*, thereby preventing damage to the workpiece 17, such as chipping of the workpiece 17. Further, even when the workpiece 17 is set on or removed from the rotary disk 57, the notch 17*a* of the workpiece 17 is in a position spaced away from the workpiece drive section 60*b*. Accordingly, the workpiece 17 can be roughly inserted into the receiving hole 60*a*.

After the workpiece 17 has finished undergoing a grinding operation, the rotary disk 57 comes to a stop at a predetermined position. Switching the switching valve 73 results in forward movement of the plunger 69, fitting the tip end 69*a* of the plunger into the entrance 68*a* of the manifold 68. As a result, compressed air is fed to the front cylinder chamber 67*f* of the actuator 67 through the port 67*c* of the actuator 67 by the channel 69*b* of the manifold 68 and the port 67*c* of the actuator 67, thereby withdrawing the plunger 67*b* against the spring force of the compression coil spring 74. Eventually, a clearance arises between the notch 17*a* of the workpiece 17 and the projection 60*b*2 of the workpiece drive member 60*b*4. The ground workpiece 17 is now removed from the receiving hole, and another unprocessed workpiece 17 is set in the receiving hole 60*a*.

(Tenth Embodiment)

Figure 29:
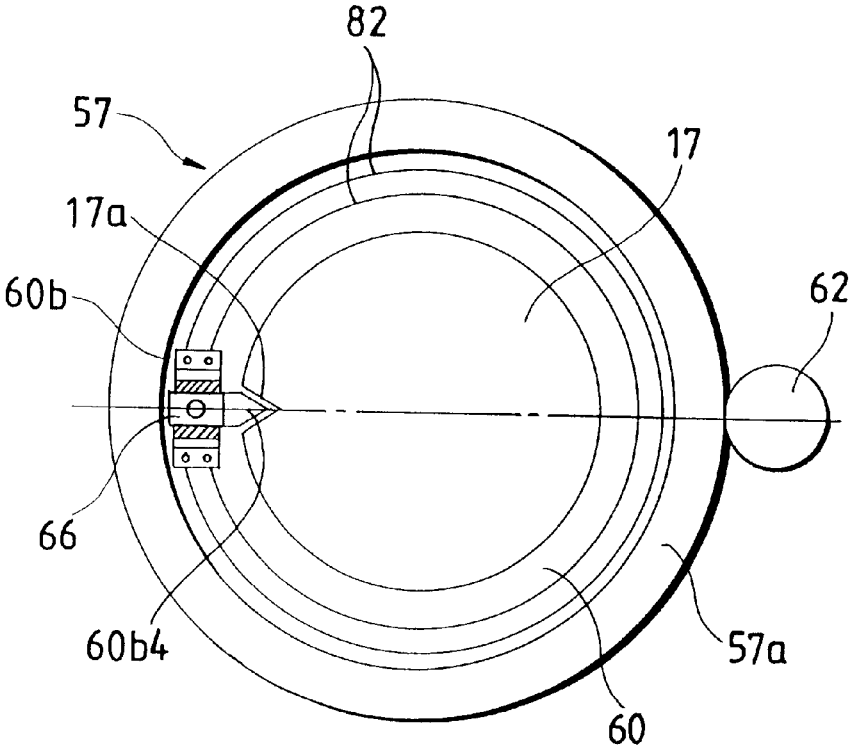
FIG. 29 is a plan view showing a workpiece support member according to a tenth embodiment of the present invention.
Figure 30:
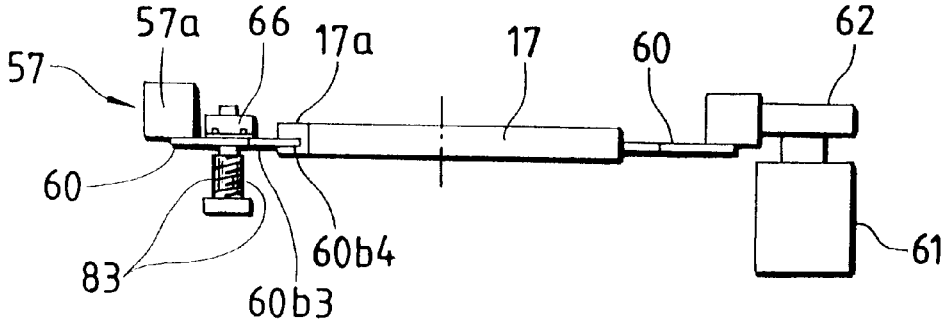
FIG. 30 is a longitudinal cross-sectional view showing the actuator shown in FIG. 27.
Figure 31:
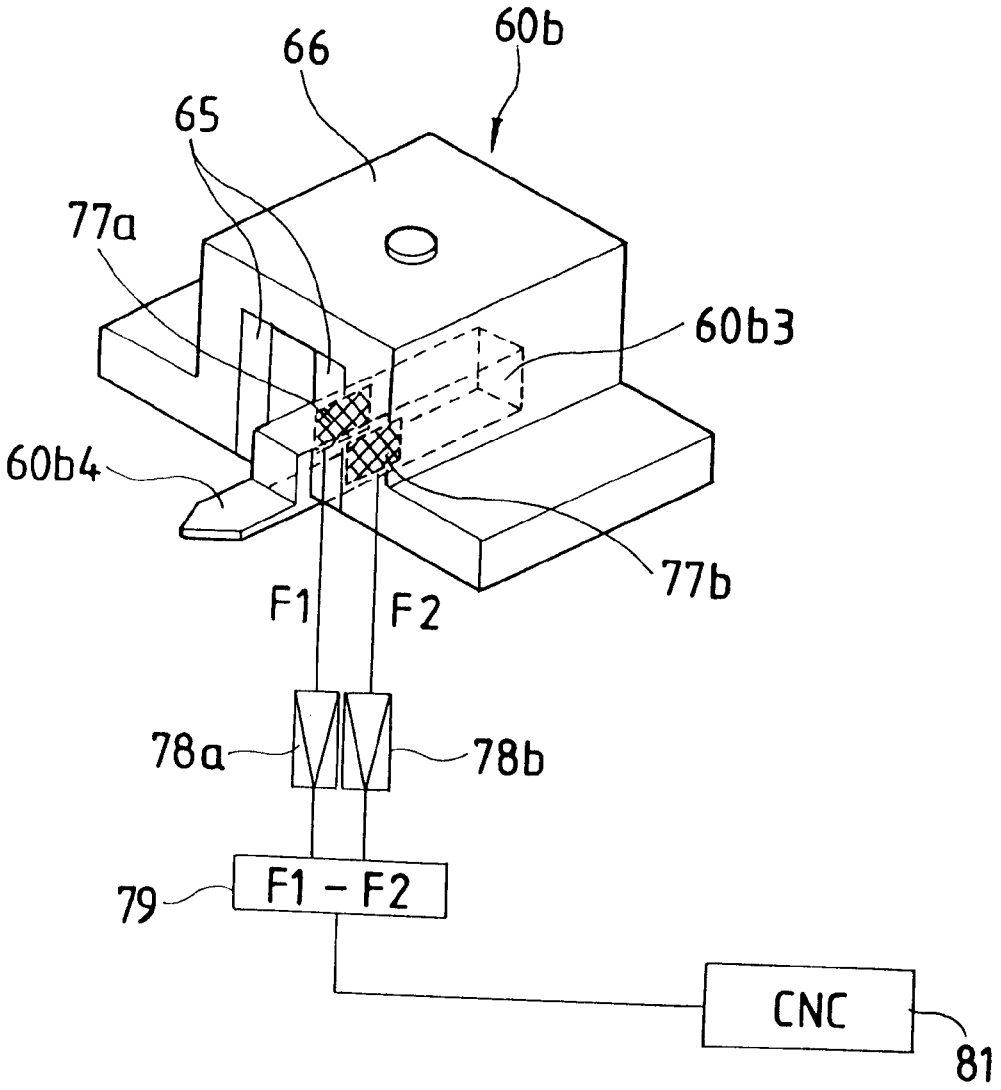
FIG. 31 is a perspective view showing the inside of load detection means in part according to the tenth embodiment.

A tenth embodiment is different from the foregoing eighth embodiment in detecting variations in a grinding torque. FIGS. 29 to 31 show the tenth embodiment. A workpiece support member employed for the present embodiment has the same overall configuration as that employed for the eight embodiment shown in FIGS. 21 and 22.

As shown in FIG. 31, the body 60*b*3 of the workpiece drive member 60*b*4 is sandwiched between the cushioning members 65. A pressure detector 77*a* is inserted in a hole formed in the cushioning member 65 provided between one surface of the body 60*b*3 of the workpiece drive member 60*b*4 and the interior wall surface of the mount bracket 66 on one side, and another pressure detector 77*b* is inserted into a hole formed in the cushioning member 65 provided between the other surface of the body 60*b*3 and the interior wall surface of the mount bracket on or the other side. The pressure detector 77 (comprising the detectors 77*a*, 77*b*) is a displacement gauge comprising a piezoelectric element. A pressure detected by the pressure detector 77 is converted into an electric signal through piezoelectric conversion, and the thus-converted electric signal is amplified by operational amplifiers 78*a*, 78*b*. A controller 79 comprising a comparator calculates a difference between the pressure values detected by the pressure detectors 77*a*, 77*b*, controlling the rotational speed of the workpiece, that of the grinding wheels, and the extent to which the workpiece is ground by grinding wheels by a numerical controller 81.

More specifically, as shown in FIGS. 29 and 30, the pressure values detected by the pressure detectors 77*a*, 77*b* are fed to the operational amplifiers 78*a*, 78*b* by two brushes 83 which move in a slidable manner along two slip rings 82 formed in the lower surface of the workpiece support plate 60 so as to become concentric with the rotary disk 57. Alternatively, detection signals may be output from unillustrated radio transmitters of the pressure detectors 77*a*, 77*b*, and the operational amplifiers 78*a*, 78*b* may receive the signals by unillustrated radio receivers.

According to the tenth embodiment, if there is a risk of the notch 17*a* of the workpiece 17 being cracked by an abnormal increase in a grinding torque due to abrasion of the grinding wheels, it is possible to cope with the risk by deceleration of the grinding wheels or workpiece or by reduction in the extent to which the workpiece is ground.

(Eleventh Embodiment)

Figure 32:
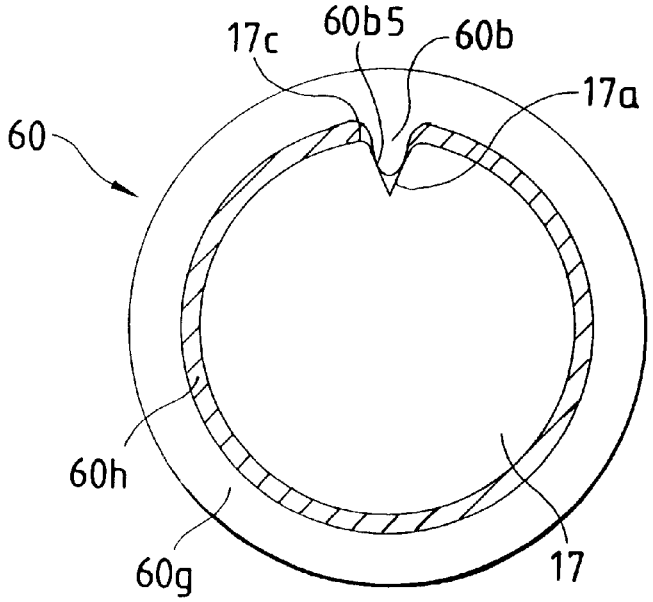
FIG. 32 is a plan view showing a workpiece support member according to an eleventh embodiment of the present invention.
Figure 33:
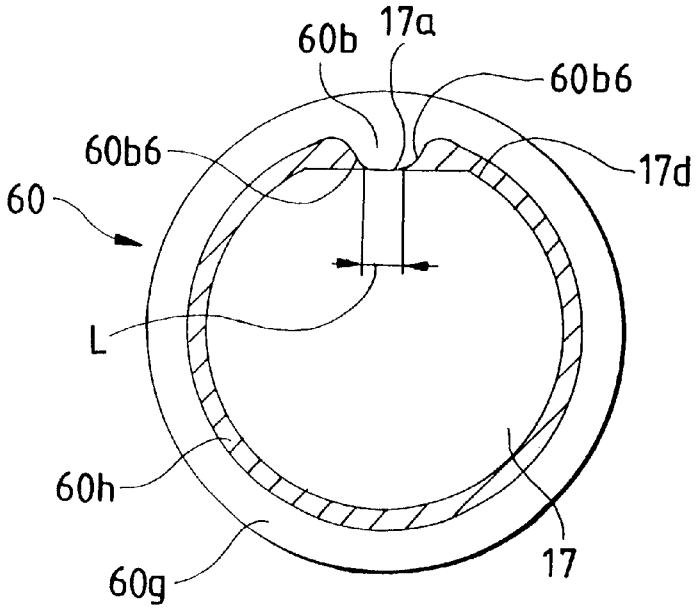
FIG. 33 is a plan view showing the workpiece support. member according to the eleventh embodiment.
Figure 34:
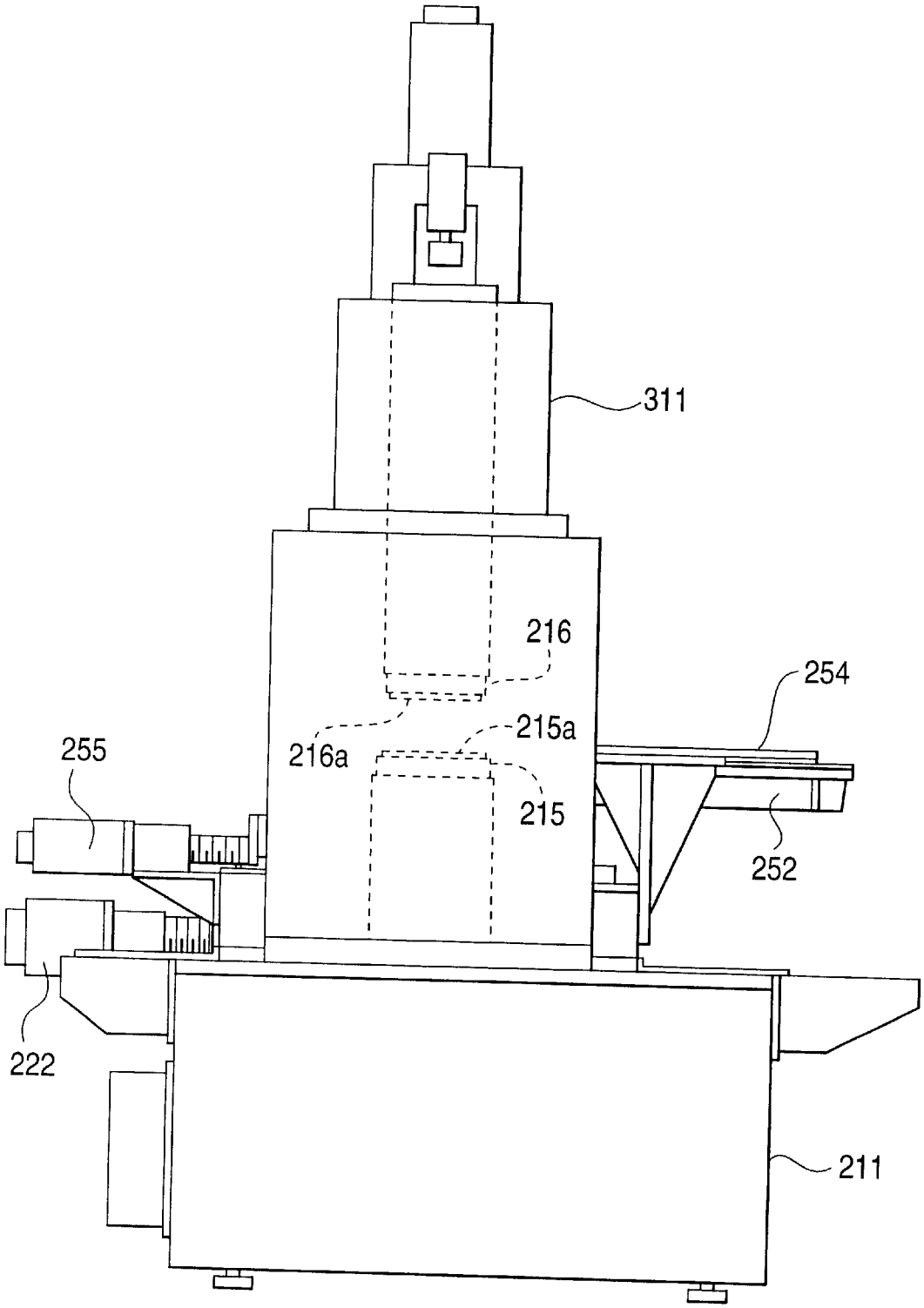
FIG. 34 is a front view showing a double disc surface grinder according to twelfth embodiment of the present invention.

FIGS. 32 and 33 show a preferred embodiment of the workpiece drive section.

FIG. 32 shows a workpiece drive section designed in such a way that a bulging curvature 60*b*5 of the workpiece drive section 60*b* comes into contact with the V-shaped notch 17*a* of the workpiece 17. The curvature corresponds to a circular surface, a quadratic surface, or an involute surface. With such a geometry of the curvature, the workpiece drive section 60*b* can be prevented from coming into contact with angular portions 17*c* formed between the notch 17*a* and the outer periphery of the workpiece 17. Accordingly, the angular portions 17*c* of the workpiece 17 which are particularly susceptible to chipping can be prevented from being chipped.

FIG. 33 shows the workpiece 17 whose notch 17*a* is formed by slicing part of the outer periphery of the workpiece along a chord (i.e., the notch is formed into what is called an orientation flat). A flat portion of the workpiece drive section 60*b* comes into contact with the flat portion of the notch 17*a* over length L, and smoothed bulging curvatures 60*b*6 are contiguous to the both sides of the flat portion of the workpiece drive section. Alternatively, the workpiece drive section 60*b* may be formed to have a curvature which comes into contact with the notch 17*a* of the workpiece 17. With the foregoing geometry of the workpiece drive section and the notch, even if driving force is exerted on the workpiece 17, the workpiece drive section 60*b* does not come into contact with angular portions 17*d* formed between the notch 17*a* of the workpiece 17 and the workpiece drive section 60*b*. Accordingly, the angular portions 17*d* of the workpiece 17 are prevented from being chipped.

By the surface grinder and the grinding method according to the present invention, both surfaces of a workpiece (such as a wafer) can be simultaneously ground while the wafer is forcibly rotated, and hence the wafer can be ground in a short time with superior surface roughness and accuracy of geometry.

By the surface grinder and the grinding method according to the present invention, both surfaces of a workpiece (such as a wafer) can be simultaneously ground while the wafer is forcibly rotated, and hence the wafer can be ground in a short time with superior surface roughness and accuracy of geometry.

With regard to the foregoing method, so long as both surfaces of the wafer are ground through use of grinding wheels of different grinding characteristics, only one surface of the wafer can be ground to a required flatness, and the other surface of the wafer on which no circuits will be formed can be ground to a minimum required extent.

With regard to the foregoing method, so long as a grinding surface of a cup-shaped grinding wheel is set so as to pass through the center of the wafer, the entire surface of the wafer can be ground.

A double disc surface grinder comprises a workpiece support plate which is thinner than a workpiece and comes into close contact with the end surface of each of grinding wheels, a workpiece drive section formed along the internal periphery of the rotary disk, a receiving hole for receiving the workpiece, a support member for rotatively supporting the rotary disk, and rotational drive means for driving the rotary disk. Through use of this surface grinder, a thin workpiece can be efficiently ground into a product having superior accuracy of geometry (i.e., warpage).

The workpiece support member according the present invention can be readily attached to a double or single disc surface grinder, and the main unit of the surface grinder can be used, substantially as is.

In the workpiece support member according to the present invention, a portion of the support member which fits into the workpiece is formed from synthetic resin or rubber. Accordingly, the workpiece support member has the advantage of preventing the workpiece from being chipped.

According to the present invention, since the workpiece support member whose workpiece drive section is formed from material softer than that of the workpiece, there is eliminated a risk of damage to the notch of the workpiece, such as chipping of the notch.

In the workpiece support member according to the present invention, since the portion of the disk plate which comes into contact with the workpiece is formed from material softer than that of the workpiece, the workpiece support member has the advantage of preventing damage to the workpiece, such as chipping of the workpiece or cracks in the workpiece.

According to the present invention, the rotary disk is formed from a circular metal plate, and a workpiece retaining member is formed from material softer than that of the metal plate along the internal periphery of the metal plate. Since the workpiece drive section is formed on the metal plate, the workpiece drive section provides strength and durability to the metal plate. In contrast, since the workpiece drive section is formed on the workpiece retaining member, there is reduced a risk of damage to the notch of the workpiece.

According to the present invention, since the surface of the workpiece drive section of the rotary disk which comes into contact with the workpiece is formed into a curvature, there can be prevented chipping of the workpiece which would otherwise be caused by application of force to angular portions of the workpiece by the workpiece drive section.

According to the present invention, since the workpiece drive section is supported so as to be freely movable relative to the rotary disk and the workpiece support member is mounted on the rotary disk by-cushioning members, there is eliminated a risk of damage to the notch of the workpiece, such as cracks in the notch.

According to the present invention, the workpiece drive member is provided in the rotary support member in such a way as to be biased by a spring member, as well as to be movable toward the center of the rotary disk. Accordingly, the workpiece drive member remains in close contact with the notch of the workpiece at all times. In the event of variations in the a grinding torque exerted on the workpiece, physical shock applied to the workpiece from the workpiece drive member can be reduced, which in turn makes it possible to prevent the notch of the workpiece from being damaged.

According to the present invention, the workpiece support member is provided with an actuator and a fluid pressure cylinder. The actuator forces the workpiece drive member toward the center of the rotary disk by a spring member. The rotary disk is stopped at a given position through use of given-position stopper and the pressure cylinder supplies a pressurized fluid to the actuator, thereby withdrawing the workpiece drive member. Such a workpiece drive member is capable of preventing damage to the notch of the workpiece, as well as capable of realizing easy removal of the workpiece.

According to the present invention, the workpiece drive member is designed so as to advance or recede by the actuator and the spring member, and a pressurized fluid is supplied to the actuator through a channel formed in a plunger. Use of the fluid pressure cylinder enables implementation of a workpiece drive member simple which has a simple structure, which prevents the notch of the workpiece from being damaged, and which effects easy removal or attachment of the workpiece.

According to the present invention, the workpiece support member is provided with load detection means for detecting pressure or displacement exerted on the workpiece drive section and is capable of coping with an overload by detection of grinding torque on the basis of the load exerted on the workpiece drive section. Such a workpiece support member is capable of detecting abnormal abrasion of grinding wheels, as well as capable of damage to the workpiece or the grinder.

Twelfth through Nineteenth Embodiments of the present invention will be described in detail by reference to FIGS. 34 through 52.

(12th Embodiment)

As shown in FIGS. 34 through 37, a double disc surface grinder according to a first embodiment comprises a lower frame 211, and an upper frame 311 is mounted on the lower frame 211. The lower frame 211 comprises a lower grinding wheel feed unit 212 and a workpiece support member 214, and the upper frame 311 comprises an upper grinding wheel feed unit 213. The lower grinding wheel feed unit 212 has a lower grinding wheel 215, and the upper grinding wheel feed unit 213 has an upper grinding wheel 216. A grinding surface 215*a* provided at the upper end of the lower grinding wheel 215 and a grinding surface 216*a* provided at the lower end of the upper grinding wheel 216 are positioned so as to become opposite to and in parallel with each other. While being supported on the workpiece support member 214, a thin-plate-like workpiece 217 is inserted between the grinding wheels 215, 216 of the grinding wheel feed units 212, 213. Both surfaces of the workpiece 217 are simultaneously ground by the grinding surfaces 215*a*, 216*a* of the grinding wheels 215, 216.

Figure 35:
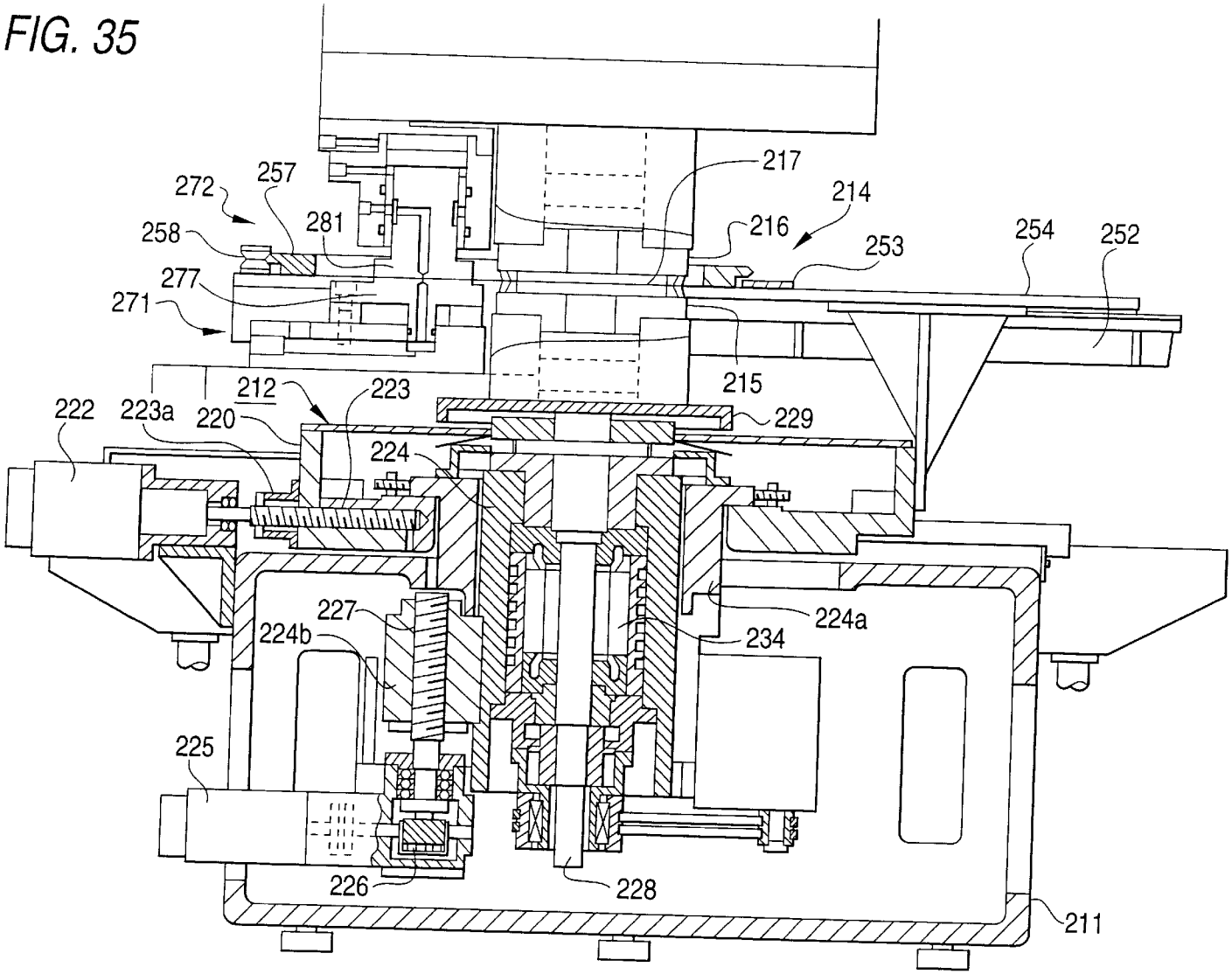
FIG. 35 is a longitudinal cross-sectional view showing the principle elements of a lower frame.
Figure 36:
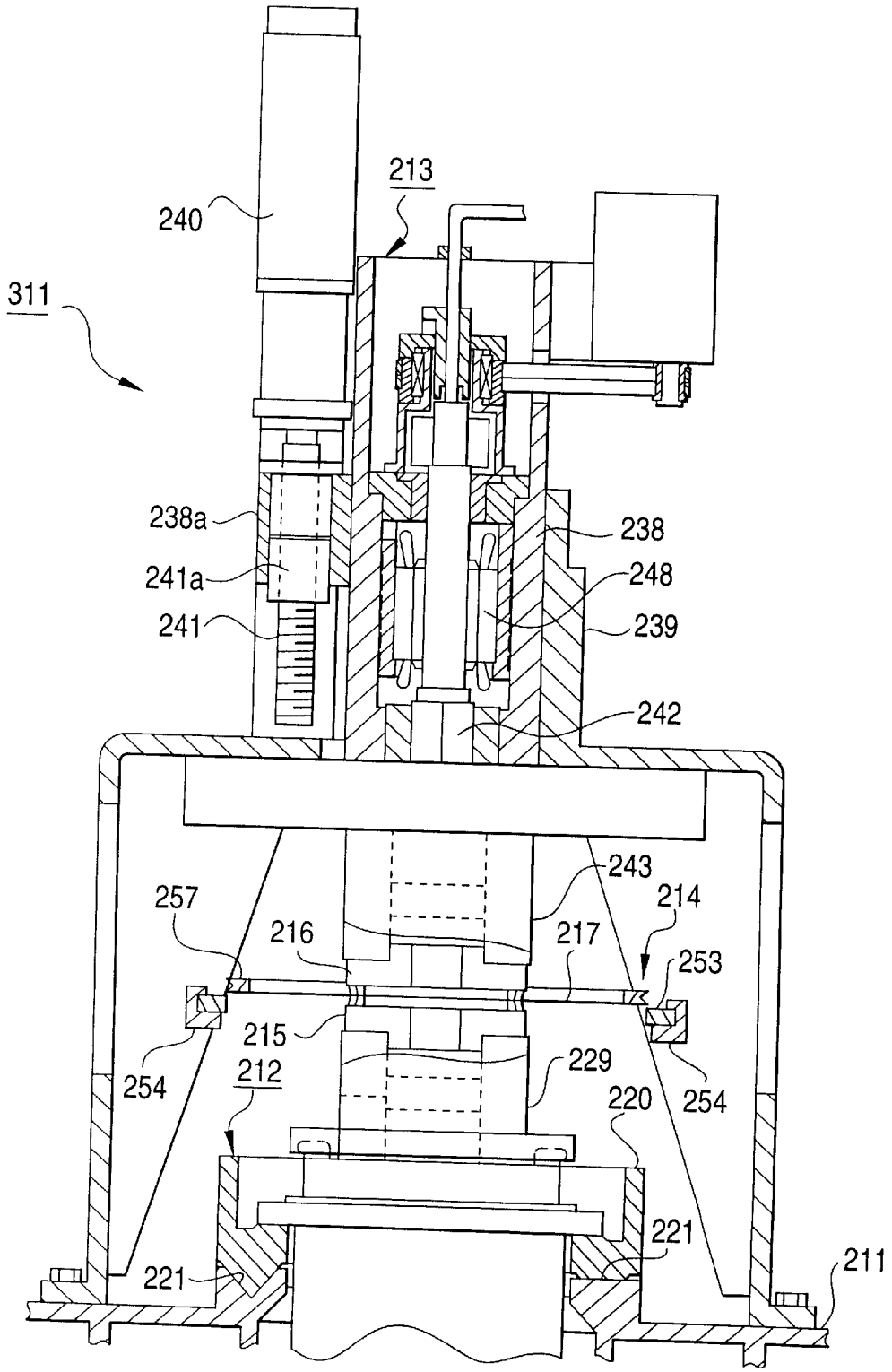
FIG. 36 is a longitudinal cross-sectional view showing the principle elements of an upper frame.

As shown in FIGS. 35 and 36, a grinding wheel table 220 of the lower grinding wheel feed unit 212 is supported on the lower frame 211 by a so-called V-and-flat-shaped guide 221 so as to be movable in the direction orthogonal to the axis of rotation of the lower grinding wheel 215. A motor 222 for traveling the lower grinding wheel is disposed at the side of the lower frame 211. As a result of rotation of the motor 222, the grinding wheel table 220 horizontally travels by a ball screw 223 threadedly engaged with a ball nut 223*a* fixed in the grinding wheel table 220. A lower spindle guide 224 is supported by a vertical guide 224*a* integrally formed with the grinding wheel table 220 so as to be movable in the direction of rotation axis of the lower grinding wheel 215. A motor 225 for feeding a lower grinding wheel is disposed at the side of the guide 224*a* below the grinding wheel table 220. As a result of rotation of the motor 225, while being guided by the guide 224*a*, the lower spindle guide 224 is raised or lowered through a torque transfer mechanism 226 which is constituted by a worm and a worm wheel and also through a ball screw 227 which is threadedly engaged with an unillustrated ball nut fixed in a bracket 224*b* being secured to the lower spindle guide 224. This feeding stroke is small.

A lower grinding wheel spindle 228 (so called a lower spindle) is rotatably supported within the lower spindle guide 224 (so called a lower housing), and the lower grinding wheel 215 is supported on a grinding wheel holder 229 integrally formed with the upper end of the lower grinding wheel spindle 228.

A grinding wheel drive motor 234 of a built-in type is provided in the lower spindle guide 224, and a stator of the grinding wheel drive motor 234 is fixedly fitted into the lower spindle guide 224. Further, a rotor of the grinding wheel drive motor 234 is fixedly fitted into the lower grinding wheel spindle 228. At the time of a grinding operation, the lower grinding wheel 215 rotates at high speed by rotation of the motor 234 by the lower grinding wheel spindle 228.

As shown in FIG. 36, an upper spindle guide 238 of the upper grinding wheel feed unit 213 is supported by a vertical guide 239 integrally formed with the upper frame 311 so as to be movable in the direction of rotation axis of the lower grinding wheel 216. A hosting/lowering motor 240 is disposed at the side of the upper frame 311. As a result of rotation of the motor 240, the upper spindle guide 238 is raised or lowered by a ball screw 241 which is threadedly engaged with a ball nut 241*a* fixedly fitted into a bracket 238*a* fixed to the upper spindle guide 238.

An upper grinding wheel spindle 242 (so called an upper spindle) is rotatably supported within the upper spindle guide 238 (so called an upper housing), and the upper grinding wheel 216 is supported on a grinding wheel holder 243 integrally formed with the lower end of the upper grinding wheel spindle 242. A grinding wheel drive motor 248 of a built-in type is provided in the upper spindle guide 238, and a stator of the grinding wheel drive motor 248 is fixedly fitted into the upper spindle guide 238. Further, a rotor of the grinding wheel drive motor 248 is fixedly fitted into the upper grinding wheel spindle 242. At the time of a grinding operation, the upper grinding wheel 216 rotates at high speed by rotation of the motor 248 by the upper grinding wheel spindle 242.

Figure 37:
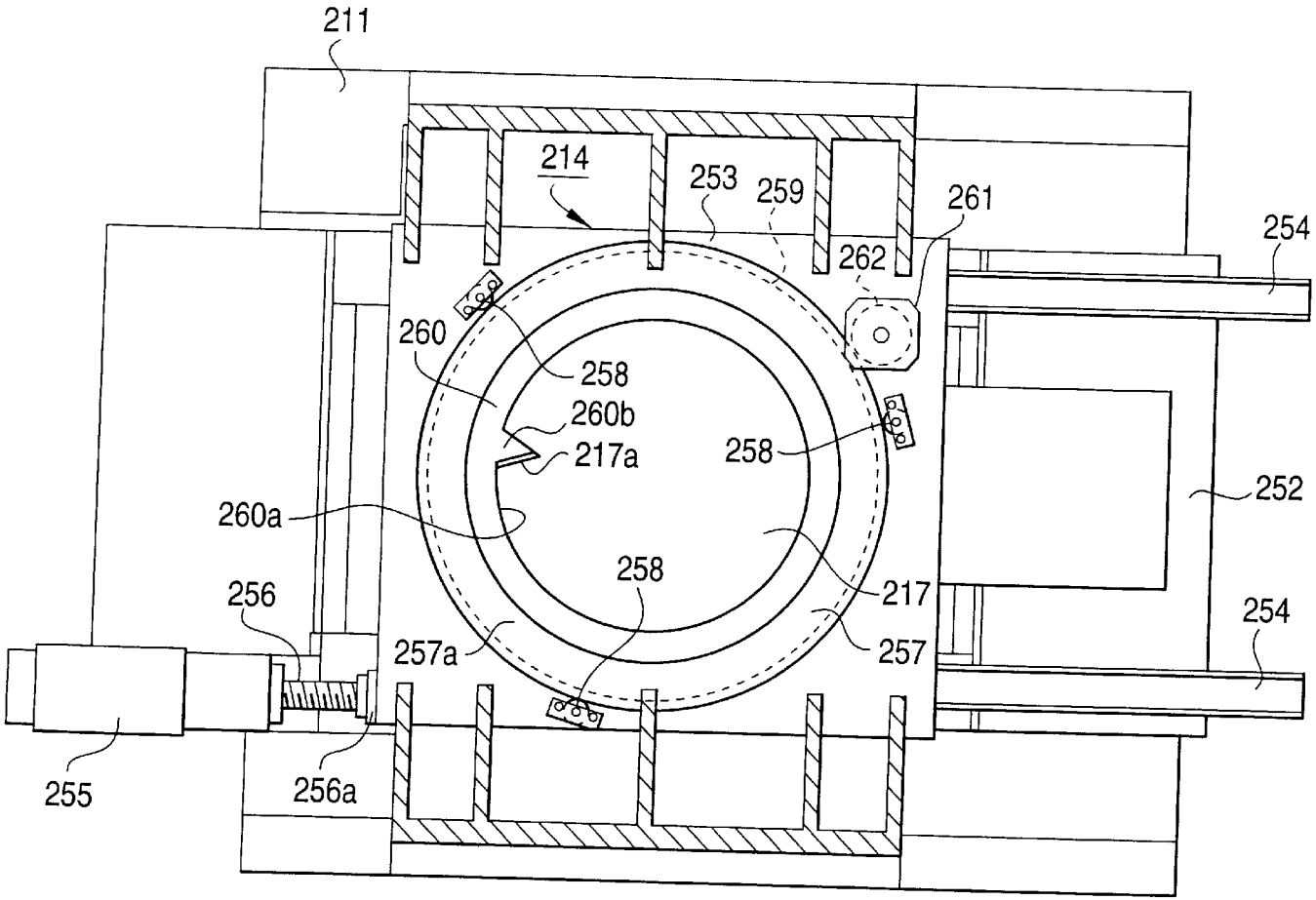
FIG. 37 is a plan view showing a workpiece support member.

As shown in FIGS. 35 and 37, a support table 252 of the workpiece support member 214 is laid on the lower frame 211 between lower and upper grinding wheel feed units 212, 213. A slide table 253 is supported by a pair of guide rails 254 disposed on the support table 252 and on both sides of the lower grinding wheel 215 so as to be movable in the same direction in which the grinding wheel table 220 of the lower grinding wheel rotary feed unit 212 is moved. As shown in FIG. 37, a motor 255 for traveling a slide table is mounted on the support table 252. As a result of rotation-of the motor 255, a ball screw 256 joined to the motor shaft of the motor 255 is threadedly engaged with a ball nut 256*a* set on the slide table 253, enabling movement of the slide table 253.

Figure 38:
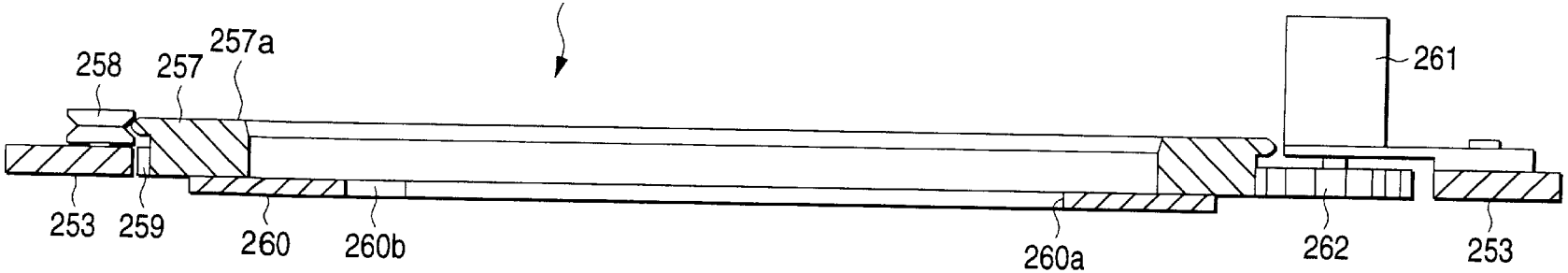
FIG. 38 is a longitudinal cross-sectional view showing a slide table.
Figure 39:
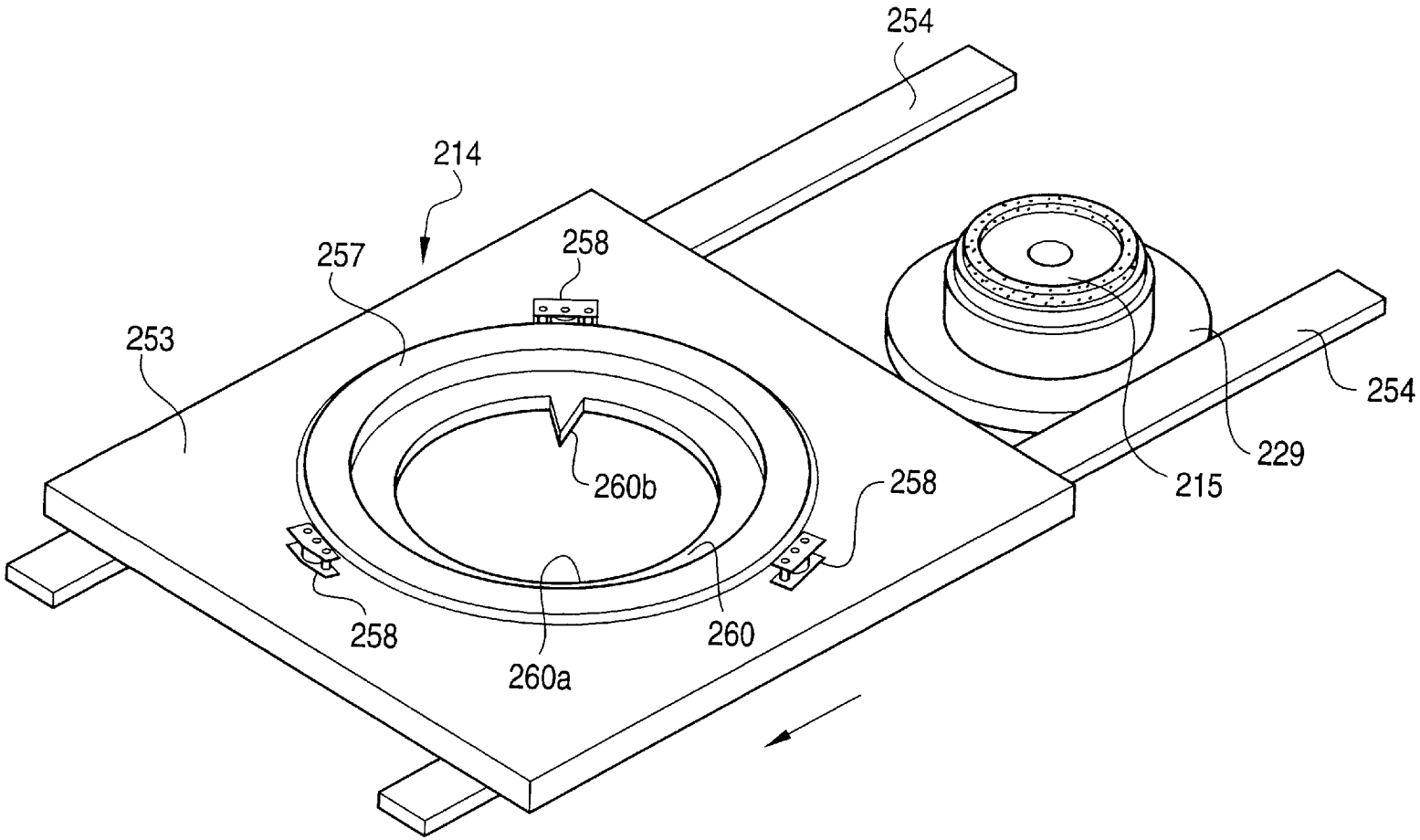
FIG. 39 is a perspective view showing the slide table.

A rotary disk 257 is disposed within the slide table 253 and is rotatably supported by three guide rollers 258 which are also rotatably supported by the slide table 253 (see FIG. 38). A thick-walled peripheral annular frame 257*a* (hereinafter simply referred to as a "peripheral frame") of the rotary disk 257 is equipped with a workpiece support plate 260, and a gear 259 is formed along the lower periphery of the peripheral frame 257*a*. The workpiece support plate 260 is formed thinner than the workpiece 217 and is horizontally extended along the lower surface of the peripheral frame 257*a* by way of an unillustrated tension mechanism so as not to become deformed or warped by gravity (its dead weight). A receiving hole 260*a* is formed at the center of the workpiece support plate 260 for removably receiving and loosely fitting the workpiece 217. The receiving hole 260*a* has a diameter which permits loosely fitting of the workpiece 217 into the hole with a fine clearance. A motor 261 for revolving a rotary disk 257 is disposed on the slide table 253, and a gear 262 which meshes the gear 259 of the rotary disk 257 is secured to the shaft of the motor 261. The rotary disk 257 is rotated by rotation of the motor 261 through the engagement between gears 259 and 262. The inner diameter of the peripheral frame 257*a* is set in such a way that the upper grinding wheel 216 which is lowered in an offset way with respect to the rotary disk 257 can approach to the workpiece support plate 260.

As shown in FIG. 37, a workpiece drive section 260*b* is formed in the receiving hole 260*a* of the workpiece support plate 260 in such a way as to protrude toward the inner radius of the hole for the purpose of engaging a notch 217*a*, such as a notch or orientation flat, used as a reference point for crystal orientation of the workpiece 217 which is an unground wafer sliced off from the ingot. As in the present embodiment, the notch 217*a* of the workpiece 217 has a shape like V-shaped notch or an orientation flat formed by cutting away the outer periphery of the workpiece. Another notch 217*a* for the purpose of driving the workpiece 217 may be provided in a position other than the position where the notch is originally provided for defining crystal orientation of the workpiece 217.

Although the foregoing workpiece receiving hole 260*a* has a circular shape in the present embodiment, the hole may take any shape other than a circular shape, so long as the workpiece 217 is positioned by the hole. For example, the hole may be formed in such a way as to come into contact with at least three trisected segments of outer periphery of the workpiece 217.

The operation of the double disc surface grinder having the foregoing structure will now be described.

In a case where a grinding operation is carried out through use of the double disc surface grinder, the workpiece 217 is inserted into and positioned between the lower and upper grinding wheels 215, 216 of the lower and upper grinding wheel feeding units 212, 213 while being loosely fitted and supported in the workpiece support plate 260 of the workpiece support member 214 with a clearance. In this state, the lower and upper grinding wheels 215, 216 of the lower and upper grinding wheel feed units 212, 213 are rotated at high speed, and the motor 261 is rotated at low speed, thereby rotating the workpiece support plate 260 by the engagement of these gears 262 and 259 which serve as rotational drive means. As a result, the workpiece 217 retained in the receiving hole 260*a* is rotated. The upper grinding wheel 216 of the upper grinding wheel feed unit 213 is lowered close to the workpiece 217. Both surfaces of the workpiece 217 are simultaneously ground by the grinding surfaces 215*a*, 216*a* of the grinding wheels 215, 216.

Figure 40:
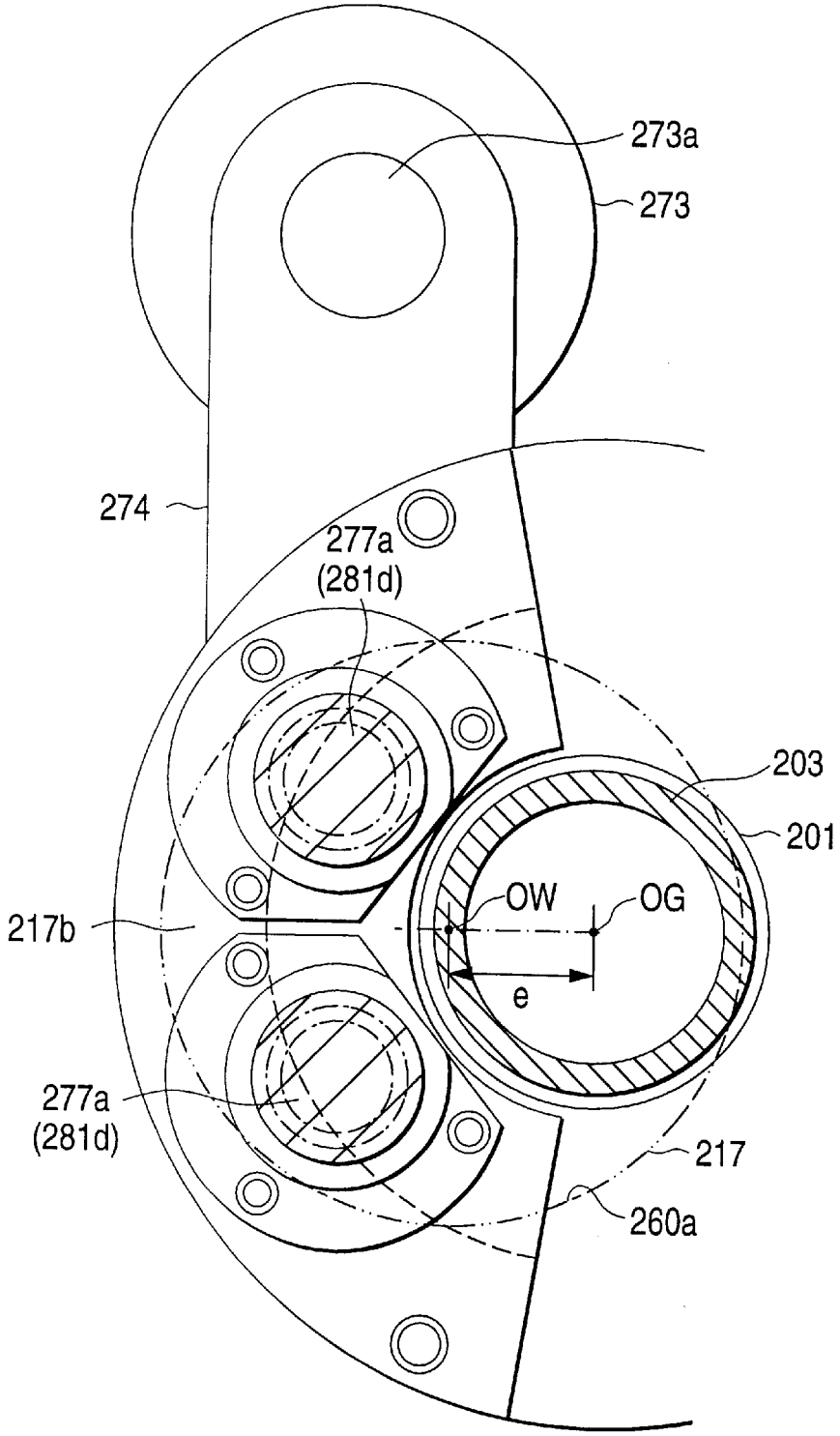
FIG. 40 is a plan view showing the relationship between a cutting tool, a workpiece, and work rests.
Figure 41:
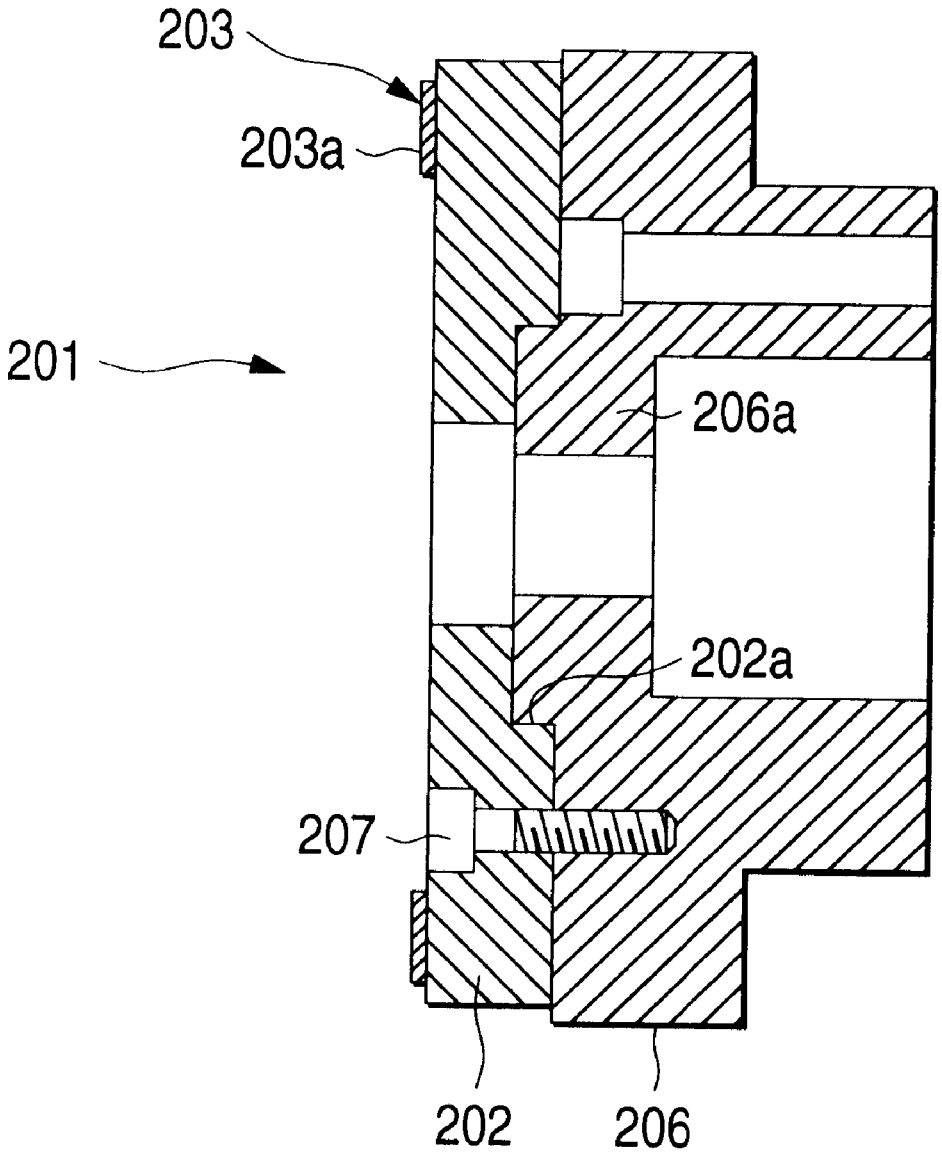
FIG. 41 is a longitudinal cross-sectional view showing the cutting tool shown in FIG. 40.

FIG. 41 is a longitudinal cross-sectional view showing the grinding tool and its center shown in FIG. 40. In the present embodiment, identical reference numerals are assigned to the grinding wheels (or grinding tools) 215, 216, both grinding wheels being collectively represented by reference numeral 201.

The grinding tool 201 comprises a steel disk table 202 and a diamond grinding wheel 203. The diamond grinding wheel is provided on the end face of the disk table 202 in the form of a rotational grinding wheel in such a way as to become slightly smaller in diameter than the disk table 202 and to become concentric with the axis of the grinding wheel. The diamond grinding wheel 203 is formed in a circular pattern of certain width.

The diamond grinding wheel 203 is manufactured by binding together abrasive diamond grains with a binder, and by fastening the thus-formed diamond grains on the disk table 202.

A grinding surface 203*a* of the diamond grinding wheel 203 is in the same plane orthogonal to the axis of the grinding wheel. A cylindrically indented fitting section 202*a* is formed in the reverse side of the disk table 202 and fittingly receives a protruding fitting section 206*a* of a grinding wheel holder 206 having the same diameter as that of the disk table 202 (used in lieu of the foregoing grinding wheel holders 229, 243). While the reverse side of the disk table 202 is being held in close contact with the front side of the grinding wheel holder 206, the disk table and the grinding wheel holder are secured to each other by screwing bolts 207 into the grinding wheel holder 206 through bolt holes formed in the disk table 202.

FIG. 40 shows the dimensional and positional relationship between the diamond grinding wheel 203 and the workpiece 217. When the workpiece 217 is fitted into the receiving hole 260*a*, the center of the receiving hole 260*a* is aligned with the center of the workpiece 217. The center OG of the diamond grinding wheel 203 is offset from the center OW of the workpiece 217 such that the diamond grinding wheel 203 passes through the center OW of the workpiece. Here, an averaged diameter, which extends from a point of bisection of the radial width of the grinding surface 203*a* to another point of bisection of the radial width of the grinding surface 203 by way of the center OG of the diamond grinding wheel is taken as an averaged grinding wheel diameter. In the present embodiment, the averaged grinding wheel diameter corresponds to half the diameter of the workpiece 217. Theoretically, the entire surface of the workpiece 217 can be ground through use of the grinding wheel having the averaged grinding wheel diameter, the averaged grinding wheel diameter ranging from the value determined by subtraction of the radial width of the grinding surface 203*a* from the radius of the workpiece 217 to the value at which the outer diameter of the diamond grind stone 203 equals the radius of the workpiece 217. With a view to preventing the surface of the workpiece from being partially unground in practical cases, it is desirable to set the outer diameter of the grinding wheel so as to become greater than the radius of the workpiece 217.

In contrast, since the upper grinding wheel 216 must enter the inside of the peripheral frame 257*a* of the rotary disk 257, a relationship represented by Dg+Dp<Df should be satisfied, provided that the averaged diameter of the grinding wheel is Dg, the diameter of the grinding wheel holder 206 (or the disk table 202) is Dp, and the internal diameter of the peripheral frame 257*a* is Df. Accordingly, whatever the diameter of grinding wheel Dg is greater than the radius of the workpiece 217, the diamond grinding wheel 203 is capable of grinding the workpiece 217. The peripheral frame 257*a* becomes greater in diameter with an increase in the diameter Dp of the grinding wheel holder 206, resulting in an increase in the amount of offset "e" between the center OW of the workpiece and the center OG of the grinding wheel. Accordingly, if the averaged diameter Dg of the grinding wheel is set to a value which is substantially half the diameter of the workpiece 217, there will be yielded an advantage of rendering apparatus associated with the grinding wheel compact.

As shown in FIGS. 35 and 40, work rests 271, 272 are provided for supporting both sides of a portion of the workpiece 217 projecting from the outer periphery of the area of the workpiece 217 which is in contact with the upper and lower grinding wheels 215, 216. The lower work rest 271 is seated on the lower frame 211 (see FIG. 35) or is supported on an arm 274 which is fixed to the root of an output-shaft 273*a* of the longitudinal shaft of a hydraulic rotary actuator 273 attached to the lower frame 211 (see FIG. 40).

Figure 50:
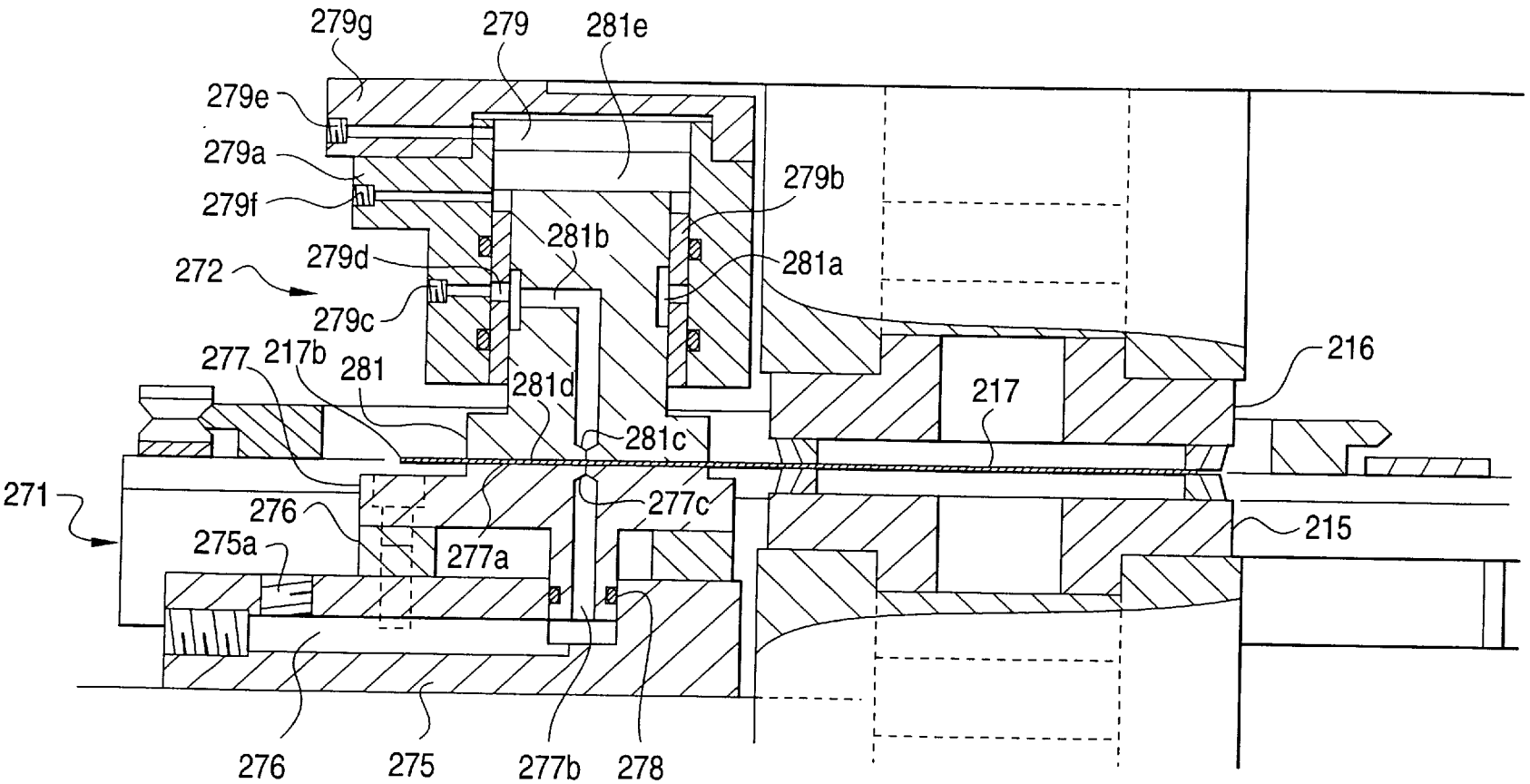
FIG. 50 is a fragmentary enlarged view showing the lower frame shown in FIG. 35.

As shown in FIG. 50 which is a fragmentary enlarged view of the lower frame shown in FIG. 35, a lower hydrostatic slide 277 is provided for the lower work rest 271. The lower hydrostatic slide 277 is provided on the lower frame 211 or a base 275 fixed to the arm 274 through a spacer 276. As shown in FIG. 40, slide surfaces 277*a* of the hydrostatic slide 277 are spaced a small interval apart from each other in such a way as to become symmetric with respect to a line connecting the center OW of the rotary disk with the center OG of the grinding wheel, as well as to become opposite to each other within the plane of a portion of the workpiece 217 projecting from the area where the workpiece 217 is in contact with the grinding tool 201. An unillustrated pocket is formed in each slide surface 277*a* of the lower hydrostatic slide 277, and a channel is provided for supplying a pressurized fluid to the pocket. However, since a hydrostatic film is formed without use of the pocket, the pocket may be omitted. More specifically, a pressurized fluid inlet 275*a* and a fluid channel 275*b* of the base 275, a fluid channel 277*b* of the lower hydrostatic slide 277 fitted into the base 275 by a seal ring 278, and an orifice 277*c* communicating the fluid channel 277*b* with the unillustrated pocket formed in the slide surface 277*a*, are connected together. A pressurized fluid supplied from the pressurized fluid inlet 275*a* flows into the space formed between the slide surface 277*a* of the lower hydrostatic slide 277 and the lower surface of the workpiece 217. The pressurized fluid supplied to the space between the slide surface 277*a* and the lower surface of the workpiece 217 is returned through a reflux port (not shown) formed in the slide surface 277*a* that faces the lower surface of the workpiece 217. Alternatively, the slide may also be formed into a hybrid fluid pressure slide which does not have any ref lux port and utilizes a static or dynamic pressure by causing the pressurized fluid supplied to the space between the workpiece 217 and the slide surface 277*a* to escape outside through the clearance formed between the workpiece 217 and the slide surface 277*a*.

The upper work rest 272 has an upper hydrostatic slide body 281, and a hydrostatic cylinder 279 comprises a cylinder body 279*a*, a cylinder bush 279*b*, and a cylinder closure 279*g*. A piston 281*e* is provided in the fluid pressure cylinder 279 so as to be able to vertically actuate the upper hydrostatic slide body 281. A pressurized fluid is supplied to the upper hydrostatic slide body 281 through a pressurized fluid inlet 279*c* formed in the cylinder body 279*a*, a hole 279*d* of the cylinder bush 279*b*, a groove 281*a* formed in the outer periphery of the upper hydrostatic slide body 281, a fluid channel 281*b* formed in the upper hydrostatic slide body 281, and an orifice 281*c* communicating a pocket formed in a slide surface 281*d* of the upper hydrostatic slide body 281 with the fluid channel 281*b*.

Alternatively, the upper slide may be formed into a hybrid fluid pressure slide.

The upper hydrostatic slide body 281 is controlled by allowing selective outflow of a pressurized fluid from or inflow of the same to the piston 281*e* from the pressurized fluid inlet and outlet 279*e* and 279*f* or by supplying a pressurized fluid to neither the inlet nor outlet. When the upper cylinder chamber is brought into a non-pressure state by permitting inflow of a pressurized fluid to the lower cylinder chamber, the upper hydrostatic slide body 281 is raised. Conversely, when the lower cylinder chamber is brought into a non-pressure state by permitting inflow of a pressurized fluid into the upper cylinder chamber, the upper hydrostatic slide body 281 is lowered. It is desirable to control the speed of actuation of the hydrostatic slide body by bleeding the cylinder chamber remaining in a non-pressure state of the pressurized fluid. If both cylinder chambers are brought into a non-pressure state, the upper hydrostatic slide body 281 attempts to descend under its dead weight.

The work rest 272 provided with the upper hydrostatic slide having the foregoing structure is seated on the upper frame 311 or secured to the upper spindle guide 238. Alternatively, the upper work rest 272 may be vertically moved by an unillustrated feeding apparatus. Still alternatively, the upper work rest 272 may be formed so as to be movable along the workpiece 217 between a position where the work rest supports the surface of the workpiece 217 and a position where the work rest is withdrawn to the outside of the workpiece 217, by an arm analogous to that used for supporting the lower work rest 271.

Gas or a liquid can be conceived as the aforementioned pressurized fluid. For gas, compressed air may be used. In contrast, for a fluid, oil or a coolant may-be used.

The operation of the double disc surface grinder having the foregoing structure will now be described. The slide surface 277*a* of the lower hydrostatic slide 277 is situated in a position where it supports the lower surface of the workpiece 217, and the upper hydrostatic slide body 281 is withdrawn from a position where it retains the upper surface of the workpiece 217. The withdrawn position must be ensured at least in a position where the upper hydrostatic slide body 281 is in an elevated position relative to the cylinder 279. As mentioned previously, in a case where the upper hydrostatic slide body 281 is in an elevated position together with the upper spindle guide 238, the upper spindle guide 238 is lowered to thereby lower the upper grinding wheel 216. Subsequently, the upper hydrostatic slide body 281 is moved to a lowered position relative to the cylinder 279. While the grinding wheel 216 is retained in an elevated position, the center OW of the workpiece receiving hole 260*a* is positioned so as to become offset from the center OG of the grinding tool 201 by value "e" by movement of the slide table 253. The offset value "e" corresponds to the averaged radius of the diamond grinding wheel 215, 216. In this case, there is a need for necessarily positioning the center OW of the workpiece on the diamond grinding wheel 215, 216. The lower grinding wheel 215 is raised close to the lower surface of the workpiece support plate 260, and the notch 217*a* of the workpiece 217 is engaged with the workpiece drive section 260*b* protruding into the workpiece receiving hole 260*a*, whereby the workpiece 217 is fitted into the workpiece receiving hole 260*a* and is positioned on the lower grinding wheel 215. As a result, both surfaces of the workpiece 217 protrude, respectively, from the upper and lower surfaces of the workpiece support plate 260. Next, the upper grinding wheel 216 is lowered close to the workpiece 217. The slide surface 281*d* of the upper hydrostatic slide body 281 is moved toward the upper surface of the workpiece 217 from the withdrawn position. At this time, the slide surface 281*d* is positioned above the upper surface of the workpiece 217 before the upper hydrostatic slide body 281 is lowered to the lowermost position with respect to the cylinder 279.

A pressurized fluid is supplied to each of the upper and lower hydrostatic slides of the upper and lower work rests 271, 272, retaining a portion 217*b* of the workpiece 217 projecting from the area where the both surfaces of the workpiece are opposite to the grinding wheels 215, 216. The workpiece 217 is retained by positioning the lower surface of the workpiece 217 relative to the slide surface 277*a* of the lower hydrostatic slide 277, and by placing the upper hydrostatic slide 281 in a position above the upper surface of the workpiece 217. In this case, pressure is applied to the workpiece so as to produce a desirable hydrostatic fluid film between the slide surface 281*d* of the upper hydrostatic slide body 281 and the surface of the workpiece 217 by only the dead weight of the upper hydrostatic slide 281 or by the cylinder 279. Either gas or a fluid can be used as a medium for the purpose of pressurizing the cylinder 279.

The grinding wheel drive motors 234, 248 and the motor 261 for driving a workpiece are energized, rotating the grinding wheels 215, 216 and the workpiece 217. When the upper grinding wheel 216 is lowered to come into contact with the workpiece 217, the diamond grinding wheels 216, 217 grind both surfaces of the workpiece 217. During the grinding operation, other than the area of the workpiece 217 (i.e., a circular-arch area passing through the center of the workpiece 217) which is ground by the grinding surface 215*a*, 216*a* of the diamond grinding wheel 215, 216, both sides in the vicinity of the outer periphery of the workpiece 217 are supported by the work rests 271, 272.

After grinding of the workpiece 217, the upper grinding wheel 216 and the upper hydrostatic slide body 281 are raised to thereby lift an area 217*b* of the workpiece 217 projecting to the outside of the outer periphery of the lower grinding wheel 215 (see FIG. 40), removing the workpiece 217 from the receiving hole 260*a*. There is achieved a balance between the dead weight of the upper hydrostatic slide body 281 or the pressure exerted by the cylinder 279 and the load capacity of the hydrostatic fluid film formed between the hydrostatic slide surface 281*d* and the workpiece 217, the surface grinder can cope with its thermal deformation. Accordingly, the workpiece 217 can be accurately retained at all times.

While being rotated at a rate of 10 r.p.m., the workpiece 217, a wafer having a diameter of 200 mm, was ground by rotation of the diamond grinding wheel 215, 216 having an outer diameter of 160 mm and an inner diameter of 130 mm together with the upper and lower grinding wheels 215, 216 at the same speed and in the same direction, i.e., at the speed ranging from 2,000 to 3,000 r.p.m. The workpiece was ground in two minutes, and the total thickness variation (TTV) of the workpiece was 0.3 $\mu$m.

Although both surfaces of the workpiece 217 are retained by the upper and lower work rests 271, 272 in the foregoing description, only one of the surfaces of the workpiece 217 may be retained by means of a work rest. Accordingly, in a case where only one surface of the workpiece 217 is retained through use of a work rest, the double disc surface grinder is provided with either the upper work rest 271 or the lower work rest 272.

(13th Embodiment)

Figure 42:
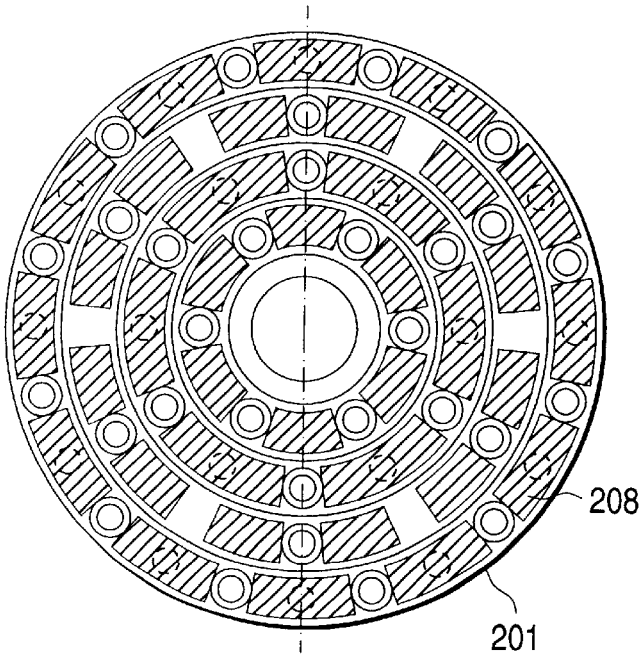
FIG. 42 is a front view showing another example of the cutting tool as a thirteenth embodiment of the present invention.
Figure 43:
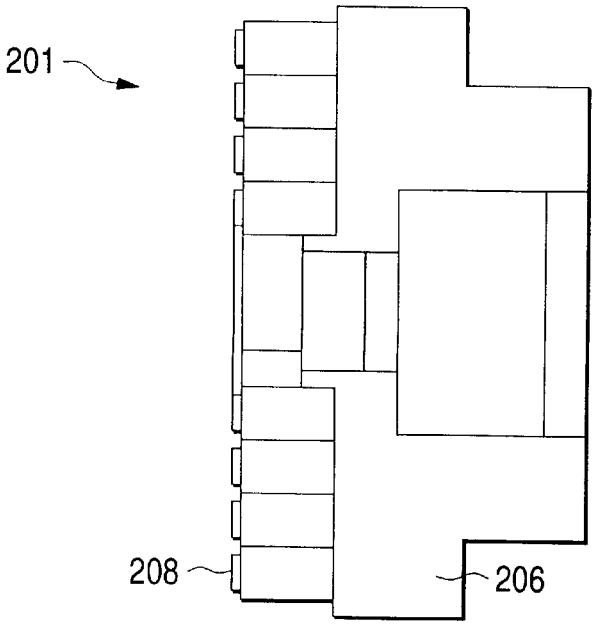
FIG. 43 is a longitudinal cross-sectional view showing the cutting tool shown in FIG. 42.

FIGS. 42 and 43 show an example of the grinding tool 201 which uses a diamond impregnated grinding wheel. A plurality of diamond impregnated grinding wheel 208 are circularly arranged so as to become spaced given intervals apart from each other, thereby forming a segmented circular pattern. Such a circular pattern is arranged in a plurality of concentric rows on the surface of the disk table 202 in such a way that the interval between the grinding wheels in one circular pattern is offset from that in the adjacent circular pattern in the radial direction of the disk table 202. The grinding tool grinds the overall workpiece 217 while the grinding tool 201 is held in a position where the outer periphery of the grinding tool passes through the center of the workpiece 217. The diameter of the grinding wheel is set so as to become slightly greater than half the diameter of the workpiece 217, as well as the case of a cup-shaped grinding wheel.

(14th Embodiment)

If the principle objective is to finish a single surface of the workpiece 217, the workpiece 217 may be ground through use of the foregoing double disc surface grinder while the lower grinding wheel 215 is stationary or is slowly. rotated, or the workpiece 217 may be ground while the lower grinding wheel 215 is replaced with a member which slightly grinds or does not grind the workpiece 217.

(15th Embodiment)

Figure 44:
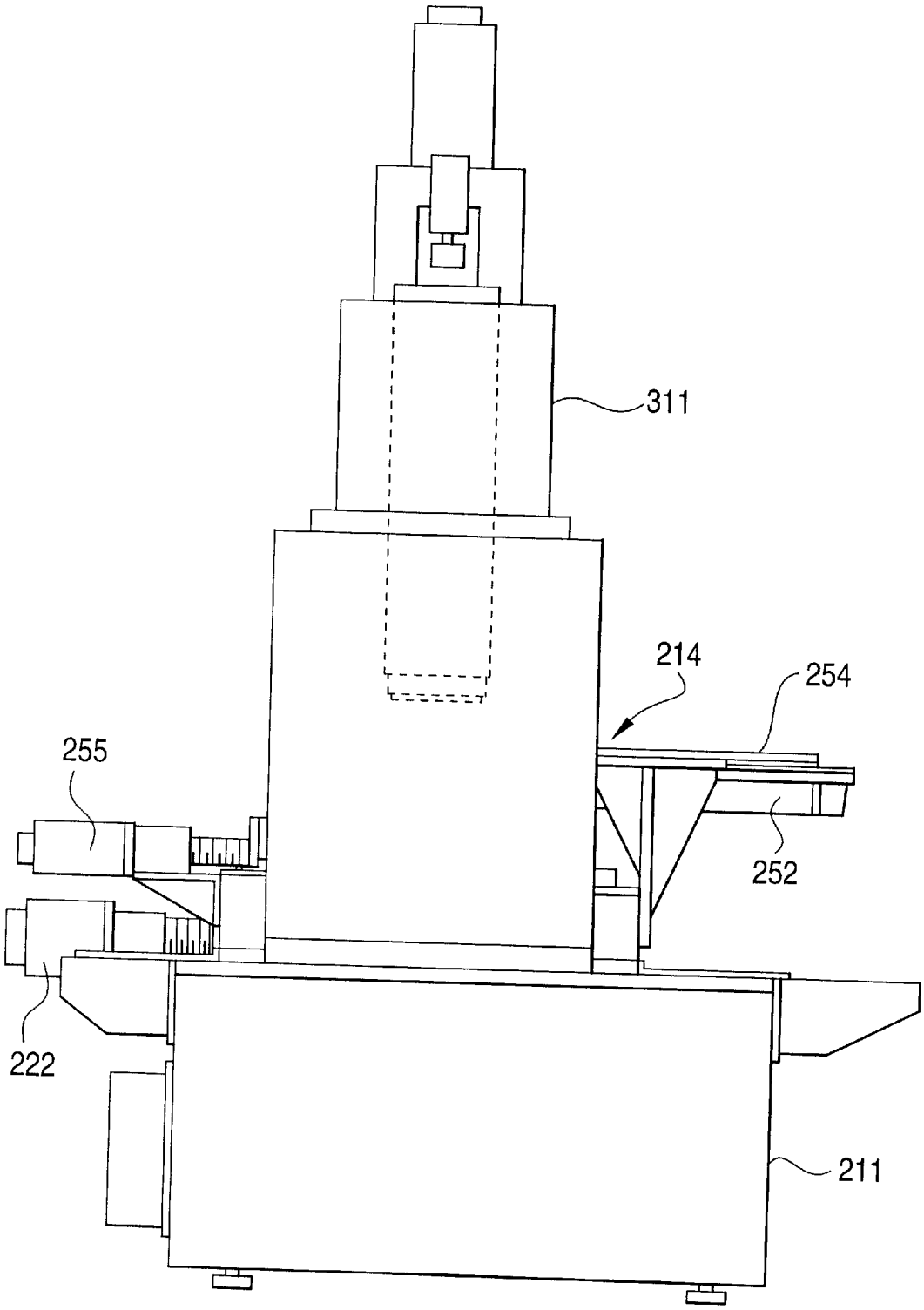
FIG. 44 is front view showing a single disc surface grinder according to a fifteenth embodiment of the present invention.
Figure 47:
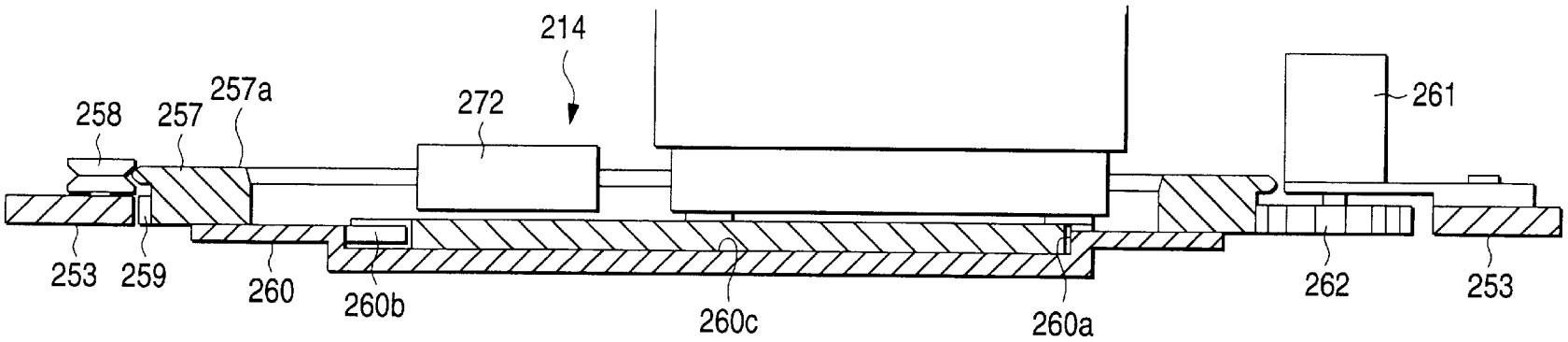
FIG. 47 is a longitudinal cross-sectional view showing the workpiece support member.
Figure 48:
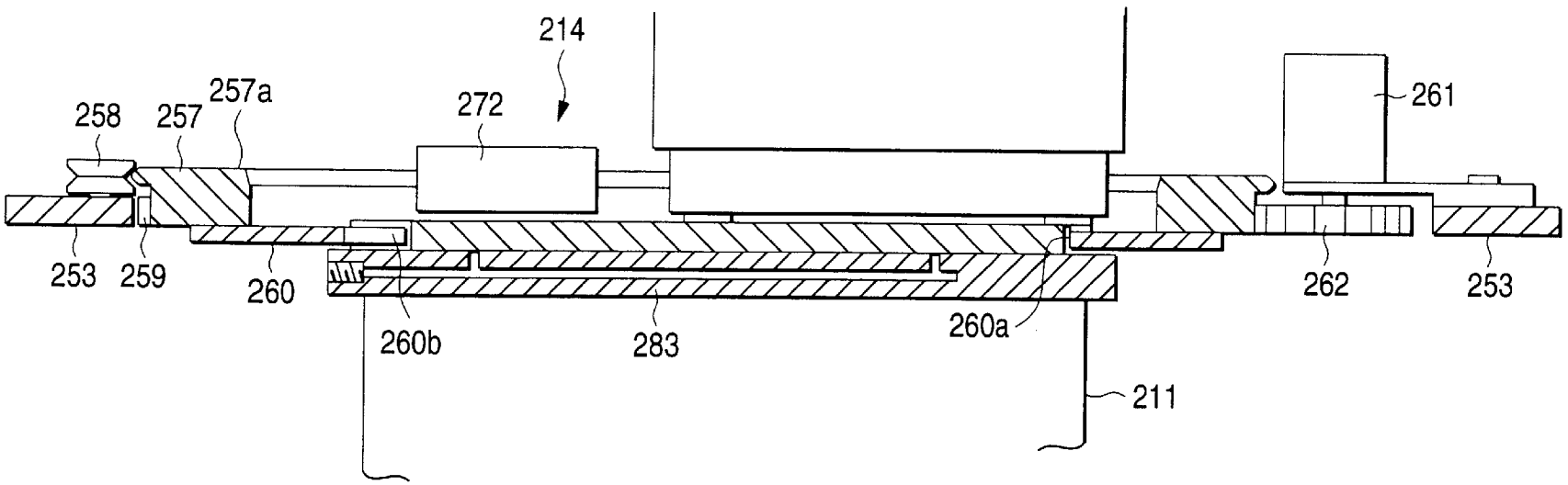
FIG. 48 is a longitudinal cross-sectional view showing the workpiece support member.

A single surface of the workpiece 217 may be finished through use of a single disc surface grinder having a grinding wheel whose end face is formed into a grinding surface. FIG. 44 shows such a single disc surface grinder, and the lower frame 211 of the surface grinder does not have any members associated with a lower grinding wheel feed unit. Only guide rails 252 and the workpiece support member 214 are provided on the lower frame 211. In this case, as shown in FIG. 48, the upper hydrostatic slide body 283 is provided above the upper surface of the lower frame 211, and the foregoing workpiece support plate 260 may be positioned in the vicinity of the upper surface. As shown in FIG. 47, the workpiece receiving hole 260*a* may be provided with a bottom 260*c* so as to be a recess for receiving the workpiece. In the case shown in FIG. 47, as a matter of course, the depth of the workpiece receiving hole 260*a* is set so as to become smaller than the thickness of the workpiece 217.

The hydrostatic slide 283 is provided concentrically with the workpiece 217. Accordingly, the entirety of one surface of the workpiece 217 is supported in a given position, and there is not any physical contact between a solid and the workpiece 217. Therefore, the surface of the workpiece 217 opposite to the surface to be machined is prevented from being damaged. Further, as shown in FIG. 48, a superior degree of flatness is ensured over the entire surface of the hydrostatic slide 283 for supporting the workpiece 217, and the hydrostatic slide 283 merely supports the workpiece 217. Consequently, the surface grinder does not cause any drop in the accuracy of geometry of a workpiece which would otherwise be caused by restoration of the original shape of the workpiece after grinding of the workpiece, such as that occurring when a workpiece is held by a vacuum chuck.

The hydrostatic slide 283 is opposite to the upper grinding wheel 216 in part while the workpiece 217 is interposed between them, and the other part of the hydrostatic slide 283 is opposite to the upper work rest 272. Accordingly, substantially the entire surface of the workpiece 217 receives pressure from the hydrostatic slide 283 and the upper grinding wheel 216. Therefore, the workpiece 217 is prevented from being warped.

In a case where the receiving hole 260*a* of the rotary disk 257 is provided with the bottom 260*c*, the bottom surface of the workpiece 217 can be readily supported. Even in this case, the workpiece 217 receives pressure from the upper hydrostatic slide body 272 and the upper grinding wheel 216, and hence the workpiece 217 is prevented from being warped. The lower surface of the workpiece 217 may be supported by a member (e.g., a hydrostatic bearing) which is concentric with and is the same in diameter as the upper grinding wheel 216. The work rests 271, 272 may be used for supporting the part of the workpiece 217 projecting from the area of the workpiece sandwiched between the upper grinding wheel 216 and the member that is concentric with and is the same in diameter as the upper grinding wheel 216.

(16th Embodiment)

Figure 45:
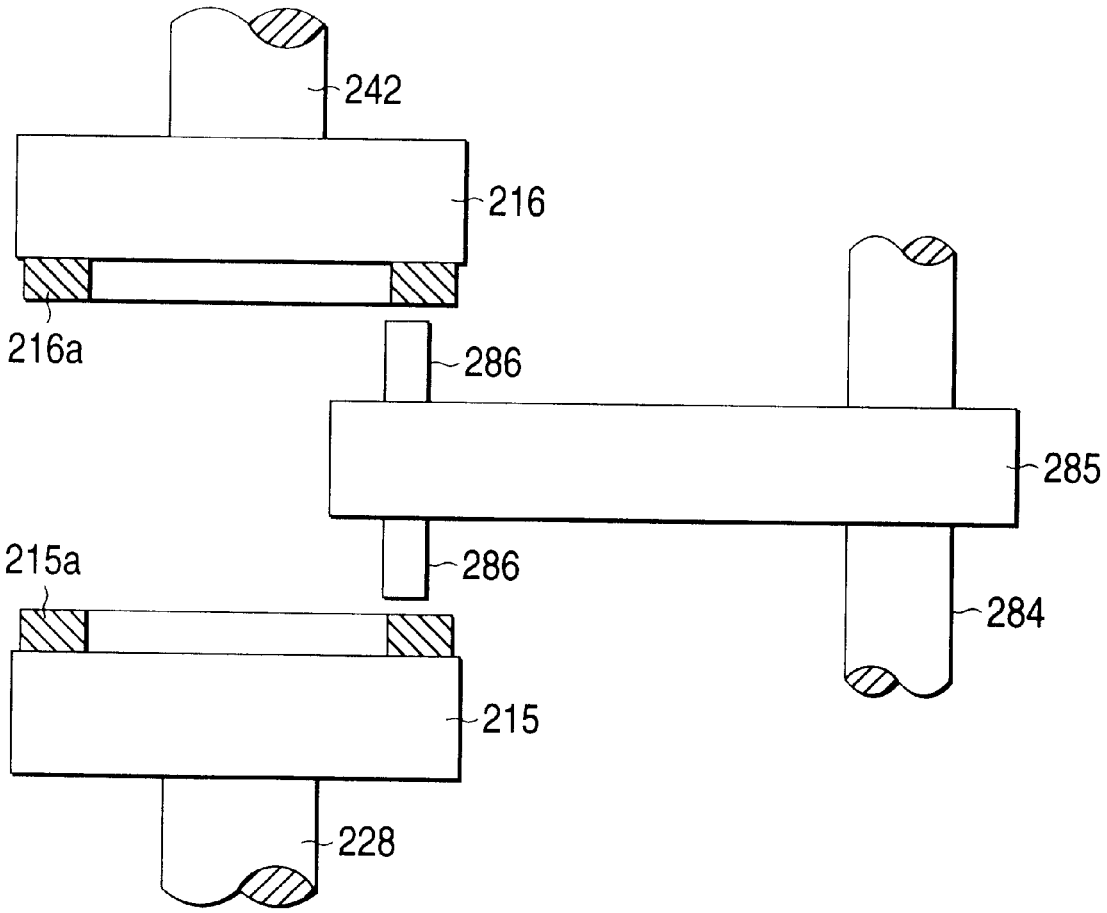
FIG. 45 is a plan view schematically representing a method of detecting abrasion of a grinding wheel.
Figure 46:
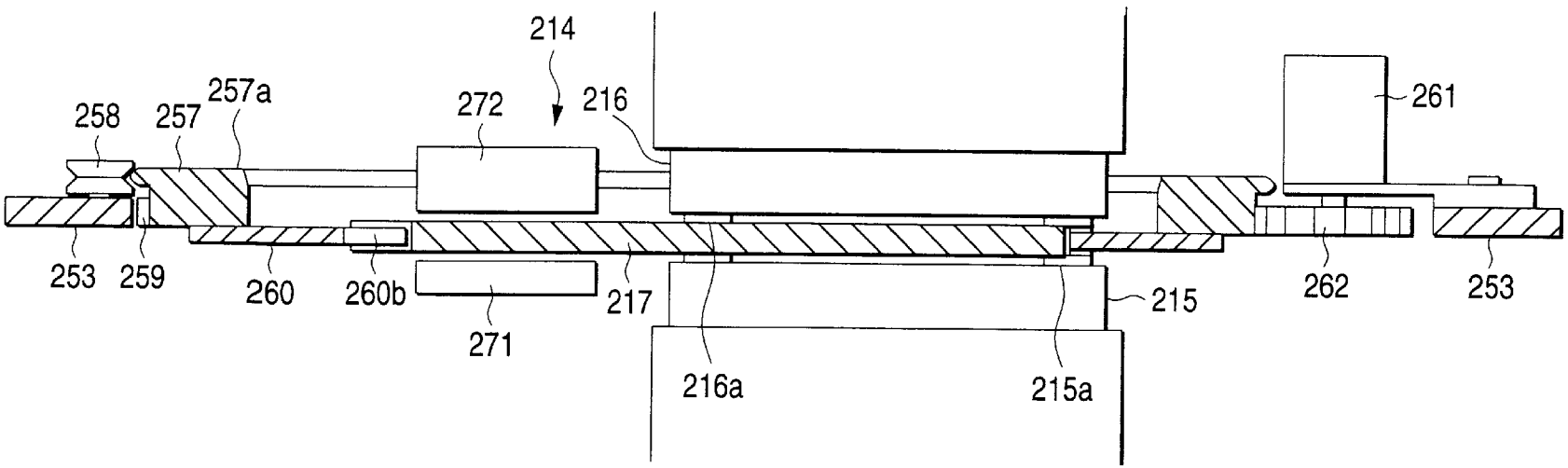
FIG. 46 is a longitudinal cross-sectional view showing the workpiece support member.

FIG. 45 shows a 16th embodiment of the present invention. The upper and lower grinding wheels 215, 216 are abraded through a grinding operation. When the upper and lower grinding wheels 215, 26 are abraded to a preset extent, the grinding wheel must be correspondingly actuated (or forwardly moved) close to the workpiece with a view to maintaining a given thickness of the workpiece 217.

In the drawing, a pivot 284 in parallel to the grinding wheel spindles 228, 242 is connected to and supported by a rotational drive source. The root of an arm 285 is fixedly connected to the pivot 284. Position sensors 286 attached to the tip end of the arm 285 come into contact with or close to the respective upper and lower grinding wheels 215, 216, thereby enabling detection of positions of the grinding surfaces 215*a*, 216*a* of the grinding wheels 215, 216.

As shown in FIG. 45, the upper grinding wheel 215 is primarily raised, and the grinding surfaces 215*a*, 216*a* of the unabraded grinding wheels 215, 216 come into contact with or close to the position sensors 286. A positioning date. according to the positions detected by the position sensors 286 are stored in an unillustrated memory device. The arm 285 is pivoted to thereby withdraw the positions sensors 286 from the grinding wheels 215, 216. After the workpiece 217 has been ground, the grinding wheels 215, 216 are withdrawn to positions such as those shown in FIG. 45. The positions of the grinding surfaces 215*a*, 216*a* are detected in a manner analogous to that mentioned previously. At the time of detection of such positions, the extent to which the grinding wheels 215, 216 are abraded is determined by means of encoders attached to the motors 225, 240. The grinding surfaces 215*a*, 216*a* of the abraded grinding wheels 215, 216 are moved by means of a controller, so that the workpiece 217 is finished to a given thickness. An air micrometer, a differential transformer, is used for the position sensor 286.

(17th Embodiment)

Figure 49:
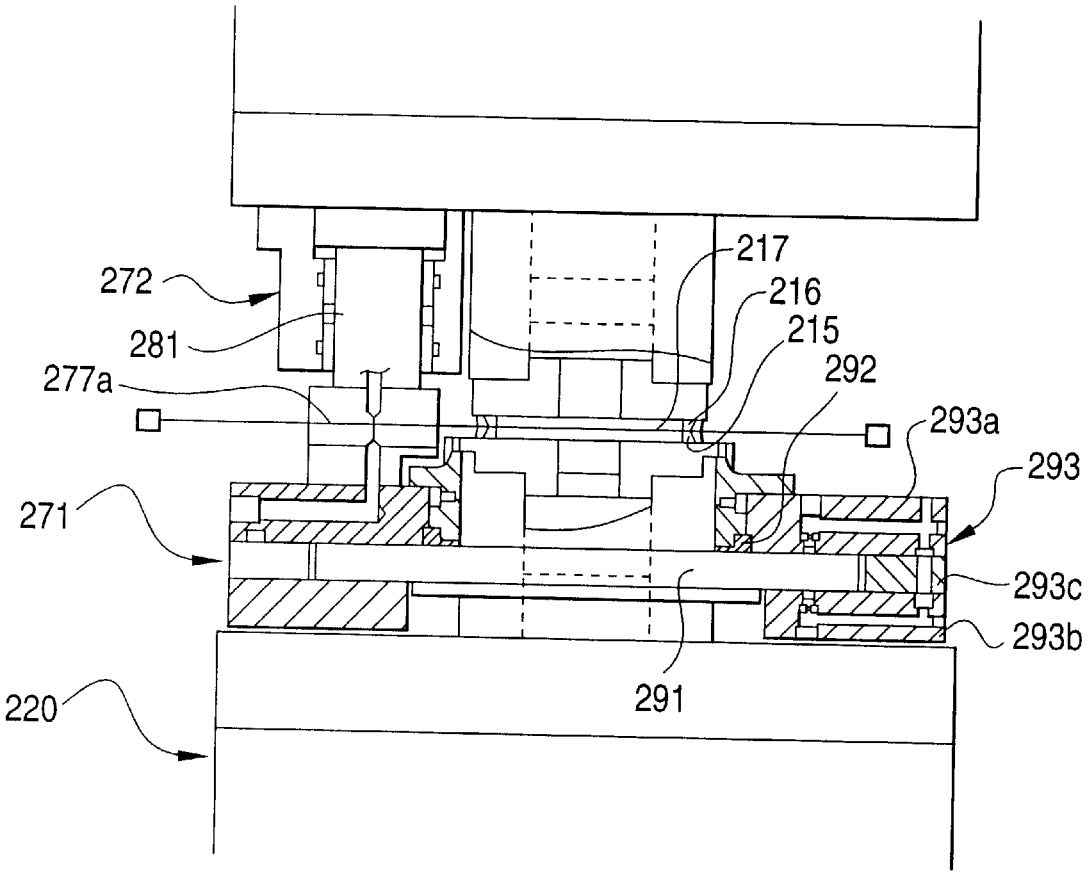
FIG. 49 is a longitudinal cross-sectional view showing a mobile member of the work rest according to a seventeenth embodiment of the present invention.

FIG. 49 shows a 17th embodiment of the present invention. The 17th embodiment is characterized by supporting of the workpiece 217 by means of the lower work rest 271. In other respects, the 17th embodiment is the same in structure as the 12th embodiment.

A disk 291 which is concentric with the grinding wheel spindle 228 is mounted on the lower grinding wheel table 220. A radial bearing 292 is fixed to the disk 291 in a concentric manner. A hydrostatic slide 293 is provided so as to hold both surfaces of the outer periphery of the disk 291. The upper and. lower surfaces of the disk 291 support the hydrostatic slide 293. An annular upper slide 293*a* and an annular lower slide 293*b* of the hydrostatic slide 293 are secured to each other by a spacer 293*c* interposed between them. The upper slide 293*a* is rotatively fitted to the radial bearing 292.

The hydrostatic slide 293 is an annular table, and the lower hydrostatic slid, or the lower work rest 71, is formed on the upper slide 293*a* of the annular table. Part of the channel through which a pressurized fluid is supplied to the lower hydrostatic slide is formed in the upper slide 293*a*. Although the hydrostatic slide 293 is pivoted by an unillustrated drive unit, the slide is pivoted through the angle ranging from 0 to 90°. A pressurized fluid is supplied to the hydrostatic slide 293 through use of an unillustrated flexible tube.

In the state shown in FIG. 49, the upper and lower work rests 271, 272 are opposite to each other, and the workpiece 217 is ground by means of the grinding wheels 215, 216 while being retained by the work rests. When the workpiece 217 is removed from or attached to the surface grinder from above, the hydrostatic slide 293 is pivoted through 90° from the position shown in FIG. 49. As a result, the area that has been occupied by the lower work rest 271 positioned below the workpiece 217 becomes available. Consequently, the workpiece 217 is readily removed from or attached to the surface grinder by raising the upper hydrostatic slide body 281. According to the present embodiment, the lower work rest 271 follows the vertical movement of the lower grinding wheel table 220 by the disk 291 and the hydrostatic slide 293. The slide surface 277*a* of the lower work rest 271 for supporting the workpiece 217 is in a position where the workpiece 217 being currently ground can be constantly maintained in a horizontal position. Further, the thermal deformation or vibration components of the workpiece can be absorbed, enabling holding of the workpiece in a stable position.

(18th Embodiment)

Figure 51:
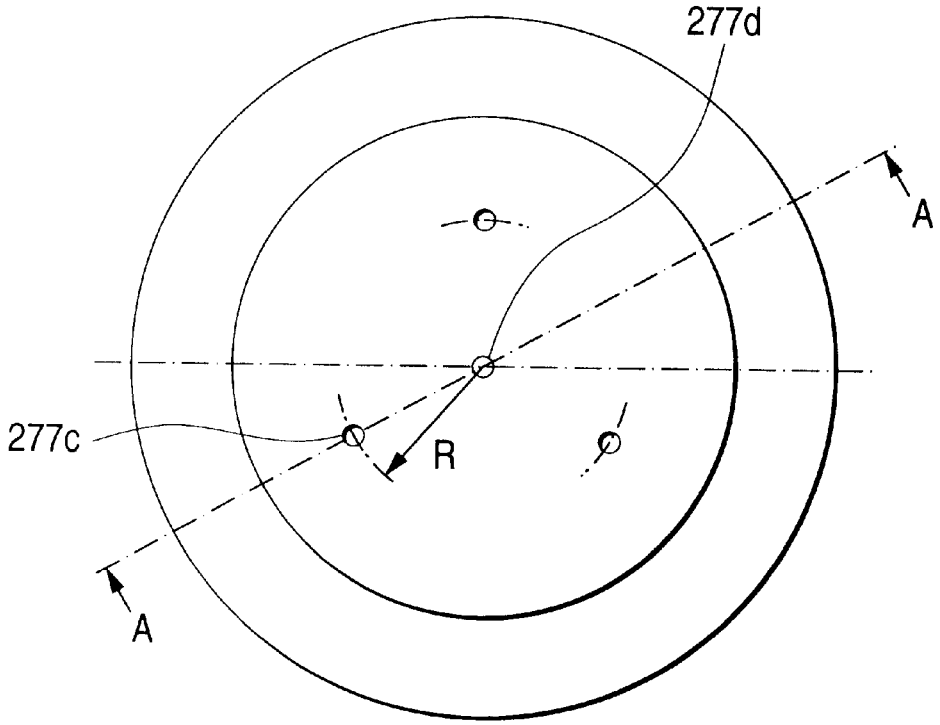
FIG. 51 is a plan view showing a hydrostatic slide according to an eighteenth embodiment of the present invention.
Figure 52:
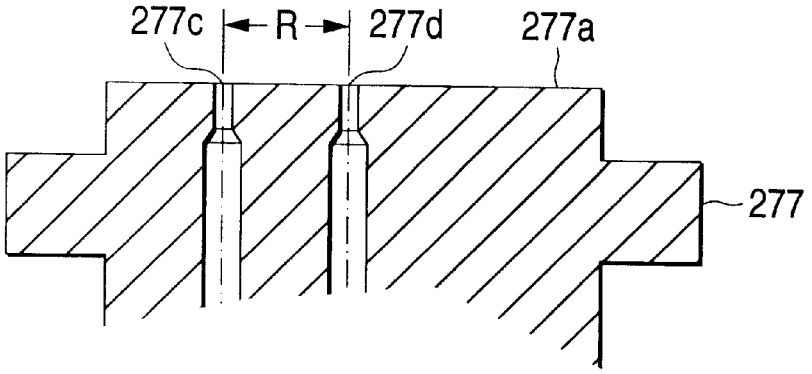
FIG. 52 is a cross-sectional view taken across line A—A shown in FIG. 51.
Figure 53:
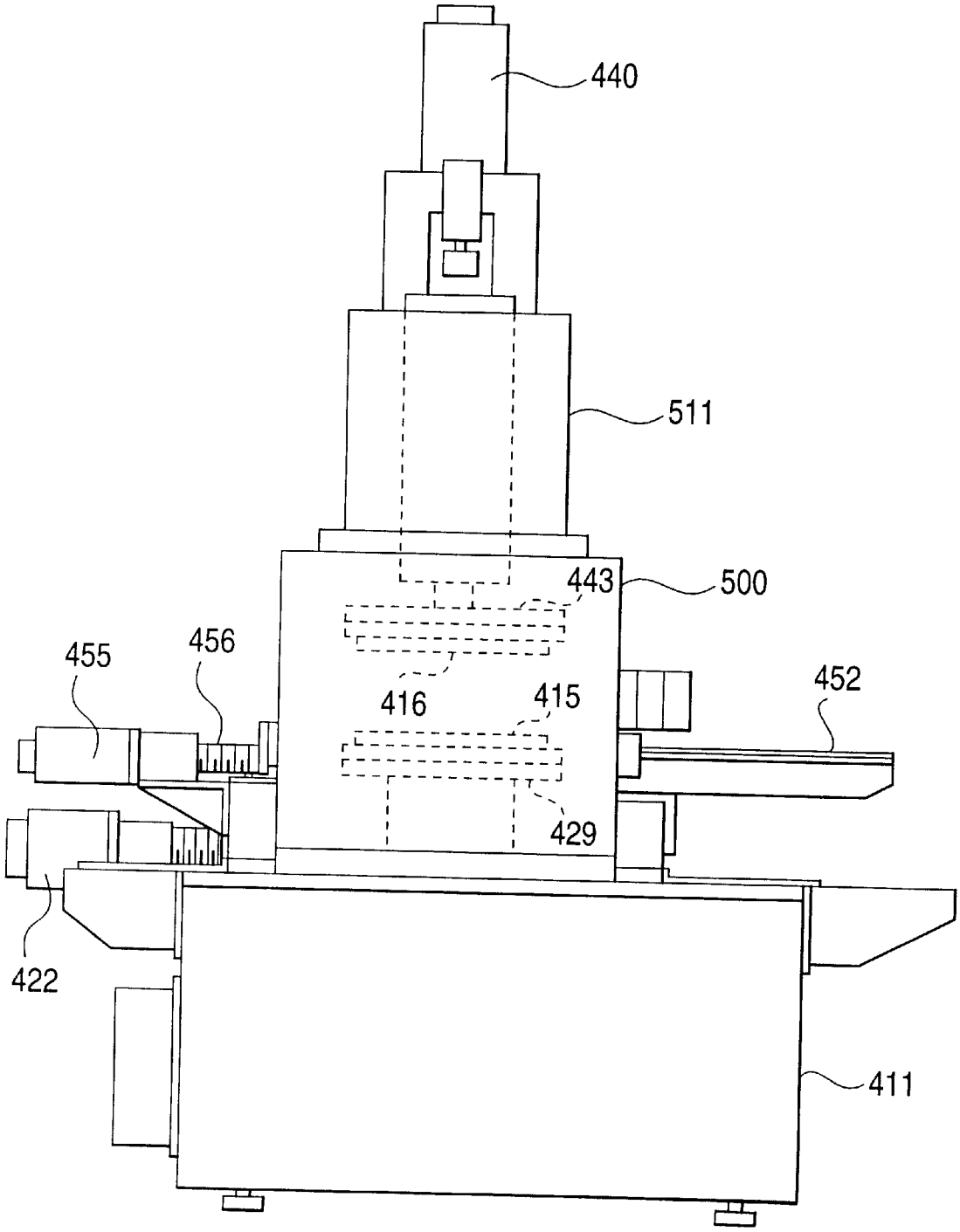
FIG. 53 is a front view showing a double disc surface grinder according to a nineteenth embodiment of the present invention.

FIGS. 51 and 52 show the slide surface of the hydrostatic slide used for the 18th embodiment. In the present embodiment, the workpiece 217 is supported by use of only the lower work rest 271 without use of the upper work rest 272.

As mentioned previously, one surface of the portion 217*b* of the workpiece 217 projecting from the grinding wheels is supported by means of two hydrostatic bearings, as in the previous embodiments.

In the drawings, the lower hydrostatic slide 277 has the circular slide surface 277*a*, as in the previous embodiments. An orifice 277*d* for the purpose of sucking is formed in the center of the slide surface 277*a*, and an orifice 277*c* for the purpose of discharging is formed in one of trisected segments centered at the orifice 277*d*.

The pressurized fluid discharged from the orifice 277*c* enters the space between the lower surface of the workpiece 217 and the slide surface 277*a*, forming a hydrostatic layer.

In the hydrostatic layer, the pressurized fluid flows toward the orifice 277*d*. The negative pressure formed by the orifice 277*d* and the diameter of the orifice 277*d* are set so as to reduce the thickness of the hydrostatic layer.

With the foregoing configuration, the workpiece 217 is held in a floating condition at the position where there is achieved a balance between the workpiece 217 and the load capacity of the hydrostatic layer. The periphery of the workpiece 217 is floated by means of the orifice 277*c* which discharges a pressurized fluid, and the center of the same is sucked by the orifice 277*d* for sucking purpose. A balance between the workpiece 217 and the slide surface 277*a* is achieved, thereby resulting in a minute clearance between them. Accordingly, the holding rigidity of the workpiece 217 to be supported can be improved.

According to the present embodiment, since the extent which the sucking force of the orifice 277*d* is exerted on the workpiece 217 is small, the workpiece 217 can be rigidly retained without inducing deformation.

According to the present embodiment, a grinding wheel whose diameter is substantially half the diameter of a workpiece is positioned in such a way that a grinding surface of the grinding wheel passes through the center of rotation of the workpiece as well as along the outer periphery of the same. The peripheral frame 257*a* of the rotary disk 257 which supports and rotates the workpiece has a small inner diameter, rendering the rotary disk 257 compact. As a result, the workpiece support member 214 becomes compact.

According to the present embodiment, the area of the workpiece projecting from the grinding surface of the grinding wheel is retained by the work rest. In a case where a grinding wheel whose diameter is substantially half that of the foregoing workpiece is used, the problem relating to how to retain the area of the workpiece projecting from the grinding wheel is solved.

According to the present embodiment, as mentioned previously, a workpiece support plate is thinner than a wafer and has a workpiece receiving hole, and a workpiece drive section projects from the brim of the receiving hole toward a notch which is formed in a wafer for the purpose of orienting the wafer relative to crystal orientation. While the workpiece support plate is rotated, upper and lower surfaces of the wafer are simultaneously ground by bringing grinding wheels to the respective upper and lower surfaces. As a result, there are advantages of the wafer being imparted with torque without fail, as well as of the overall surfaces of the wafer being uniformly ground. Further, there are advantages of both surfaces of the wafer being simultaneously ground, as well as of being able to achieve superior surface roughness in a short time. In a case where a wafer is held by a vacuum chuck, the wafer is pulled and held in a plane state by means of a suction portion of the vacuum chuck. If a wafer having inferior accuracy of geometry is ground in such a state, the wafer will restore its original shape by means of elasticity after having been removed from the vacuum chuck, resulting in a deterioration in the accuracy of geometry of the wafer. In contrast, according to the present embodiment, since the workpiece is not held in a plane state when being supported, superior accuracy of geometry can be achieved.

As mentioned previously, even in the case of a single surface grinding operation, the wafer is loosely fitted and supported within the workpiece receiving hole of the workpiece support plate, and the drive section is engaged with the notch formed for the purpose of orienting the wafer relative to crystal orientation. In such a state, since the wafer is forcibly imparted with torque, both superior surface roughness and accuracy of geometry are achieved.

Although the foregoing explanation has described the cases where the vertical double disc surface grinder or the vertical single disc surface grinder is used as the surface grinder, a horizontal double disc surface grinder or a horizontal single disc surface grinder may be used in place of them.

According to a surface grinder and a grinding method in accordance with the present invention, the area of a workpiece projecting from a grinding wheel is regulated by means of work rests in terms of position. As a result, even in a case where the diameter of the grinding wheel is set to substantially half the diameter of the workpiece, the workpiece can be stably ground. Further, the support member of the workpiece can be made compact.

In a case where the work rest is formed from a hydrostatic slide, damage to the workpiece which would be otherwise caused by the work rests is prevented. Further, since the hydrostatic slide has a damping action, a stable grinding operation is conducted.

(19th embodiment)

19th embodiment of the present invention, in which the invention is embodied in the form of a double disc surface grinder, will be described in detail by reference to the accompanying drawings.

As shown in FIGS. 53 through 56, a double disc surface grinder comprises a lower frame 411 and an intermediate frame 500 seated on the lower frame 411, and an upper frame 511 is mounted on the lower frame 411. The lower frame 411 comprises a lower grinding wheel feed unit 412 and a workpiece supporting members 414, and the upper frame 511 comprises an upper grinding wheel feed unit 413. The lower grinding wheel feed unit 412 has a lower grinding wheel 415, and the upper grinding wheel feed unit 413 has an upper grinding wheel 416. A grinding surface 415*a* provided at the upper end of the lower grinding wheel 415 and a grinding surface 416*a* provided at the lower end of the upper grinding wheel 416 are positioned so as to become opposite to and in parallel with each other. While being supported on the workpiece supporting members 414, a workpiece 417 is inserted between the grinding wheels 415, 416 of the grinding wheel feed units 412, 413. Both surfaces of the workpiece 417 are simultaneously ground by the grinding surfaces 415*a*, 416*a* of the grinding-wheels 415, 416.

Figure 54:
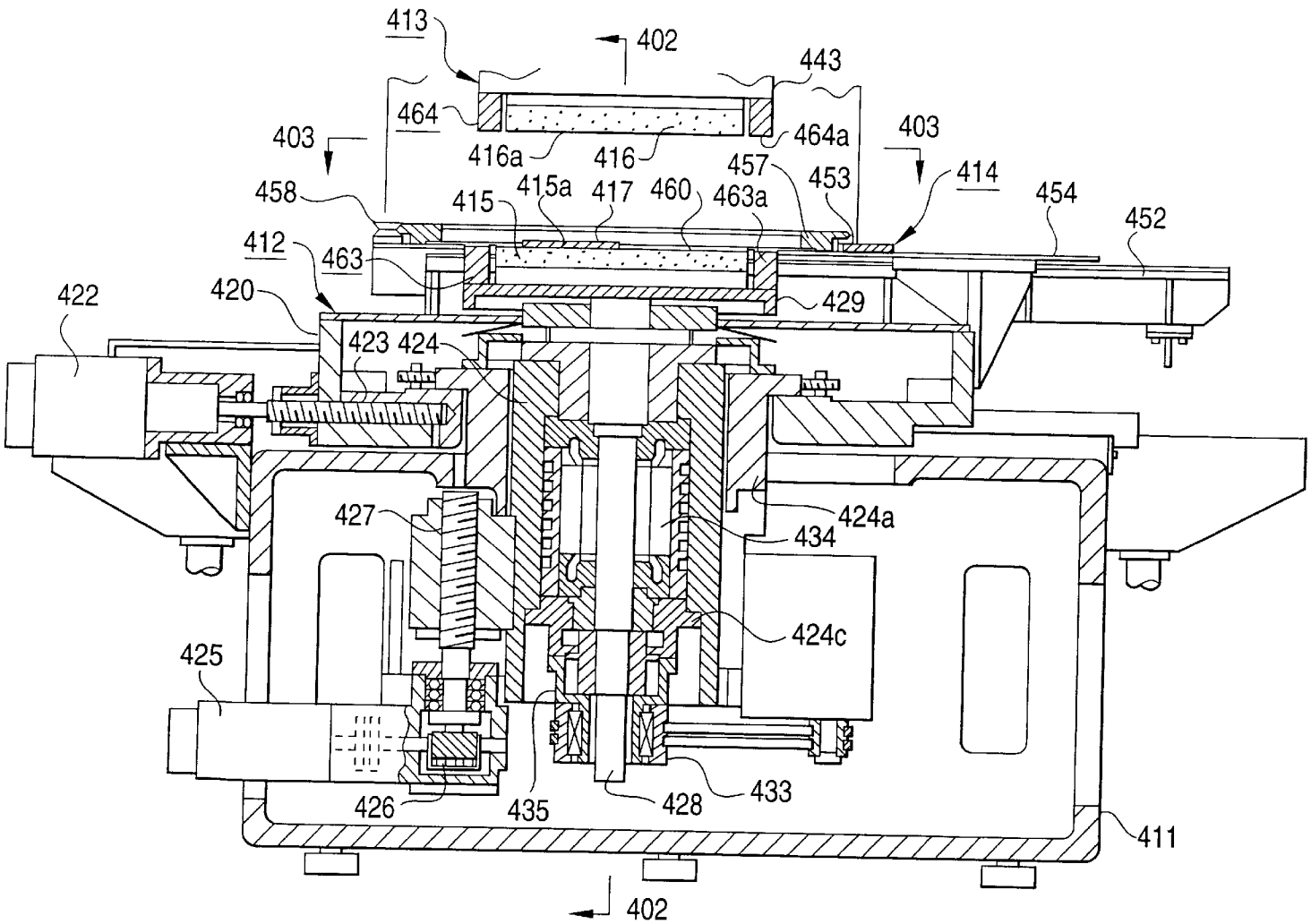
FIG. 54 is a cross-sectional view showing a lower frame.
Figure 55:
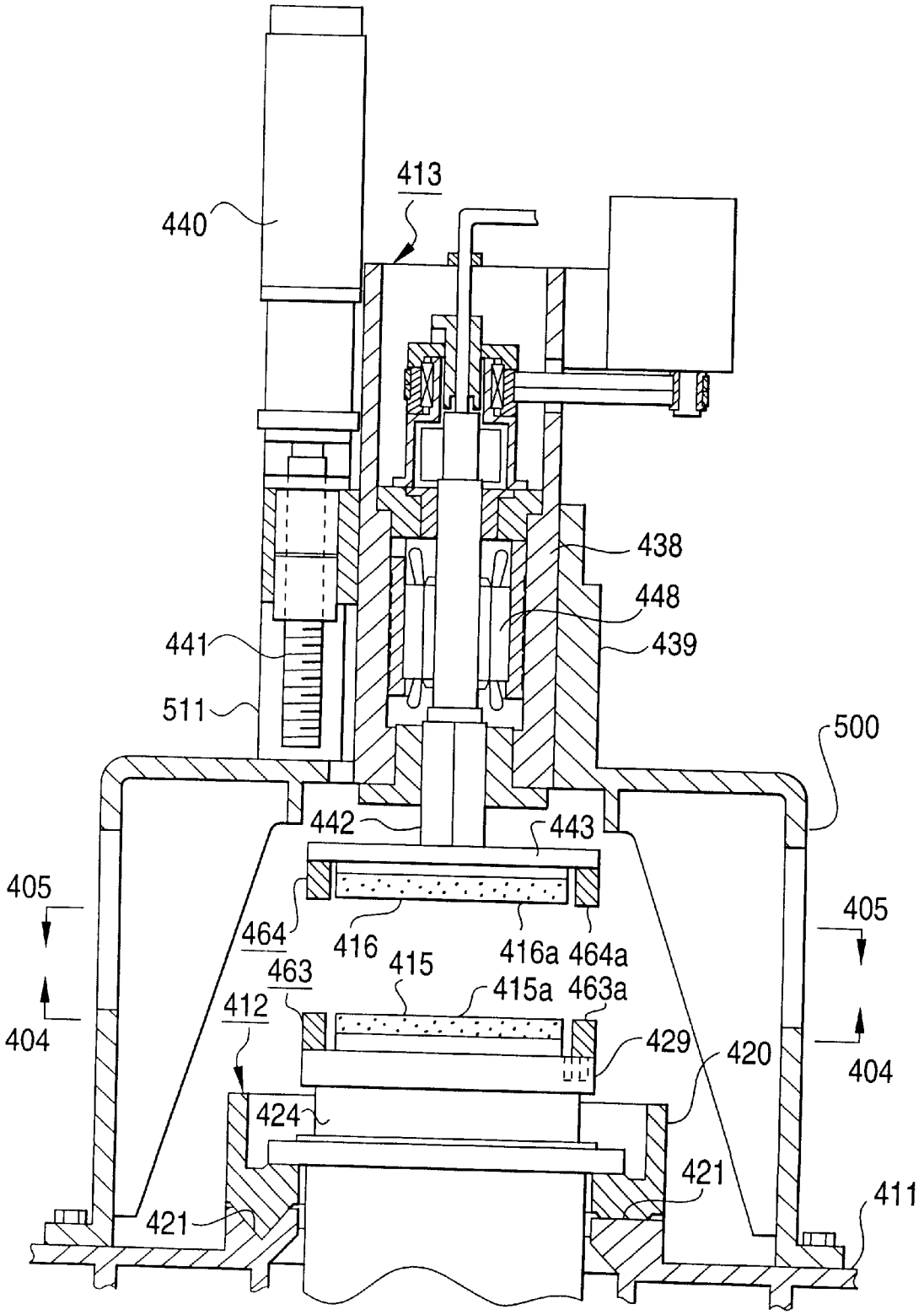
FIG. 55 is a cross-sectional view showing an upper frame.

As shown in FIGS. 54 and 55, a grinding wheel table 420 of the lower grinding wheel feed unit 412 is supported on the lower frame 411 by a guide 421 so as to be movable in the direction orthogonal to the axis of rotation of the lower grinding wheel 415. A motor 422 for traveling the lower grinding wheel 415 is disposed at the side of the lower frame 411. As a result of rotation of the motor 422, the grinding wheel table 420 horizontally travels by a ball screw 423. A spindle guide 424 is supported by a guide 424*a* so as to be movable in the direction of rotation axis of the lower grinding wheel 415. A motor 425 for feeding a lower grinding wheel is disposed below the grinding wheel table 420. As a result of rotation of the motor 425, the spindle guide 424 is raised or lowered by a torque transfer mechanism 426 comprising a warm gear and a warm wheel and a ball screw 427. This feeding stroke is small.

A rotary shaft 428 (so called spindle) is rotatably supported within the spindle guide 424, and the grinding wheel 415 is attached to the upper end of the rotary shaft by a grinding wheel holder 429. A machining motor 434 is provided in the spindle guide 424, and, at the time of a grinding operation, the grinding wheel 415 rotates at high speed by rotation of the machining motor 434 by the rotary shaft 428 and the grinding wheel holder 429.

Figure 56:
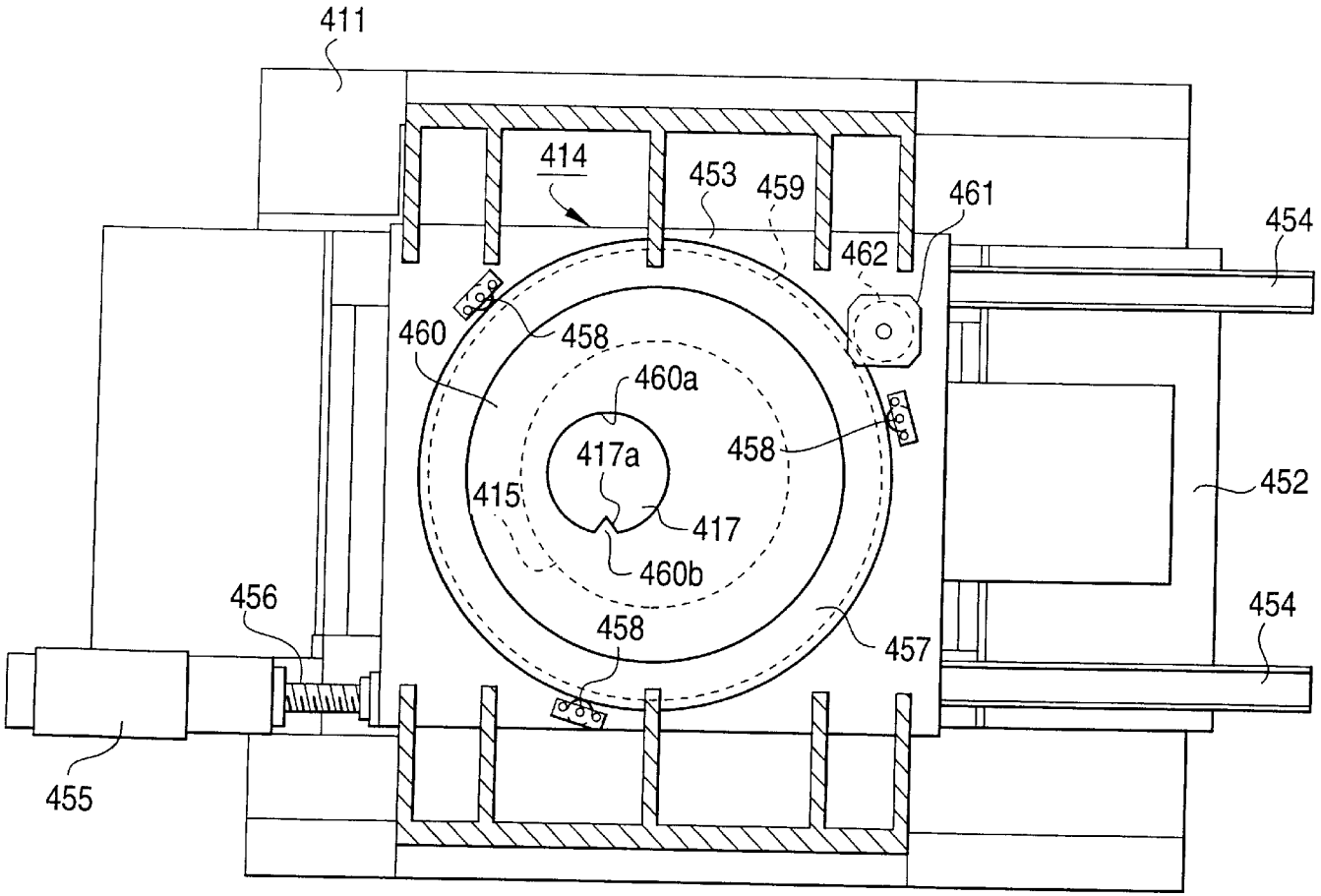
FIG. 56 is a plan view showing a workpiece retaining mechanism.

As shown in FIGS. 55 and 56, a spindle guide 438 of the upper grinding wheel feed unit 413 is supported by a vertical guide 439 so as to be movable in the direction of rotation axis of the grinding wheel 416. A hosting/lowering motor 440 is disposed at the side of the upper frame 511. As a result of rotation of the motor 440, the spindle guide 438 is raised or lowered by a ball screw 441.

A rotary shaft 442 is rotatably supported within the spindle guide 438, and the grinding wheel 416 is supported on the lower end of the rotary shaft by a grinding wheel holder 443. A machining motor 448 of a built-in type is provided in the spindle guide 438, and at the time of a grinding operation the grinding wheel 416 rotates at high speed by rotation of the motor 448 by the rotary shaft 442 and the spindle guide 443.

As shown in FIGS. 54, 56, 57, and 59, a support table 452 of the workpiece support member 414 is laid on the lower frame 411 between lower and upper grinding wheel feed units 412, 413. A movable frame 453 is supported by a pair of guide rails 454 disposed on the support table 452 so as to be movable in the same direction in which the grinding wheel table 420 of the lower grinding wheel feed unit 412 is moved. A motor 455 for traveling a slide table is mounted on the support table 452. As a result of rotation of the motor 455, the movable. frame 453 is moved by a ball screw 456.

Figure 59:
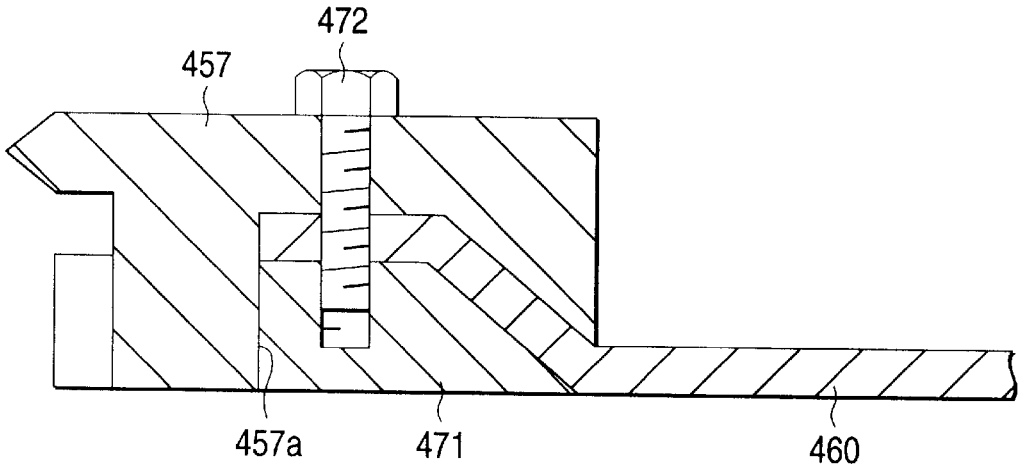
FIG. 59 is a fragmentary enlarged cross-sectional view showing the end of the workpiece retaining mechanism.

As shown in FIG. 56, a circular rotary disk 457 is disposed within the movable frame 453 and is rotatably supported by three guide rollers 458. A gear 459 is formed along the lower periphery of the rotary disk 457. As shown in FIG. 59, a press ring 471 is provided along a peripheral groove 457*a* formed in the lower surface of the rotary disk 457. The tip end of each bolt 472 is screwed into the press ring 471 so as to pass through the rotary disk 457. A circular workpiece support plate 460 which serves as a workpiece support member is sandwiched between the rotary disk 457 and the press ring 471. The overall workpiece support plate 460 which is susceptible to permanent deformation is held in a stretched/tensioned state by fastening the bolts 472 so as not to become warped under its own weight.

Figure 60:
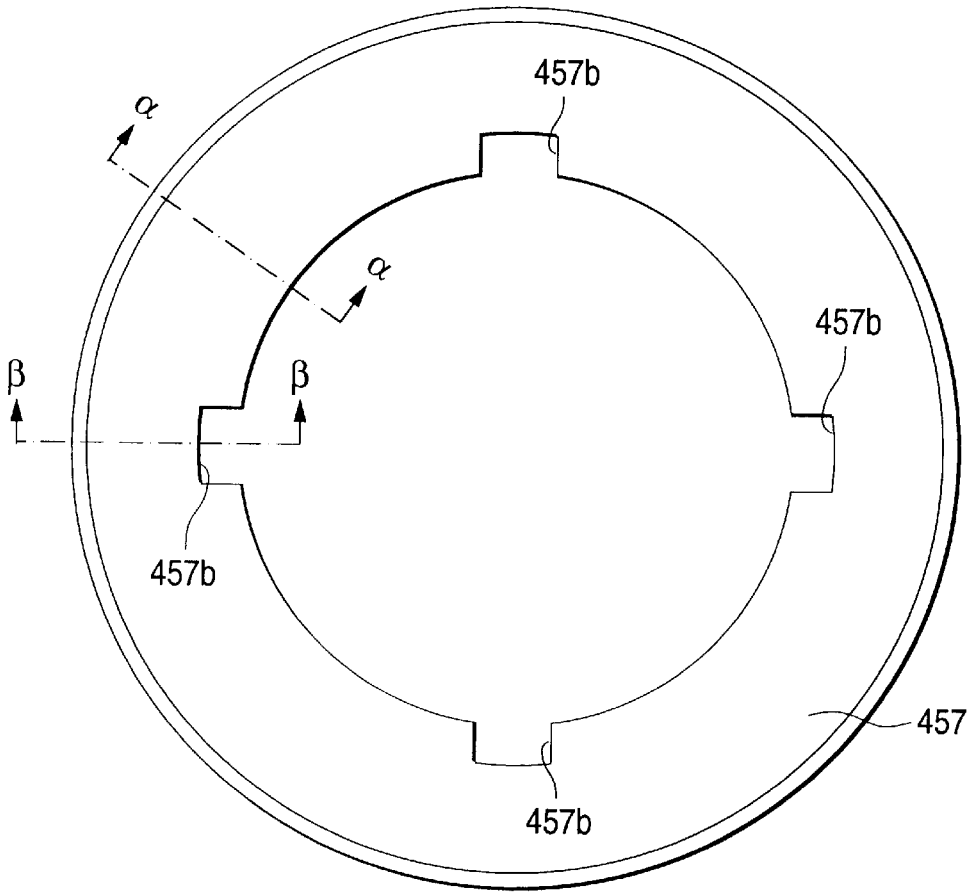
FIG. 60A is a plan view showing a rotary disk.
FIG. 60B shows a cross-sectional view showing the rotary disk taken across line α—α shown in FIG. 60A.
FIG. 60C is a cross-sectional view taken across line β—β shown in FIG. 60A.
Figure 60:
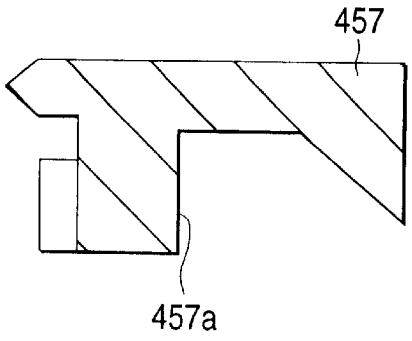
Figure 60:
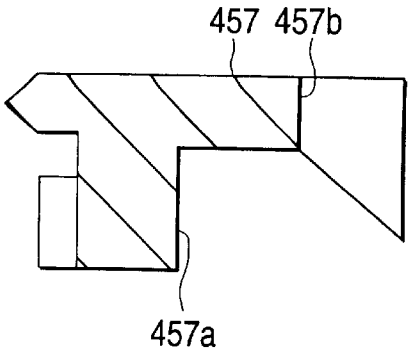
Figure 61:
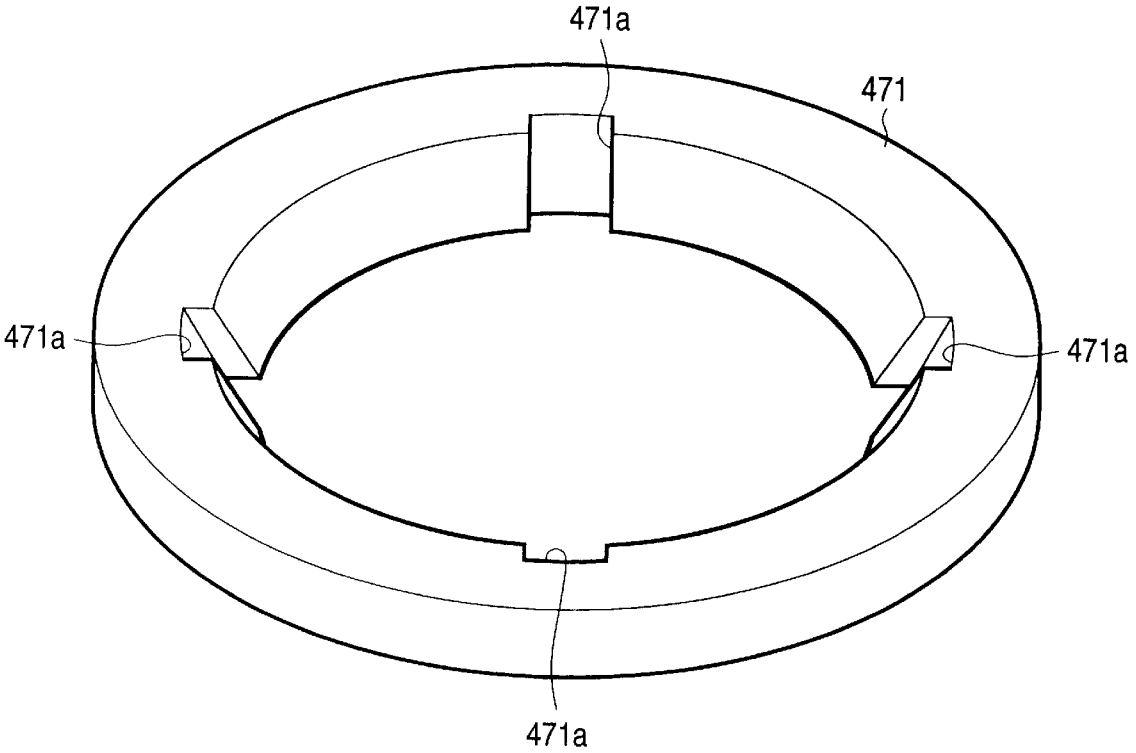
FIG. 61 is a perspective view showing a press ring.
Figure 62:
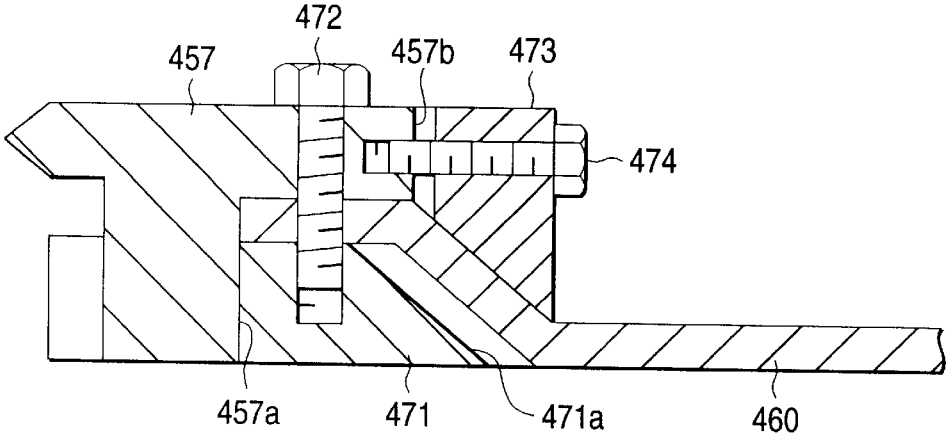
FIG. 62 is a fragmentary enlarged cross-sectional view showing the end of the workpiece retaining mechanism.

As shown in FIGS. 60A to 60C, a plurality of notches 457*b* (four notches shown in the drawings) are formed in the rotary disk 457. Further, as shown in FIG. 61, a plurality of grooves 471*a* (four grooves shown in the drawing) are formed in the press ring 471. Still further, as shown in FIG. 62, a press piece 473 is fitted to the notch 457*b* of the rotary disk 457 in its radial direction by a bolt 474. A clearance is formed between the notch 457*b* of the rotary disk 457 and the press piece 473, and the foregoing grooves 471*a* are formed in the press ring 471 so as to correspond to the notches. Accordingly, even if the workpiece support plate 460 becomes warped upon receipt of pressing force from the press piece 473, the workpiece support plate 460 becomes further deformed and enters the groove 471*a* toward the outside in the radial direction, so that the workpiece support plate 460 returns to the stretch/tensioned state.

A receiving hole 460*a* is formed in the vicinity of the center of the workpiece support plate 460 with a view to allowing removal of the workpiece 417 from or attachment of the same to the workpiece support plate. As shown in FIG. 56, the center of the receiving hole 460*a* is in alignment with or is slightly offset from the center of the workpiece support plate 460. Further, an engagement protuberance as a workpiece drive section 460*b* is formed along the inner periphery of the receiving hole 460*a*. The workpiece drive section 460*b* can engage the notch 417*a* formed in the workpiece 417. A motor 461 for rotating purpose is disposed on the movable frame 453, and a gear 462 which meshes the gear 459 of the rotary disk 457 is fixed to the shaft of the motor. As a result of rotation of the motor 461, the rotary disk 457 is rotated at low speed through the gears 462, 459.

Figure 57:
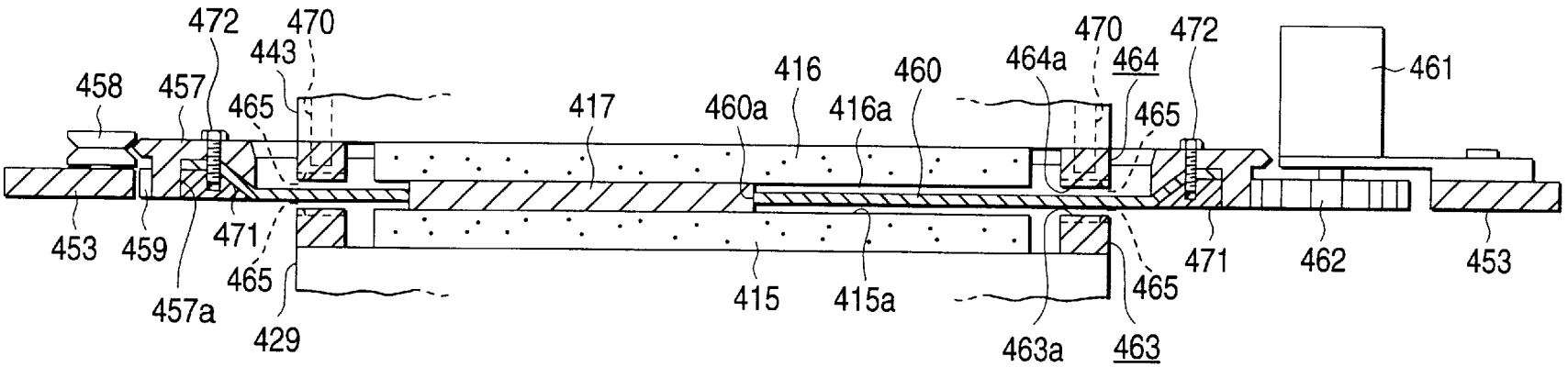
FIG. 57(*a*) is an enlarged cross-sectional view showing a workpiece retaining mechanism when a workpiece having a diameter larger than the outer diameter of the grinding wheel is being ground, and FIG. 57(*b*) is an enlarged cross-sectional view showing a workpiece retaining mechanism when a workpiece having a diameter smaller than the outer diameter of the grinding wheel is being ground.
Figure 57:
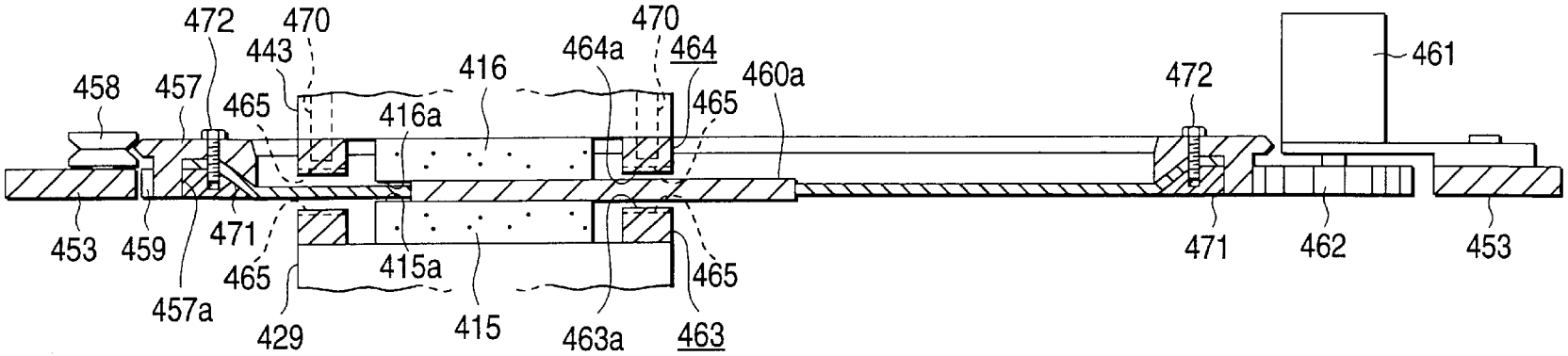

As shown in FIGS. 54, 55, and 57(*a*) or 57(*b*), an annular lower rotational ring 463 is seated in alignment with the axis of the grinding wheel holder 429 along the outer periphery of the grinding wheel holder 429 so as to become opposite to the workpiece support plate 460, and an annular upper rotational ring 464 is seated in alignment with the axis of the grinding wheel holder 443 along the outer periphery of the grinding wheel holder 443 so as to become opposite to the workpiece support plate 460. The rotational rings are removably secured by screws 470 so as to surround the grinding wheels 415, 416, respectively. The upper and lower rotational rings 464 and 463 have the same diameter and are spaced away from the workpiece support plate 460, thereby forming a small clearance.

Figure 58:
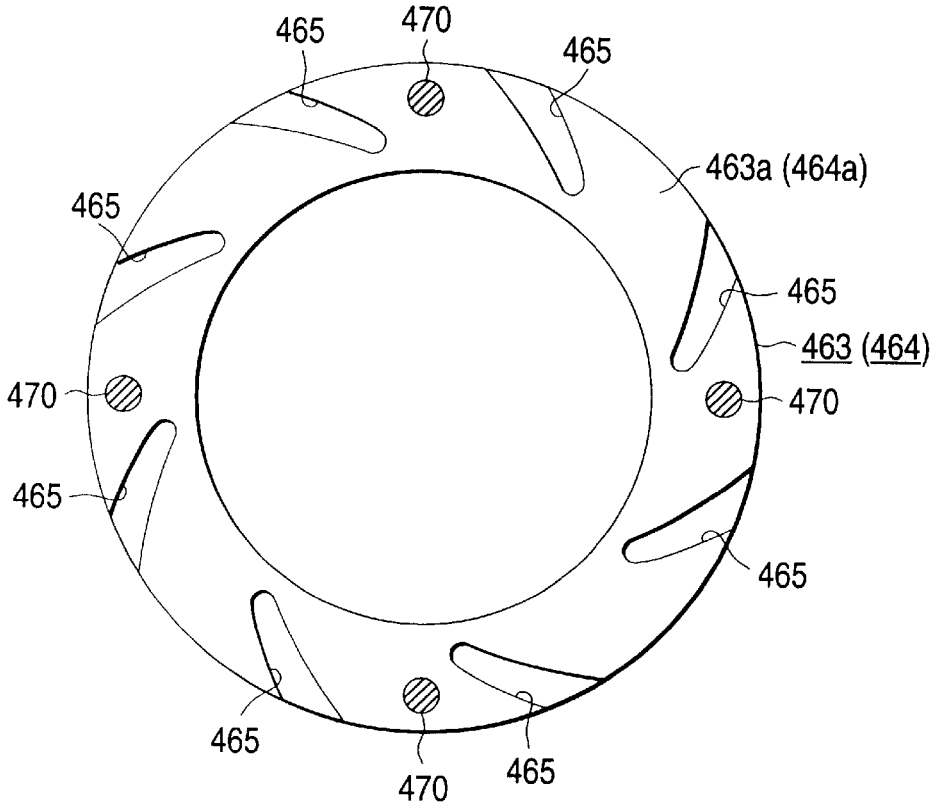
FIG. 58 is a plan view showing a ring.

As shown in FIG. 58, an irregular surface 463*a*, on which a plurality of projections and a plurality of recesses are provided, is formed on the rotational ring 463 opposite the rotational ring 464, and an irregular surface 464*a* is formed on the rotational ring 464 opposite the rotational ring 463. A plurality of helical slots 465 are formed at equivalent intervals in the respective irregular surfaces 463*a*, 464*a*, The slots 465 are formed to the depth ranging from micrometers to several tens of micrometers in the same circumference at equivalent intervals.

The operation of the double disc surface grinder having the foregoing structure will now be described.

In a case where a grinding operation is carried out through use of the double disc surface grinder, while being fittingly supported in the workpiece support plate 460 of the workpiece support member 414, the workpiece 417 is inserted and placed between the grinding wheels 415, 416 of the lower and upper grinding wheel feed units 412, 413 so as to be placed on the lower grinding wheel 415. Further, as a result of rotation of the motor 461, the rotary disk 457 is rotated by the gears 459, 462, thereby rotating the workpiece 417 at low speed within the horizontal plate while being sandwiched between the grinding wheels 415, 416. In this state, the lower and upper grinding wheels 415, 416 of the lower and upper grinding wheel feed units 412, 413 are rotated at high speed, and the grinding wheel 416 of the upper grinding wheel feed unit 413 is lowered close to the workpiece 417. Accordingly, both surfaces of the workpiece 417 are simultaneously ground by the grinding surfaces 415*a*, 416*a* of the grinding wheels 415, 416.

As mentioned previously, during the grinding of the workpiece 417, the rotational rings 463, 464 are rotated at high speed together with the grinding wheels 415, 416. Since there is a minute clearance between the workpiece support plate 460 and the rotational ring 463, as well as between the workpiece support plate 460 and the rotational ring 464, dynamic pressure arises in the clearances. By virtue of the thus-developed dynamic pressure, the workpiece support plate 460 is held in a horizontal state, thereby keeping the grinding surfaces 415*a*, 416*a* of the grinding wheels 415, 416 from contact with the workpiece support plate 460.

The grinding wheels 415, 416 are reduced in thickness through being used for a grinding or dressing operation. Accordingly, the positional relationship between the workpiece support plate 460 and the rotational rings 463, 464 changes according to a variation in thickness of the grinding wheels. Therefore, any one of the following countermeasures is taken against a change in the positional relationship.

If there is a decrease in thickness of the grinding wheels 415, 416, the rotational rings 463, 464 are ground by a dressing operation in such a way as to correspondingly reduce the thickness of the rotational rings 463, 464. In such a case, with a view toward preventing elimination of the slots 465, the slots 465 are deeply formed.

The rotational rings 463, 464 are set so as to have small thickness beforehand, allowing for a reduction in the thickness of the grinding wheels 415, 416. In such a case, since the clearance between the rotational ring 463 and the workpiece support plate 460, as well as between the rotational ring 464 and the same, becomes great until the rotational rings 463, 464 become thinner, the depth, number, and geometry of the slots 465 are set so as produce strong dynamic pressure.

Elements of different thickness types, each having slot 465, may be prepared, and these elements of one type are replaced with that of the other type so as to correspond to a reduction in thickness of the rotational rings 463, 464.

Advantageous results of the present embodiment will be described hereinbelow.

By virtue of the dynamic pressure occurring between the grinding wheel holder 428 and the workpiece support member 460, as well as between the grinding wheel holder 443 and the. workpiece support member 460, the workpiece support plate 460 can be retained while being kept from non-contact with the grinding wheels 415, 416. Accordingly, the workpiece support plate 460 can be prevented from being ground by the grinding wheels 415, 416.

Only the rotational rings 463, 464 are provided on the respective grinding wheel holder 429, 443, and the rings do not have any mobile portions. Accordingly, a structure in which the grinding wheels 415, 416 are prevented from being ground by the workpiece support plate 460 can be provided with a simple configuration.

Since the irregular surfaces 463*a*, 464*a*, containing a projecting surface and a recessed surface, are formed from helical slots 465, strong dynamic pressure arises, thereby ensuring prevention of contact between the workpiece support plate 460 and the grinding wheels 415, 416.

The foregoing embodiment may be formed in the following manner.

Figure 63:
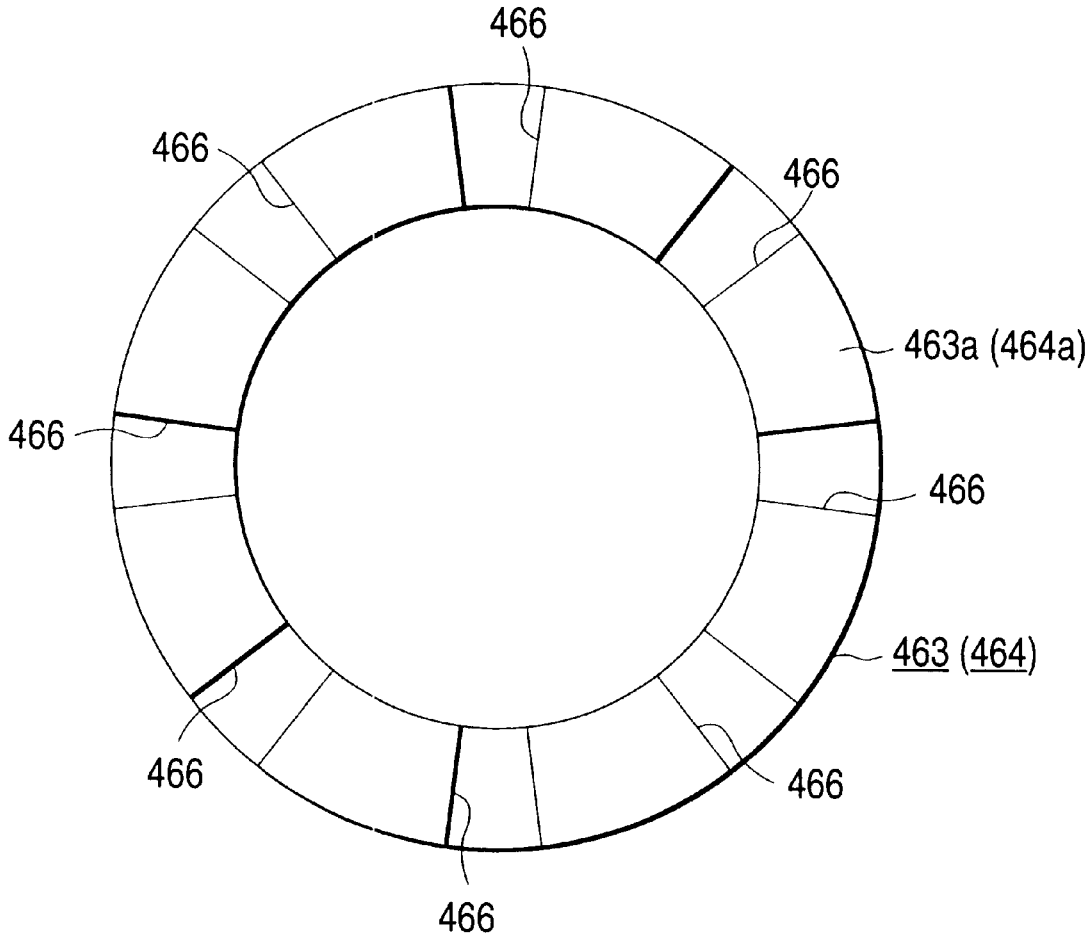
FIG. 63 is a plan view showing a ring according to another embodiment.

The geometry of the irregular surfaces 463*a*, 464*a* of the upper and lower rotational rings 463, 464 is changed, as needed. For example, as shown in FIG. 63, the irregular surfaces 463*a*, 464*a* are formed from the grooves made in the rotational rings 463, 464 in the radial direction thereof.

Pressure generation means is provided for the workpiece support plate 460. For example, an irregular sheet the surface of which contains projections and recesses, is labeled to each surface of the workpiece support plate 460, or the upper and lower surfaces of the workpiece support plate 460 are made irregular through rough machining. In this case, the grinding wheel holders 429, 443 may or may not be provided with pressure generation means. There is provided means for maintaining a small clearance between the workpiece support plate 460 and the grinder holder 429, as well as between the same and the grinder holder 443.

The rotational rings 463, 464 are integrally formed, respectively, with the grinding wheels 415, 416.

Next, technical ideas which are conceivable from and different from the foregoing embodiment will now be described together with their advantageous results.

The surface grinder according to the present invention is characterized by comprising the dynamic pressure generation means having an irregular surface for the purpose of generating dynamic pressure, and the irregular surface including a plurality of slots (465). With such a configuration, strong dynamic pressure can be generated.

The surface grinder according to the present invention is characterized by comprising the dynamic pressure generation means having an irregular surface, and the irregular surface which includes a plurality of slots (466) extending in the radial direction of a grinding wheel. With such a configuration, an irregular surface can be readily processed.

Since the present invention has the foregoing configuration, there are yielded the following advantageous results.

According to the invention, dynamic pressure is caused between a grinding wheel holder and a workpiece support member through use of dynamic pressure generation means, enabling the workpiece support member to be kept from contact with the grinding wheel. Consequently, the workpiece support member can be prevented from being ground by the grinding wheel. Further, since it is only required to provide the grinder with mere rings, the grinder can be implemented in simple structure.

While there has been described in connection with the preferred embodiment of the invention, it will be obvious to those skilled in the art that various changes and modifications may be made therein without departing from the invention, and it is aimed, therefore, to cover in the appended claim all such changes and modifications as fall within the true spirit and scope of the invention.

What is claimed is:

1. A surface grinder comprising:

a support member;

a rotary disk mounted on said support member for rotation, said rotary disk having one of a recess and a through hole for receiving a workpiece having an engaged portion, said rotary disk having a workpiece drive section for engaging with said engaged portion of said workpiece to rotationally fix together said rotary disk and said workpiece, said work piece being positively driven to rotate by said rotary disk; and a grinding wheel for grinding a work surface of said workpiece;

wherein said engaged portion of said workpiece (1) is one of a notch and an orientation flat formed on an outer periphery of said workpiece and (2) defines a crystal orientation of said workpiece.

2. The surface grinder as defined in claim 1, wherein said grinding wheel is an upper grinding wheel which is arranged so as to be opposite to the upper surface of said workpiece in the vertical direction of the surface grinder, and the recess is formed in the rotary disk.

3. The surface grinder as defined in claim 1, wherein the grinding wheel comprises upper and lower grinding wheels arranged so as to respectively face both surfaces of the workpiece in the vertical direction of the surface grinder; and the through hole is formed in the rotary disk.

4. The surface grinder as defined in claim 1, wherein the grinding wheel is a cup-shaped grinding wheel;

the workpiece is substantially circular; and the center of the workpiece is arranged so as to permit overlap between the center and the grinding surface of the cup-shaped grinding wheel.

5. The surface grinder as defined in claim 1, wherein said rotational drive means comprises:

a motor supported on the support member; and a torque transfer mechanism interposed between said motor and said rotary disk.

6. The surface grinder as defined in claim 1, wherein said workpiece drive section is formed from a material which is softer than that of said workpiece.

7. The surface grinder as defined in claim 1, wherein the rotary disk comprises:

a substantially-annular rotary metal plate body; and a workpiece loosely fitting member provided along the internal periphery of said rotary body and formed from a material which is softer than that of the workpiece.

8. The surface grinder as defined in claim 1, further comprising:

a work rest member operative to confront and support at least a part of said work surface of said workpiece when said grinding wheel grinds said work surface.

9. The surface grinder as defined in claim 1, further comprising:

a grinding wheel holder for supporting the grinding wheel; and a dynamic pressure generating means provided on at least either the grinding wheel holder or the rotary disk for generating dynamic pressure between said grinding wheel holder and said rotary disk.

10. The surface grinder as defined in claim 3, wherein the upper and lower grinding wheels are different from each other in terms of magnitude of grinding ability.

11. The surface grinder as defined in claim 5, wherein the support member comprises:

a slide table for rotatively supporting said rotary disk; and guide member, along which said slide table is movable, extended in a direction perpendicular to the rotational axis of said grinding wheel.

12. The surface grinder as defined in claim 7, wherein the workpiece drive section is integrally formed from the rotary disk.

13. The surface grinder as defined in claim 9, wherein the dynamic pressure generating means is provided in the grinding wheel holder so as to surround the grinding wheel.

14. The surface grinder as defined in claim 8, wherein said work rest member comprises:

an upper work rest for supporting an upper surface of said workpiece;

a lower work rest for supporting a lower surface of said workpiece.

15. The surface grinder as defined in claim 8, wherein said work rest member comprises:

a hydrostatic slide for supporting said work surface of said workpiece through a pressurized medium.

16. The surface grinder as defined in claim 8, further comprising:

means for moving said work rest member between (1) a supporting position in which said work rest member supports said work surface of said workpiece, and (2) a withdrawn position in which said work rest member is withdrawn from said workpiece.

17. A grinding method comprising the steps of:

fitting a workpiece into one of a recess and a through hole formed in a rotary disk in such a manner that a workpiece drive section formed on said rotary disk engages with an engaged portion formed in said workpiece to rotationally fix together said rotary disk and said workpiece, wherein said engaged portion of said workpiece (1) is one of a notch and an orientation flat formed on an outer periphery of said workpiece and (2) defines a crystal orientation of said workpiece;

rotating said rotary disk and said workpiece together, said workpiece being positively driven to rotate by said rotary disk; and grinding a work surface of said workpiece with a grinding wheel while said workpiece is being rotated.

18. The grinding method as defined in claim 17, wherein said fitting step comprises the step of fitting loosely said workpiece into said recess; and said workpiece grinding step comprises the step of grinding the upper surface of said workpiece thus fitted into said recess loosely through use of a grinding wheel.

19. The grinding method as defined in claim 17, wherein said fitting step comprises the step of loosely fitting said workpiece into said through hole; and said workpiece grinding step is the step of grinding both surfaces of said workpiece thus fitted into said through hole loosely through use of upper and lower grinding wheels.

20. The grinding method as defined in claim 17, wherein said grinding step is conducted with a cup-shaped grinding wheel the grinding surface of which is overlapped with the center of said workpiece.

21. The grinding method as defined in claim 17, further comprising the step of:

simultaneously with said grinding step, supporting at least a part of said work surface with a work rest member that confronts said work surface.

22. The grinding method as defined in claim 19, wherein said step of grinding the upper and lower surfaces of the workpiece comprises the steps of:

grinding the upper surface of said workpiece with a certain magnitude of grinding ability; and grinding the lower surface of said workpiece with grinding ability which is different in magnitude from the grinding ability employed in the upper surface grinding step.

23. The grinding method as defined in claim 21, wherein said supporting step comprises the step of:

supporting said work surface of said workpiece with a pressurized medium through a hydrostatic slide.

24. A surface grinder comprising:

a workpiece support member for rotating a workpiece, said workpiece support member rotationally fixed to said workpiece;

a grinding wheel which is rotated to grind a work surface of said workpiece; and a work rest for confronting and supporting at least a part of said work surface of said workpiece when said grinding wheel grinds said work surface.

25. The surface grinder as defined in claim 24, wherein said work rest member comprises:

an upper work rest for supporting an upper surface of said workpiece; and a lower work rest for supporting a lower surface of said workpiece.

26. The surface grinder as defined in claim 24, wherein said work rest member comprises:

a hydrostatic slide for supporting said work surface of said workpiece by use of a pressurized medium.

27. The surface grinder as defined in claim 24, further comprising:

means for moving said work rest member between (1) a supporting position in which said work rest member said work surface of said workpiece, and (2) a withdrawn position in which said work rest member is withdrawn from said workpiece.

28. The surface grinder as defined in claim 24, wherein an outer diameter of said grinding wheel is substantially half an outer diameter of said workpiece.

29. The surface grinder as defined in claim 24, wherein said grinding wheel comprises a cup-shaped grinding wheel.

30. The surface grinder as defined in claim 27, wherein said moving means comprises an arm member supported by a pivot provided in parallel to a rotational axis of said grinding wheel said work rest disposed on said arm member.

31. A work rest comprising:

a workpiece supporting member, disposed in a surface grinder which grinds a work surface of a workpiece while said workpiece is (1) rotated around a center axis of said workpiece and (2) brought into engagement with an end face of a grinding wheel, wherein said workpiece supporting member confronts and supports at least a part of said work surface of said workpiece when said grinding wheel grinds said work surface.

32. The work rest as defined in claim 31, wherein said workpiece supporting member comprises:

an upper workpiece supporting member for supporting an upper surface of said workpiece; and a lower workpiece supporting member for supporting a lower surface of said workpiece.

33. The work rest as defined in claim 31, wherein said workpiece supporting member is a hydrostatic slide that supports said work surface of said workpiece through a pressurized medium.

34. The work rest as defined in claim 31, further comprising:

means for moving said work rest member between (1) a supporting position in which said work rest member said work surface of said workpiece, and (2) a withdrawn position in which said work rest member is withdrawn from said workpiece.

35. The work rest as defined in claim 34, wherein said moving means comprises an arm member supported by a pivot provided in parallel to a rotational axis of said grinding wheel said work rest disposed on said arm member.

36. A grinding method comprising the steps of:

rotating a grinding wheel;

rotating a workpiece that is rotationally fixed to a rotatable disk;

grinding a work surface of said workpiece while said grinding wheel being rotated is brought in contact with said work surface of said rotating workpiece; and simultaneously with said grinding step, supporting at least part of said work surface with a work rest member that confronts said work surface.

37. The grinding method as defined in claim 36, wherein said supporting step comprises the step of:

supporting said work surface by means of a hydrostatic slide through use of a pressurized medium.

38. The grinding method as defined in claim 36, wherein said grinding step comprises the steps of:

grinding an upper surface of said workpiece through use of an upper grinding wheel, and grinding a lower surface of said workpiece through use of a lower grinding wheel; and said supporting step comprises the steps:

supporting at least either the upper or the lower surface of said workpiece.

39. A workpiece support mechanism comprising:

a support member; and a rotary disk mounted on said support member for rotation, said rotary disk having one of a recess and a through hole that receives a workpiece having an engaged portion, said rotary disk having a workpiece drive section for engaging with said engaged portion of said workpiece to rotationally fix together said rotary disk and said workpiece, said workpiece having a work surface that slides across a grinding surface when said rotary disk rotates, said workpiece being positively driven to rotate by said rotary disk;

wherein said engaged portion of said workpiece (1) is one of a notch and an orientation flat formed on an outer periphery of said workpiece and (2) defines a crystal orientation of said workpiece; and wherein said support mechanism accommodates said workpiece without pulling a vacuum.

* * * * *